US007266981B2

(12) United States Patent
Flory et al.

(10) Patent No.: US 7,266,981 B2
(45) Date of Patent: Sep. 11, 2007

(54) LOCKER LOCK

(75) Inventors: Edward Flory, Crown Point, IN (US); Christopher Haczynski, Crown Point, IN (US)

(73) Assignee: Master Lock Company LLC, Oak Creek, WI (US)

( * ) Notice: Subject to any disclaimer, the term of this patent is extended or adjusted under 35 U.S.C. 154(b) by 166 days.

(21) Appl. No.: 10/605,693

(22) Filed: Oct. 17, 2003

(65) Prior Publication Data

US 2004/0182120 A1 Sep. 23, 2004

Related U.S. Application Data

(60) Provisional application No. 60/419,250, filed on Oct. 17, 2002.

(51) Int. Cl.
*E05B 37/00* (2006.01)

(52) U.S. Cl. ..... 70/284; 70/285; 70/314; 70/315

(58) Field of Classification Search ..... 70/284, 70/285, 314–316
See application file for complete search history.

(56) References Cited

U.S. PATENT DOCUMENTS

| | | | | | |
|---|---|---|---|---|---|
| 1,909,393 | A * | 5/1933 | Diesel | 70/445 |
| 1,909,453 | A * | 5/1933 | Brown | 70/445 |
| 1,937,165 | A * | 11/1933 | Piagneri | 70/284 |
| 2,002,453 | A * | 5/1935 | North | 70/285 |
| 2,035,781 | A * | 3/1936 | Bell | 70/285 |
| 2,047,795 | A * | 7/1936 | North | 70/153 |
| 2,110,094 | A * | 3/1938 | Pauloski et al. | 70/284 |
| 2,168,621 | A * | 8/1939 | Lane et al. | 70/285 |
| 2,251,145 | A * | 7/1941 | Machinist | 70/285 |
| 2,424,396 | A * | 7/1947 | Heyer | 70/285 |
| 2,481,099 | A * | 9/1949 | Formo et al. | 70/285 |
| 3,383,886 | A * | 5/1968 | Hermann | 70/284 |
| 3,395,557 | A * | 8/1968 | Berkowitz | 70/285 |
| 3,529,454 | A * | 9/1970 | Fish | 70/271 |
| 3,572,069 | A * | 3/1971 | Junkunc | 70/285 |
| 3,903,718 | A * | 9/1975 | Fish | 70/156 |
| 4,104,896 | A * | 8/1978 | Hahn | 70/310 |
| 4,325,240 | A * | 4/1982 | Gable | 70/284 |
| 4,616,492 | A * | 10/1986 | Barfield | 70/284 |
| 4,726,204 | A * | 2/1988 | Peyronnet | 70/315 |
| 4,770,013 | A * | 9/1988 | Nakai | 70/285 |
| 4,885,923 | A * | 12/1989 | Nakai | 70/284 |
| 4,901,545 | A * | 2/1990 | Bacon et al. | 70/278.3 |
| 5,113,675 | A * | 5/1992 | Uyeda | 70/477 |
| 6,508,089 | B1 * | 1/2003 | Tsai | 70/213 |
| 6,708,538 | B1 * | 3/2004 | Walby | 70/285 |

* cited by examiner

*Primary Examiner*—Suzanne Dino Barrett
(74) *Attorney, Agent, or Firm*—Calfee, Halter & Griswold LLP

(57) ABSTRACT

A locker lock that provides for increased security and ease of use. The locker lock can be a vertical built-in lock or a horizontal built-in lock. In each case the lock is symmetrical such that it can be used in either right-handed or left-handed lockers. The locker lock provides for increased security by increasing the distance the lock bolt must travel. The locker lock also provides for an easy combination changing mechanism, such that the combination can be changed without opening the lock and the locker lock can accommodate a large number of lock combinations.

5 Claims, 53 Drawing Sheets

LOCKER LOCK

CROSS REFERENCE TO RELATED APPLICATIONS

This invention claims priority to U.S. Provisional Patent Application Ser. No. 60/419,250, entitled LOCKER LOCK DIAL filed Oct. 17, 2002.

BACKGROUND OF INVENTION

Lockers have been around for many years as a means of preventing the unauthorized access of others to articles contained within the locker. Over the years, locks have been made in many different shapes and sizes, and with their respective right-hand and left-hand door models, for many applications. The locker designs have changed slightly, but the locker locking mechanism has stayed fairly constant.

Typically, locker locking mechanisms consist of two types: the single-point latching mechanism and the multiple-point latching system. Both types of locker locking mechanisms are positioned furthest from the hinges and nearest the edge of the locker door that opens, and in the center position of that edge. This increases the strength of the locking mechanism by providing the best possible mechanical advantage. The single-point latching system provides a single point where the locker door is prohibited from opening. This type of latching system typically is designed to utilize either a hang-on lock or a horizontal built-in lock. The multiple-point latching mechanism provides multiple points where the locker door is prohibited from opening. The multiple-point latching system typically is designed to utilize either a hang-on lock or a vertical built-in lock.

Historically there have been three types of built-in locker locks: the vertical built-in lock; the horizontal built-in spring bolt; and the horizontal built-in dead bolt. Each of these locks have been designed to accommodate both the right-hand and the left-hand door models, doubling the total number of built-in locks used for locker to six.

The vertical built-in lock is named for the relative movement of its locking bolt and assembly to the locker. Present vertical built-in locks are available for both right-handed and left-handed doors through the use of multiple models. Present vertical built-in locks provide for a certain amount of movement of the locking bolt. The amount of movement in which the locking bolt can move can lead to manipulation of the lock by flexing the locker, thereby allowing the locker rods to be removed from their respective locking positions, and compromising the locker lock integrity.

Both the horizontal built-in spring bolt and the horizontal built-in dead bolt are named for their relative locking bolt movements, and their particular modes of locking. Both of the horizontal build-in locks have a designed degree of movement allotted to the locking bolt. This amount of movement can lead to manipulation of locker lock by flexing the locker. This is especially true on larger lockers. As with the vertical built-in locks, flexing of the locker can allow for movement of the locking bolt, thereby allowing for the locker door to be opened.

Present horizontal built-in dead bolt designs provide for increased security, as compared with the present horizontal built-in spring bolt designs; however the increased security compromises the ease of use when locking and unlocking the locker. The horizontal dead-bolt design prohibits manipulation of the locking bolt by contact with objects that can fit through holes in the locker. To open the locker without a key, the combination must be dialed. Once the dial reaches the last combination, the lock is ready to open. Further turning of the dial pushes the locking bolt into the retracted or unlocked position, thereby allowing the locker door to open. The locking bolt is then left in the open position until the dial is turned back the opposite direction. The locker door must then be closed and the dial must be turned to extend the bolt to the locked position. This makes the locking dead bolt inconvenient to use, as the door and dial must simultaneously be manipulated in order to shut the locker.

Present horizontal built-in spring bolt designs provide for increased convenience over the horizontal built-in dead bolt, in that once the combination is dialed and the dial is turned further to push the locking bolt into the unlocked position, the locker door can be opened and closed without additional manipulation of the dial. This is because the bolt is spring-loaded. However, since the locking bolt is spring-loaded, it can be manipulated by pushing on the bolt with and object that passes through the locker holes or crevice between the door and the locker wall.

SUMMARY OF INVENTION

The present invention relates to a locker lock design that can be made into a vertical built-in latching mechanism or a horizontal built-in latching mechanism. The improved locker lock provides for a high degree of security as well as a high degree of convenience in use. The present locker lock also provides an improved locker combination change mechanism.

DESCRIPTION OF THE DRAWINGS

FIGS. 42-52 illustrate the present invention horizontal build-in lock assembly in the locked and unlocked position.

DETAILED DESCRIPTION

Operation of the Key-Operated Vertical Built-In Lock Assembly

Figure 1:
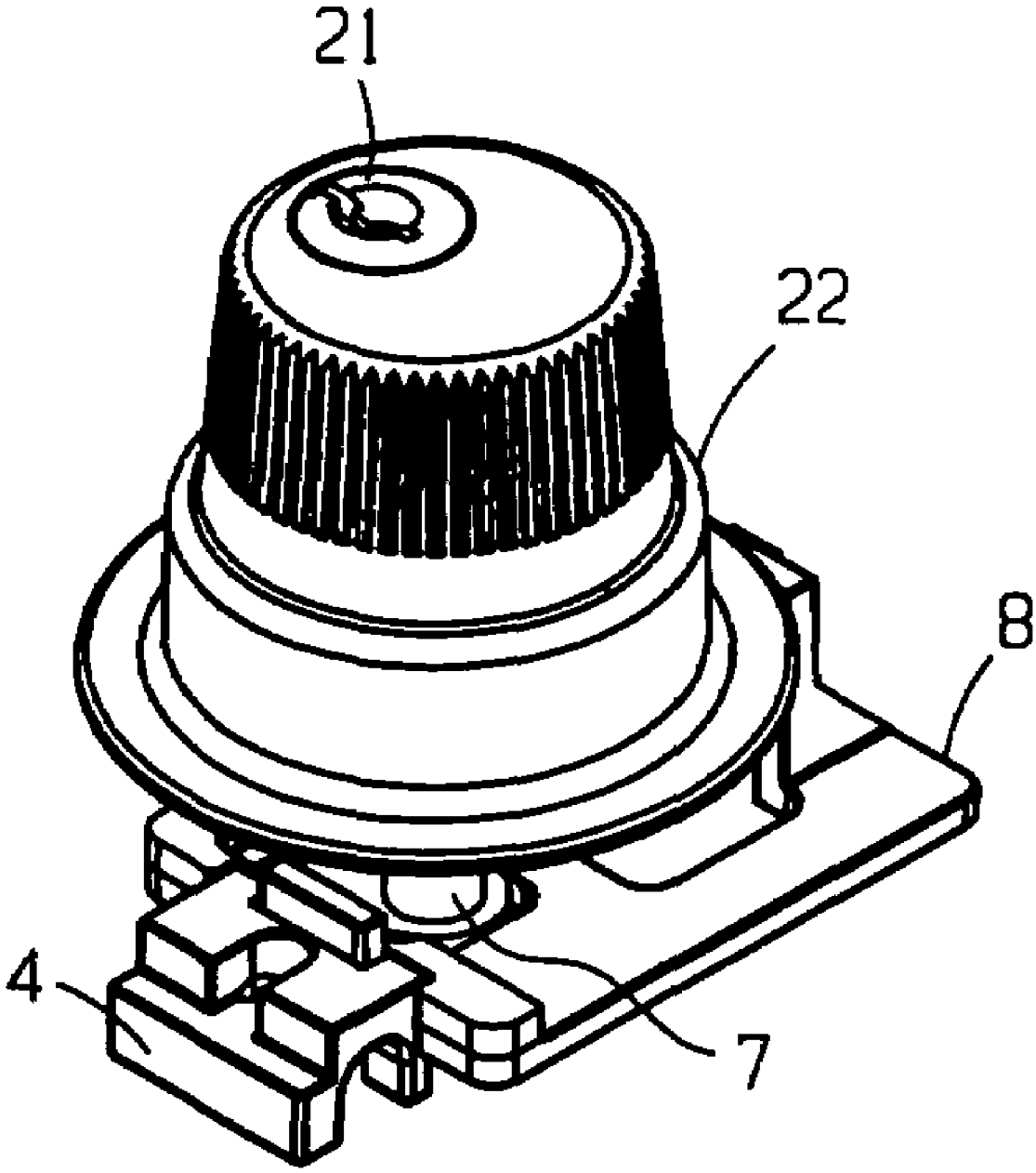
FIGS. 1-4 illustrate the present invention lock assembly, wherein the key cylinder is in the locked position.
Figure 2:
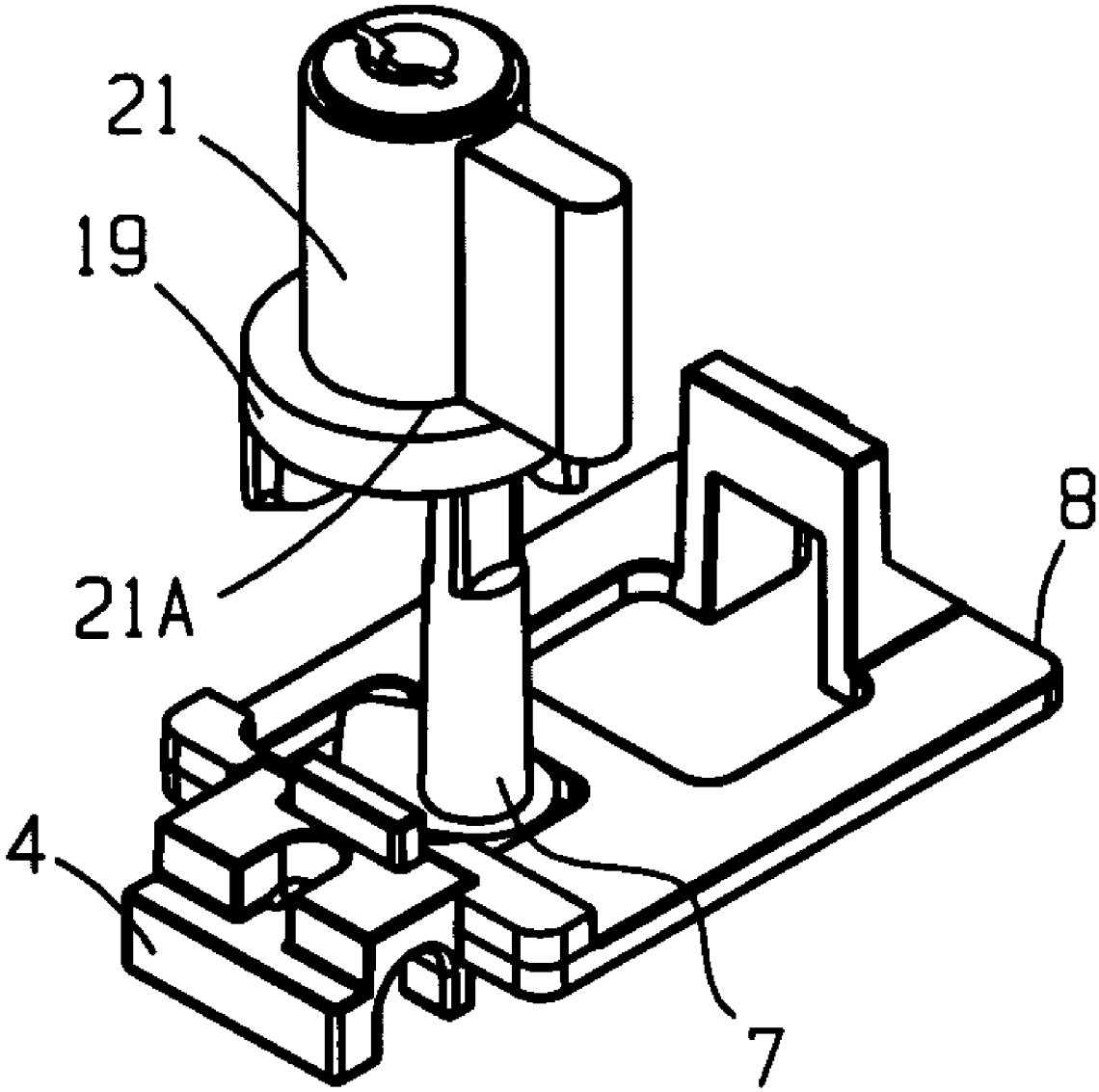
Figure 3:
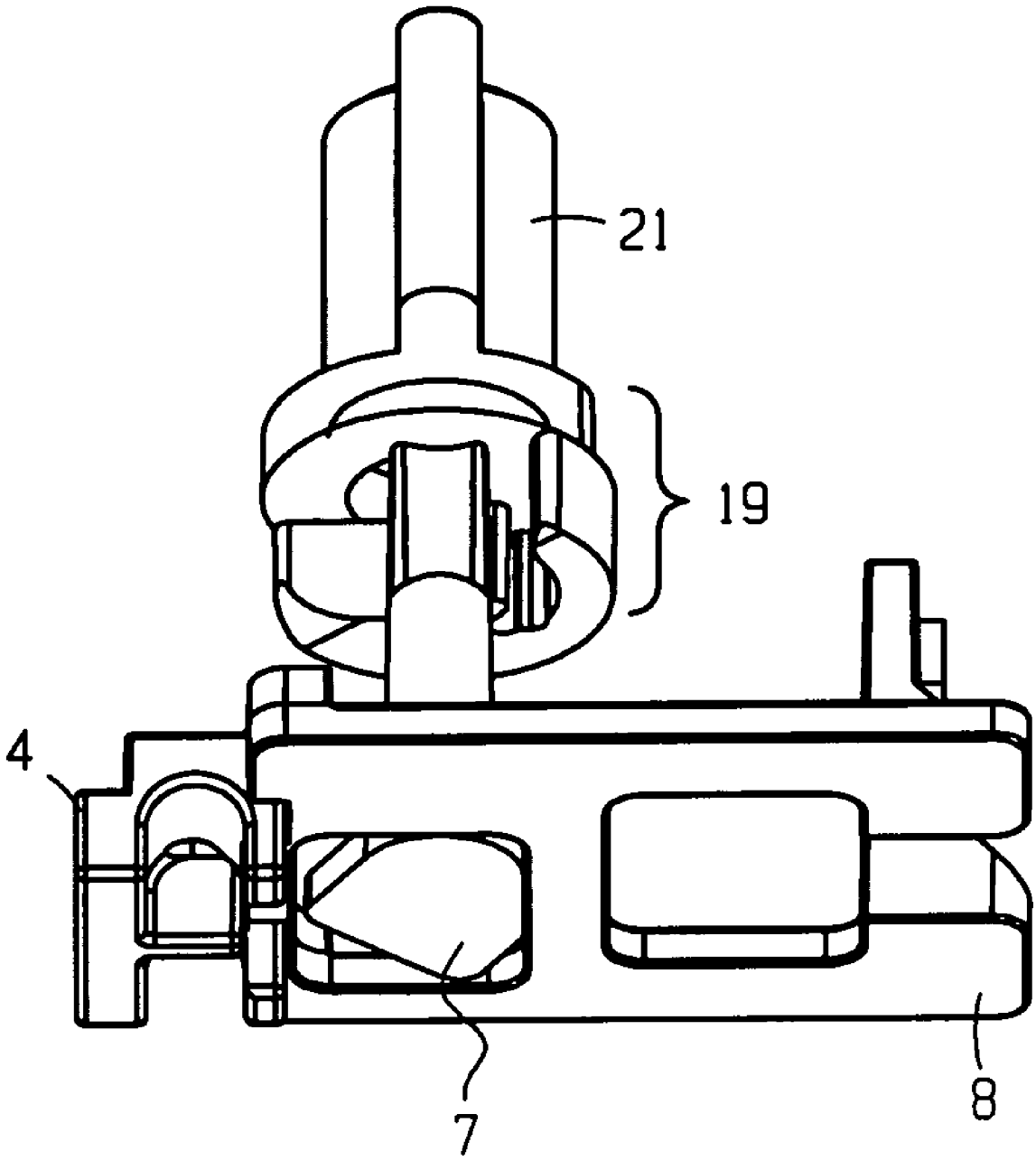
Figure 4:
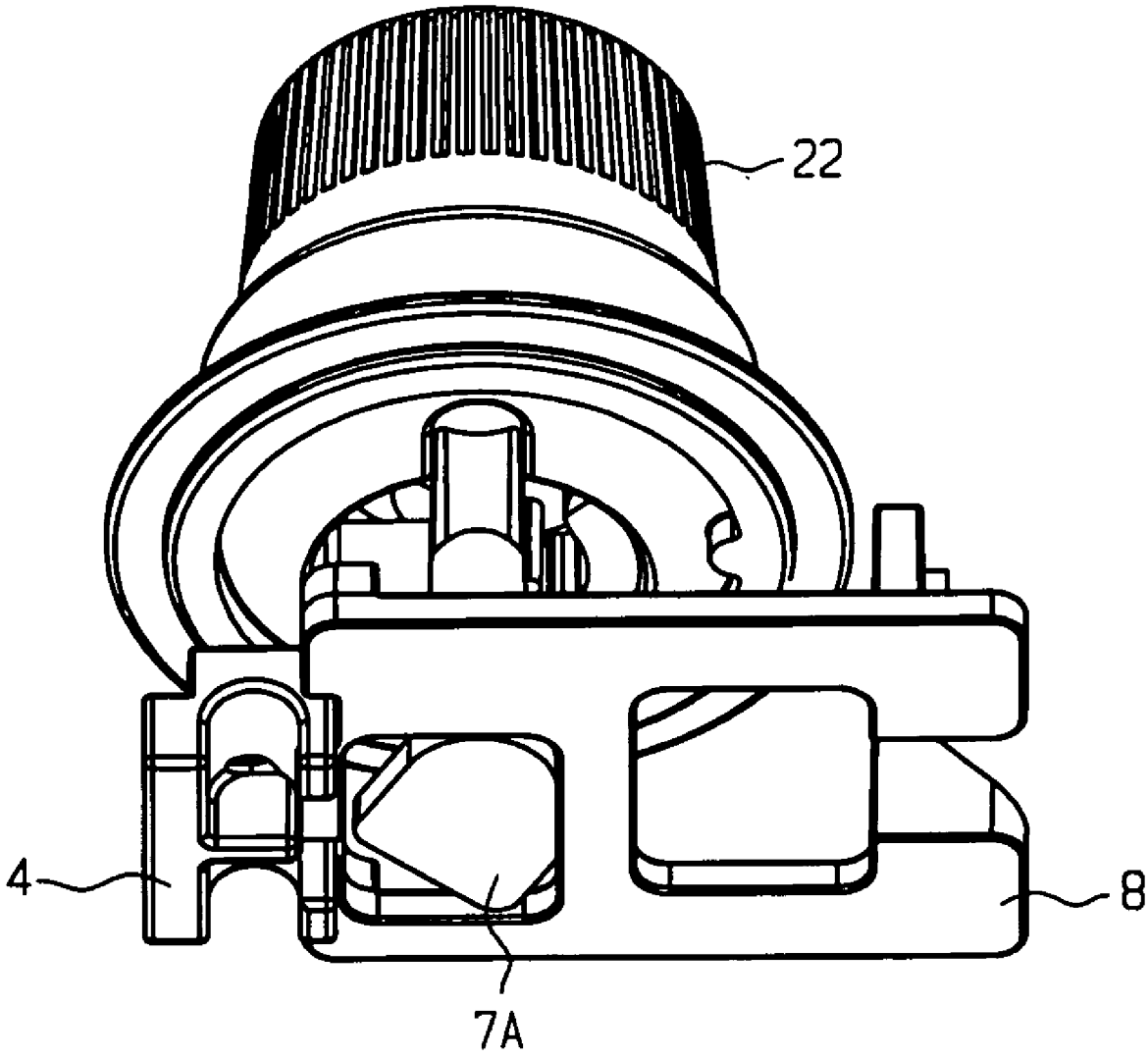
Figure 5:
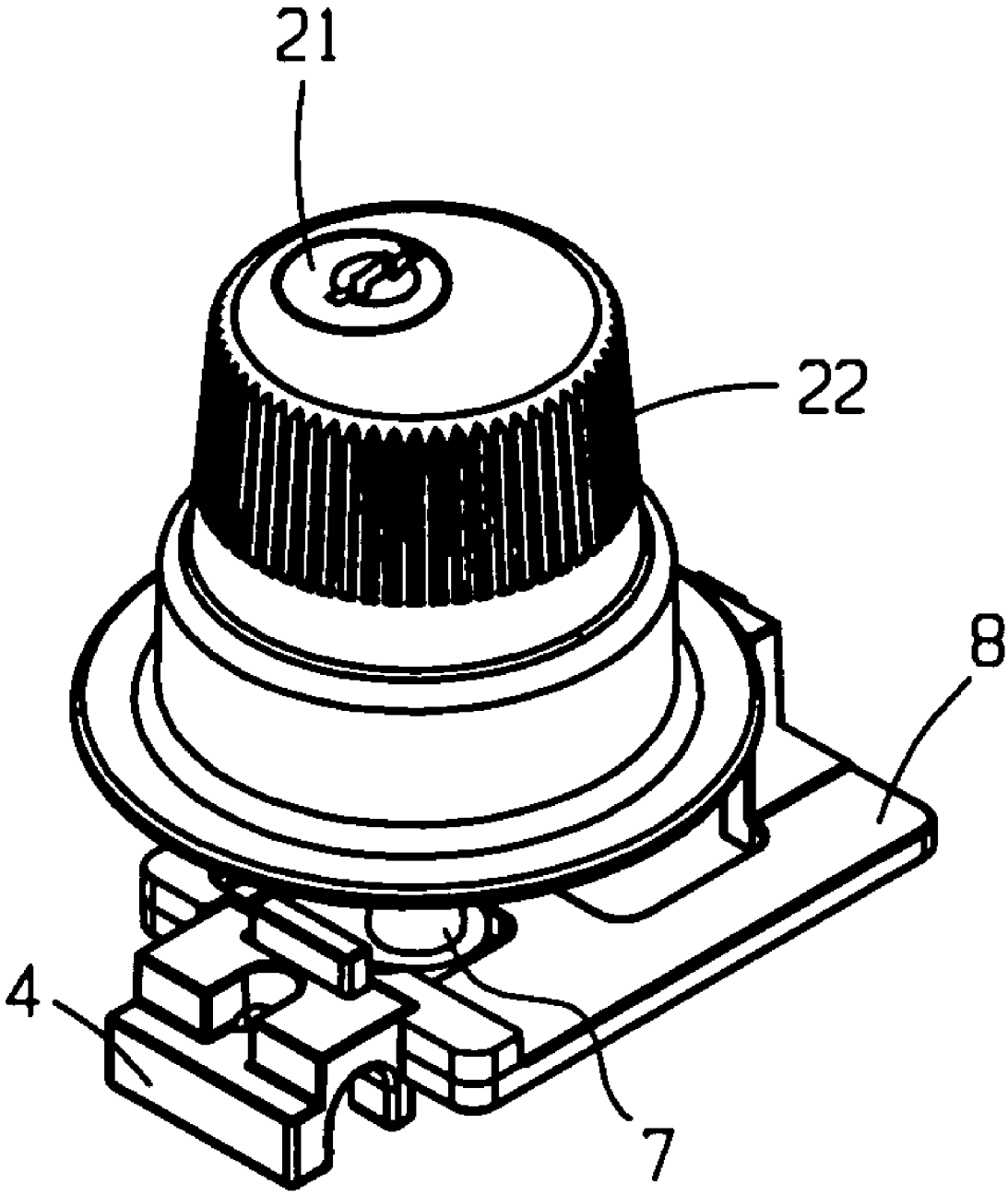
FIGS. 5-7 illustrate the present invention lock assembly, wherein the key cylinder is in the unlocked position.
Figure 6:
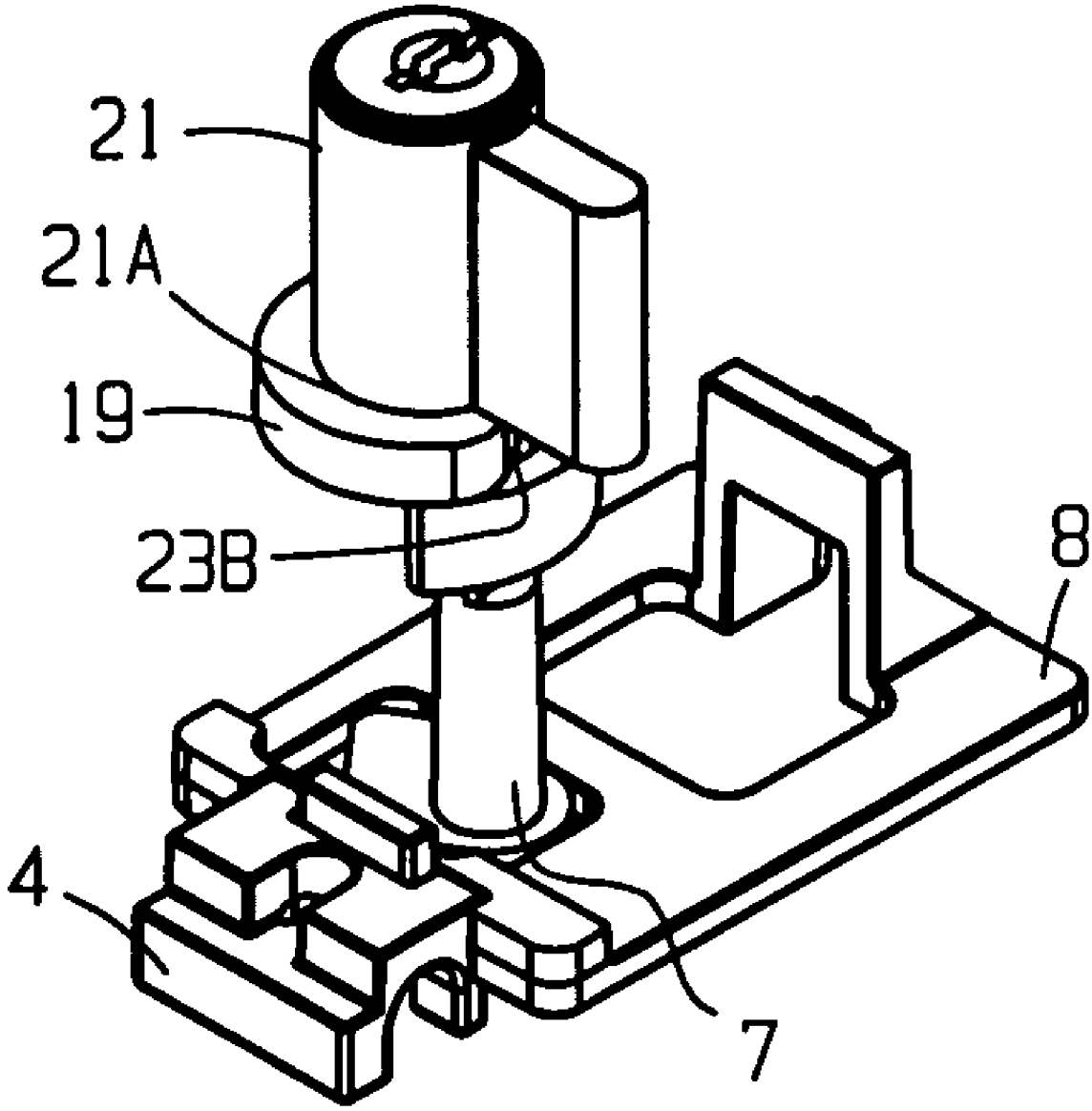
Figure 7:
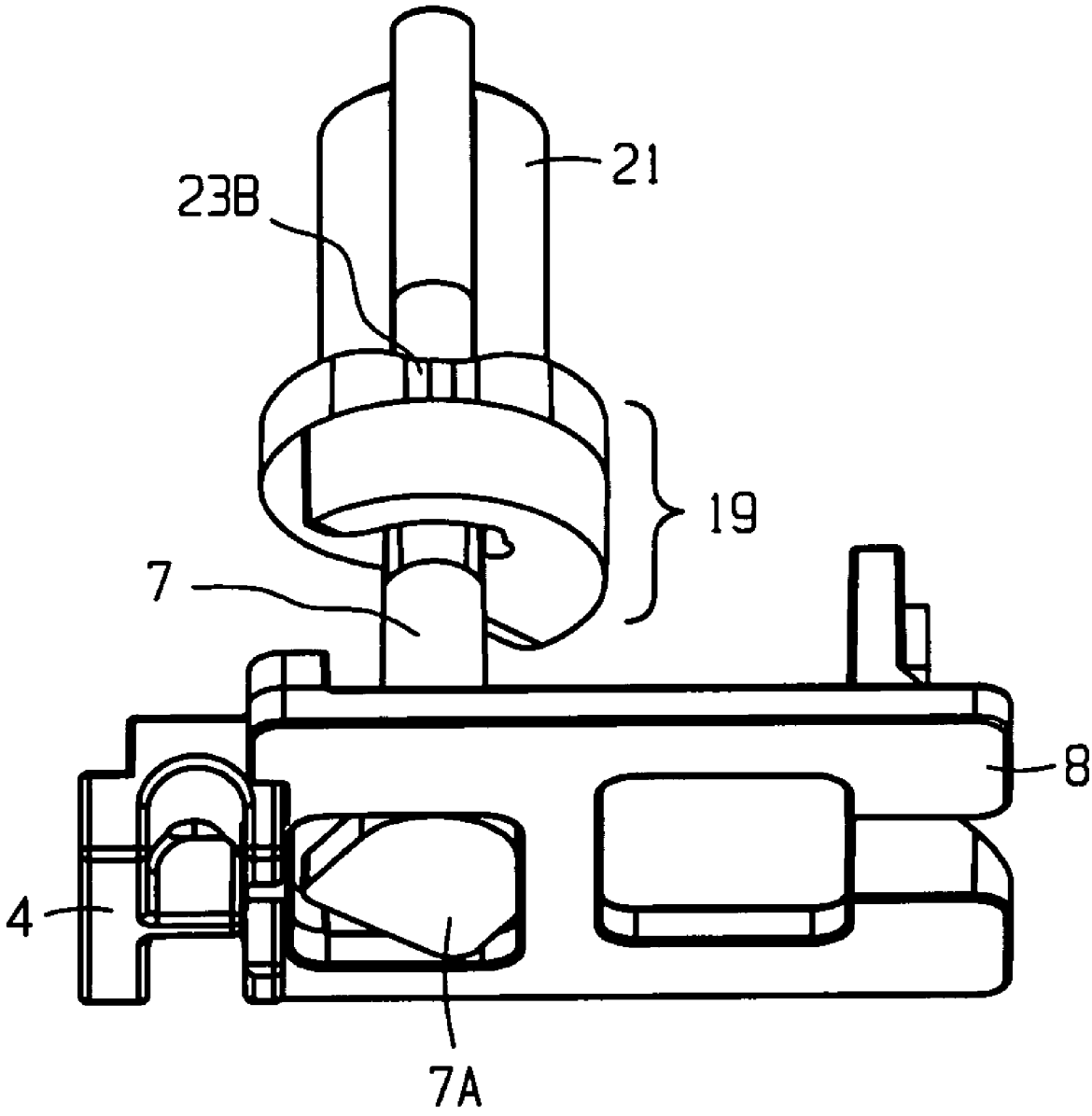
Figure 8:
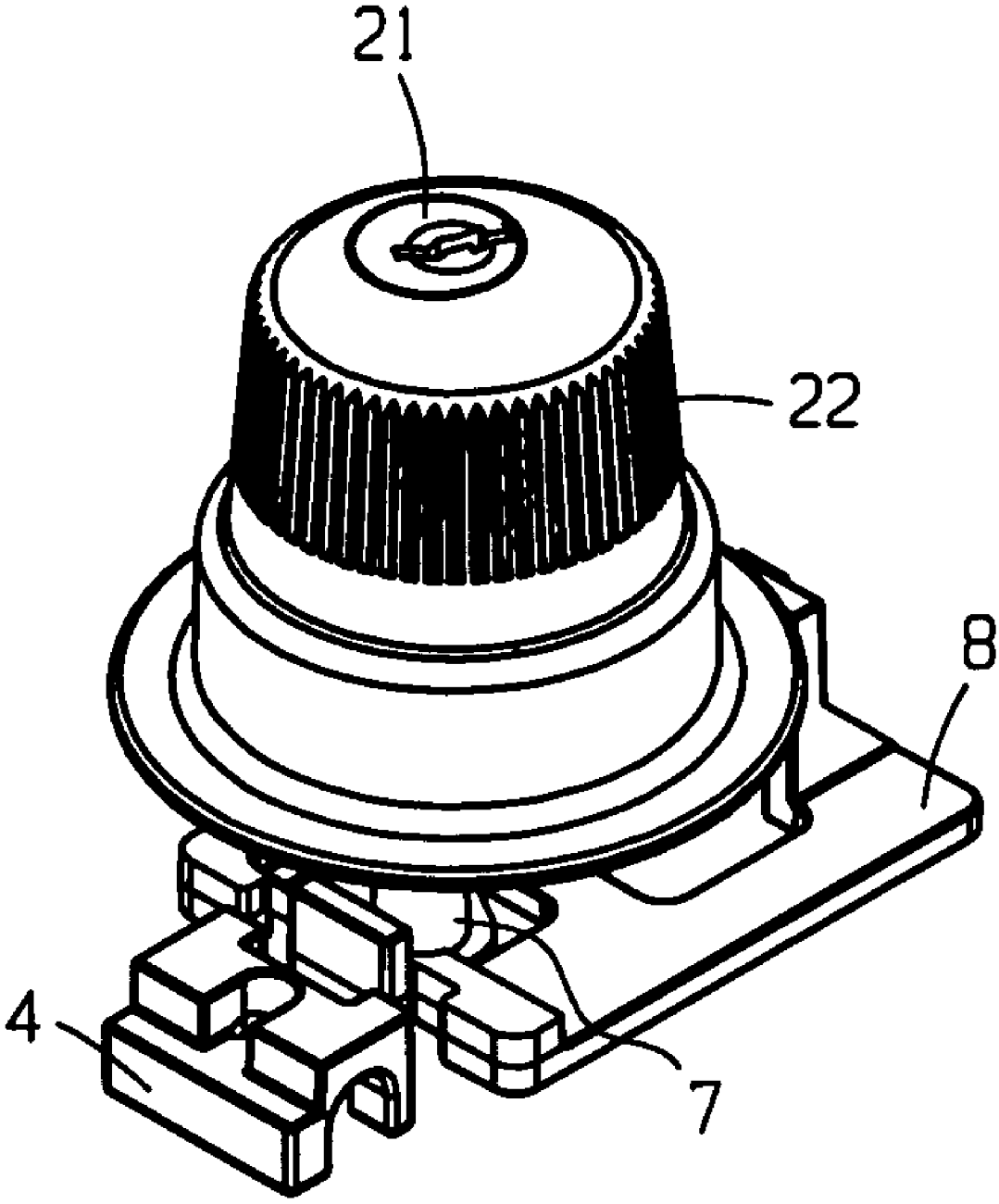
FIGS. 8-11 illustrate the present invention lock assembly, wherein the locking slide is disengaged from the guide.
Figure 9:
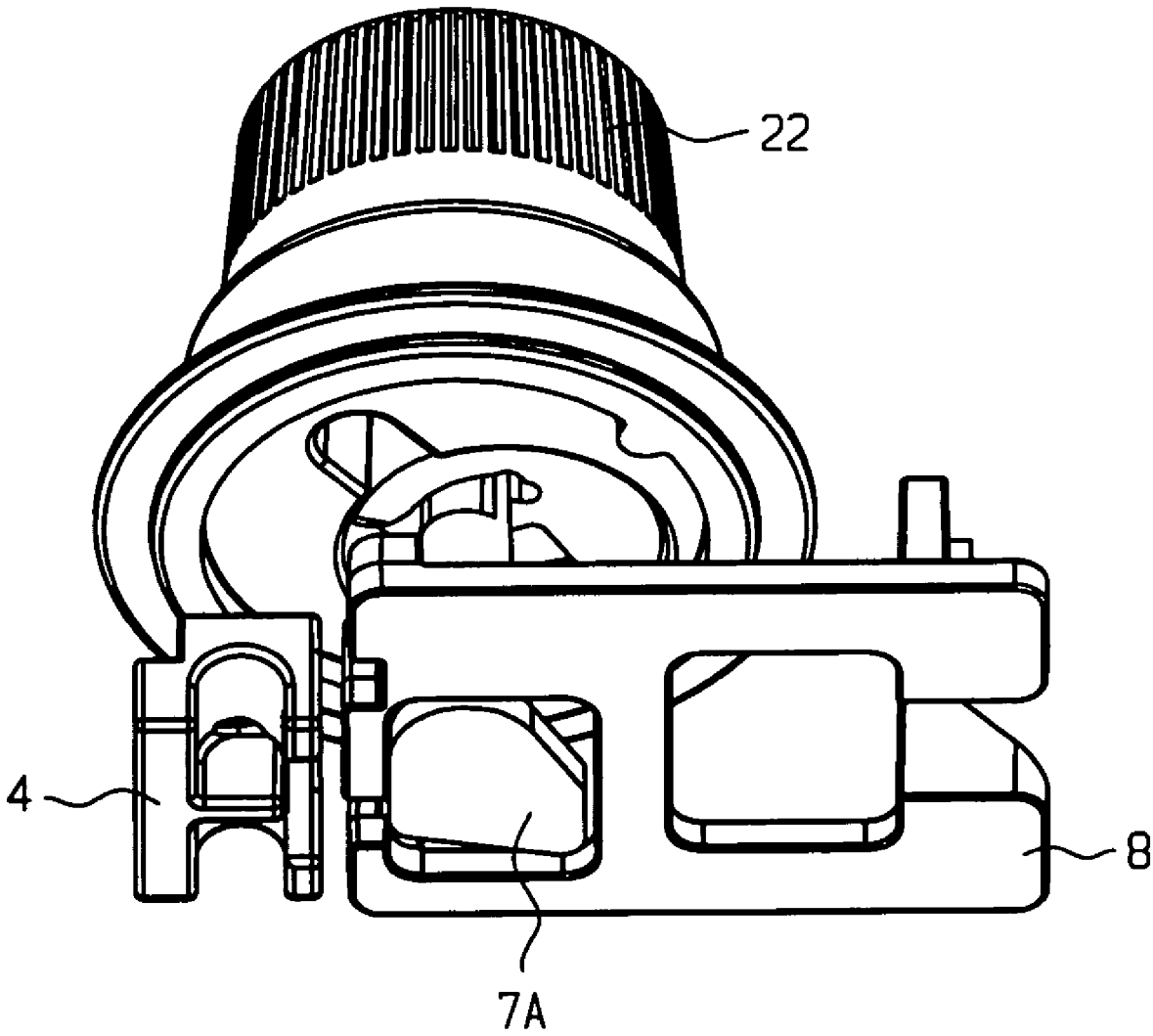
Figure 10:
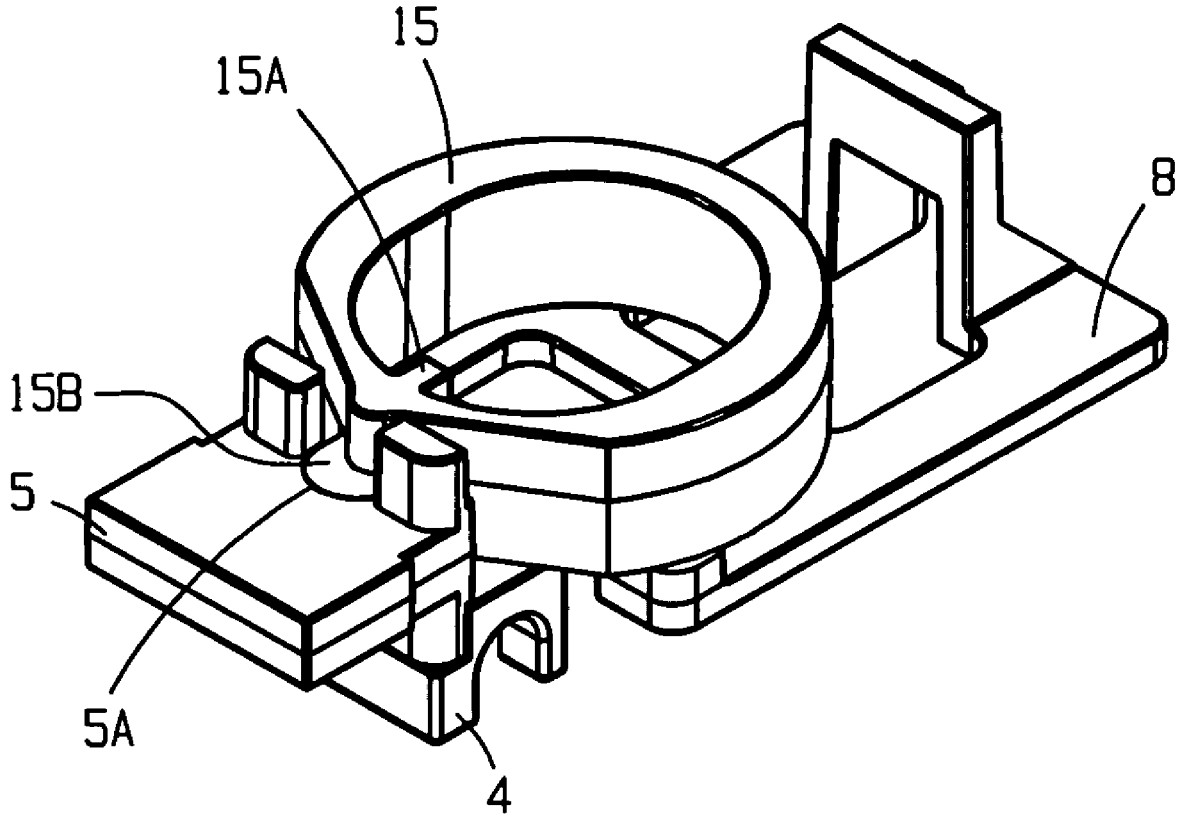
Figure 11:
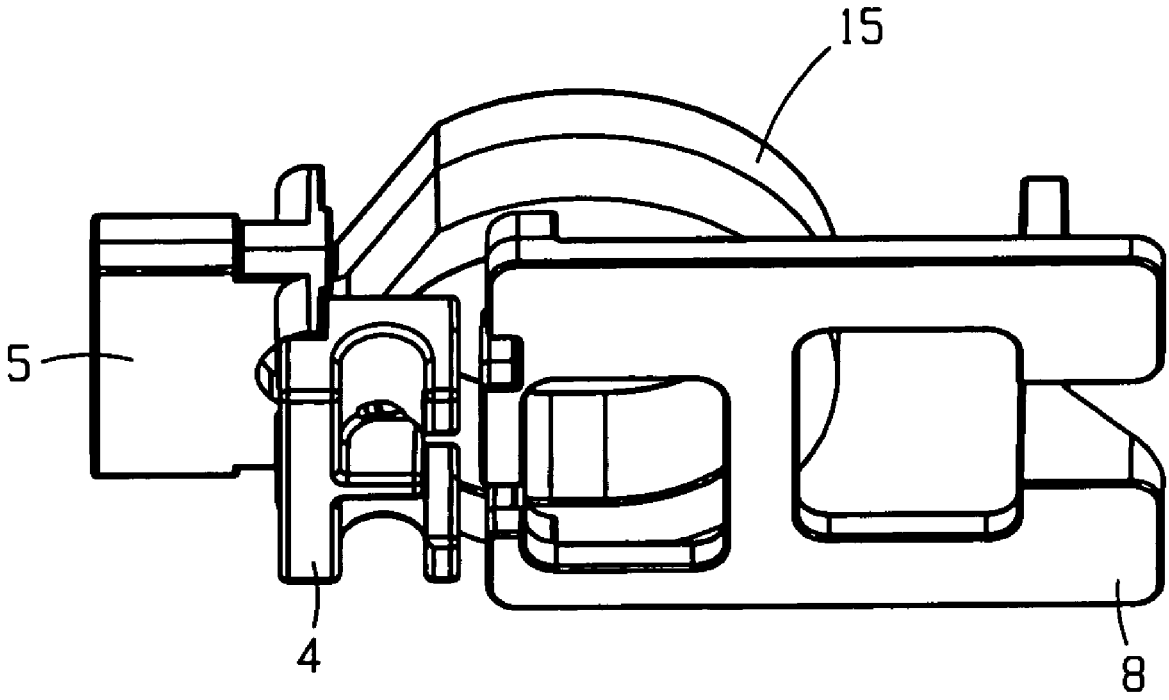
Figure 12:
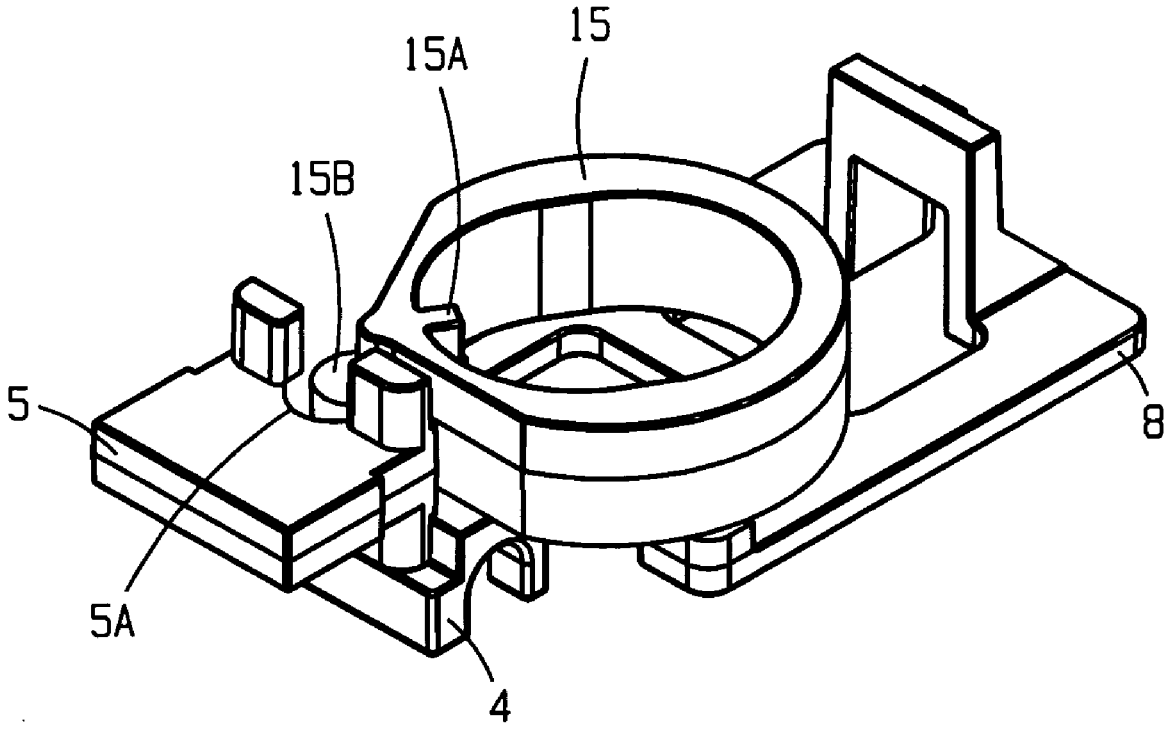
FIGS. 12-13 illustrate the present invention lock assembly, wherein the guide and bolt are moved to allow the locker door to be opened.
Figure 13:
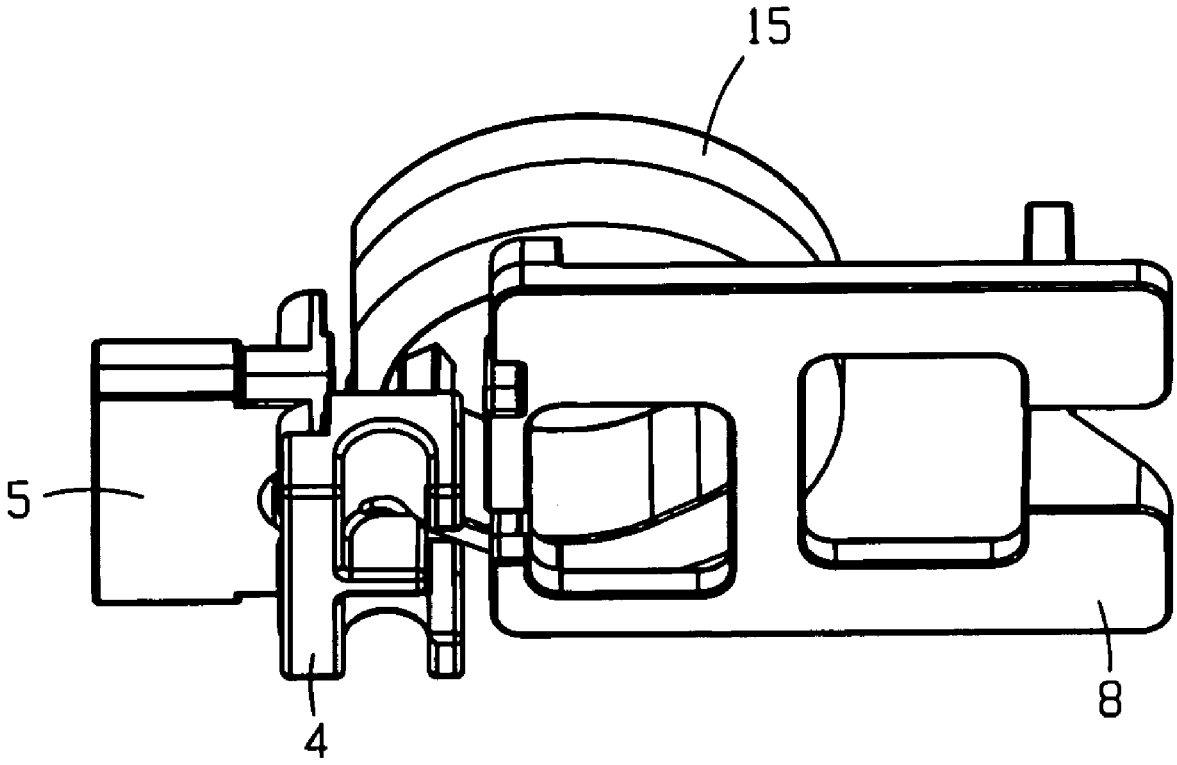
Figure 27:
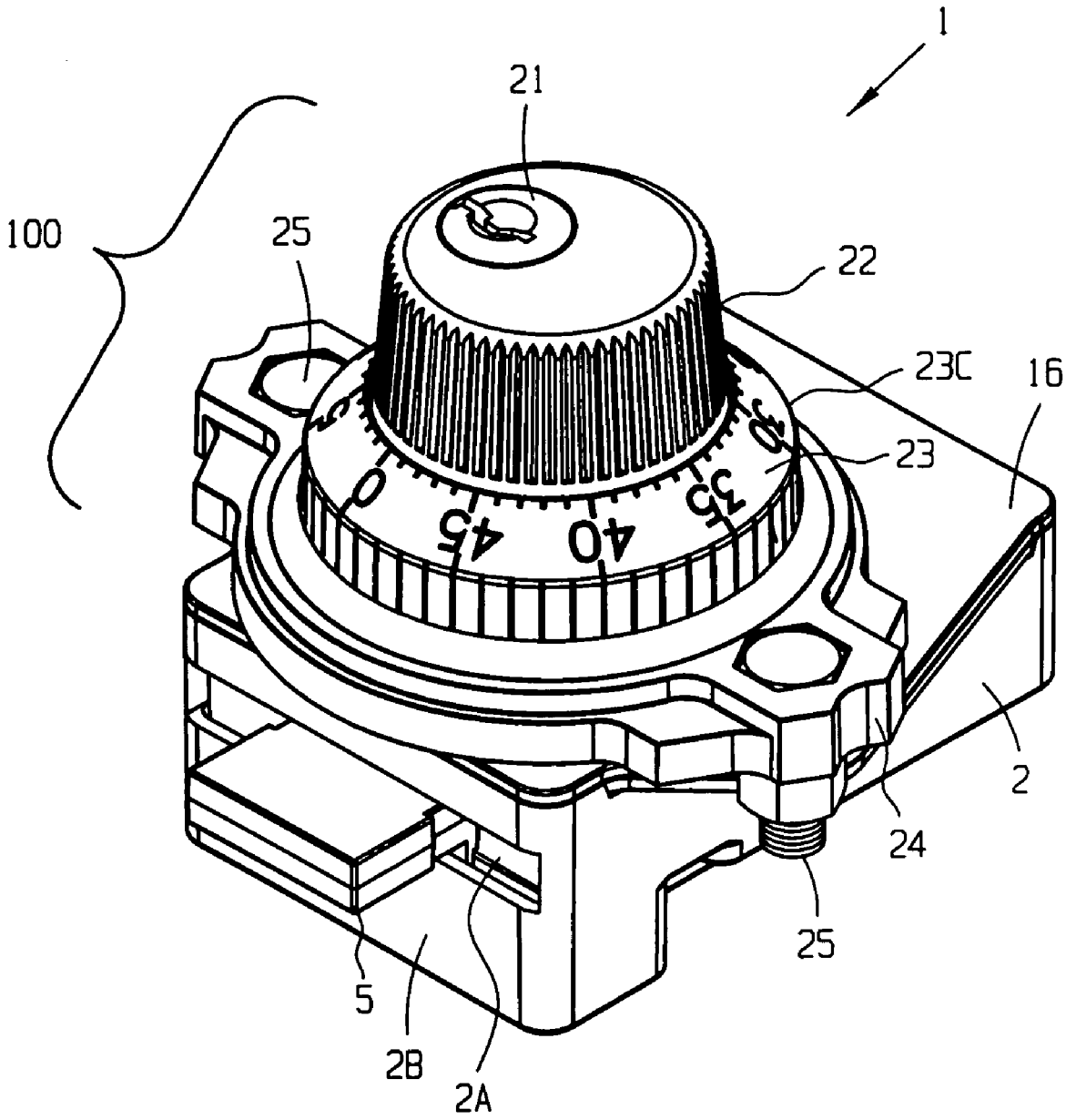
FIGS. 27-32 illustrate the present invention vertical lock assembly and dial in different subassemblies to show the relative position of each of the parts of the lock assembly.
Figure 28:
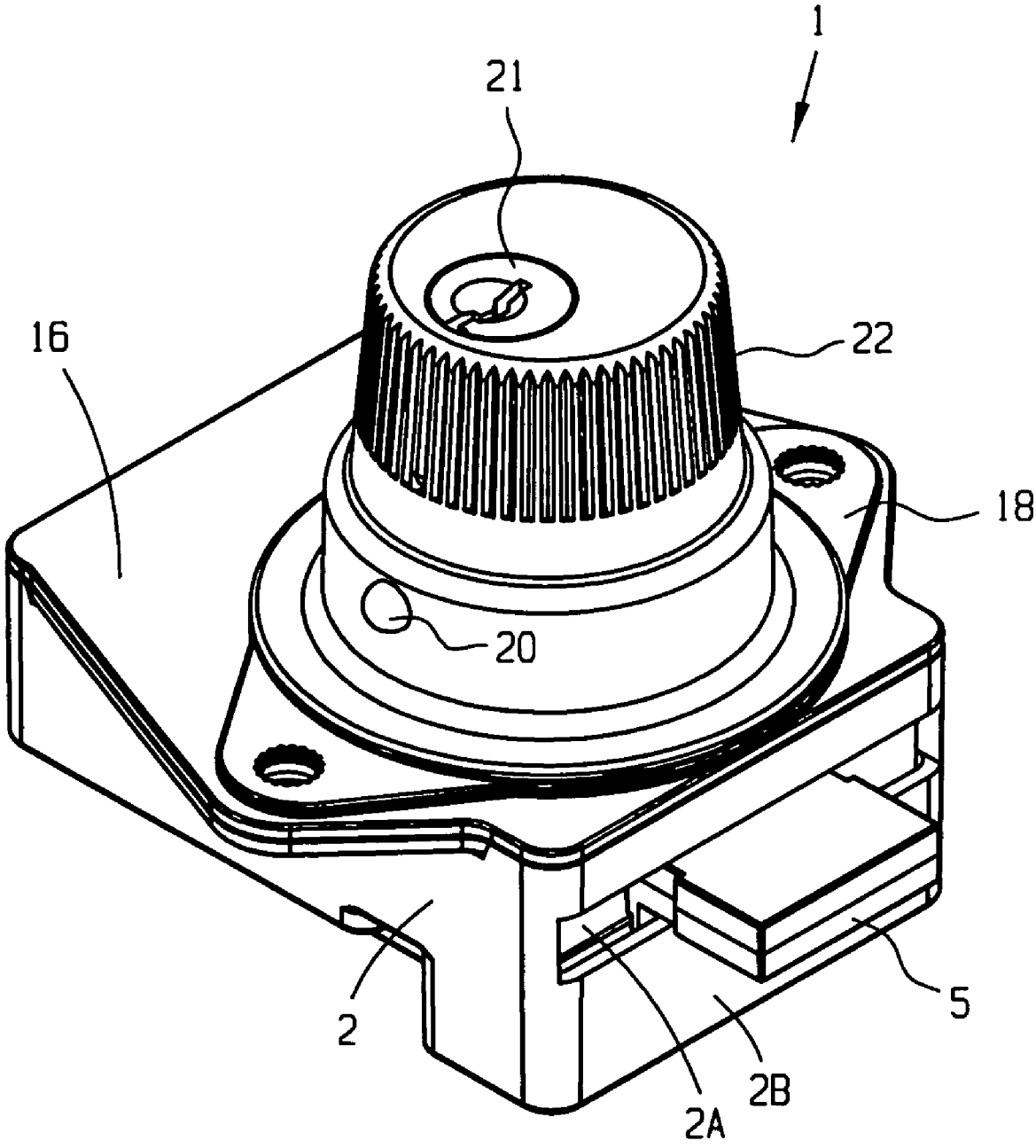
Figure 29:
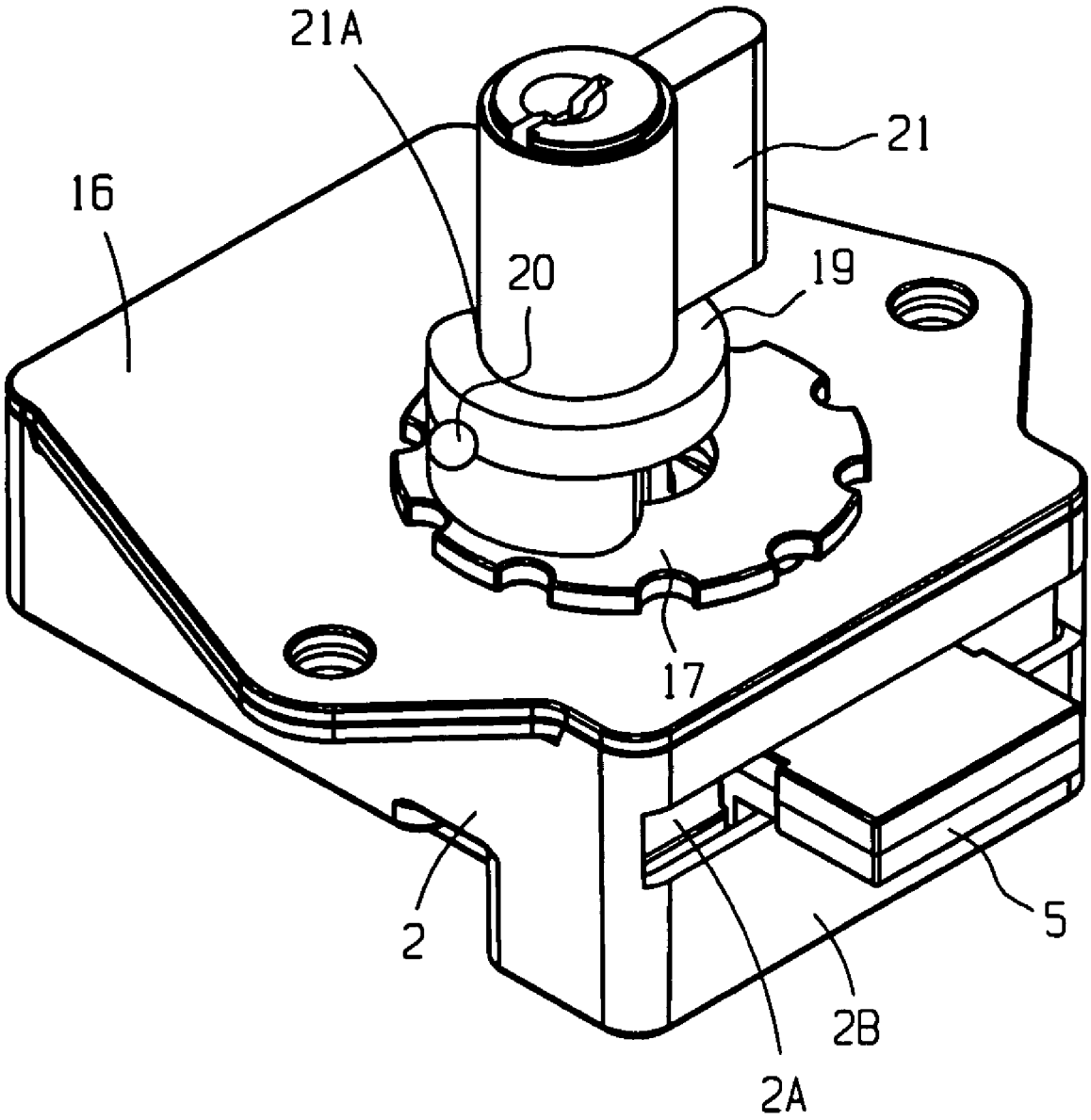
Figure 30:
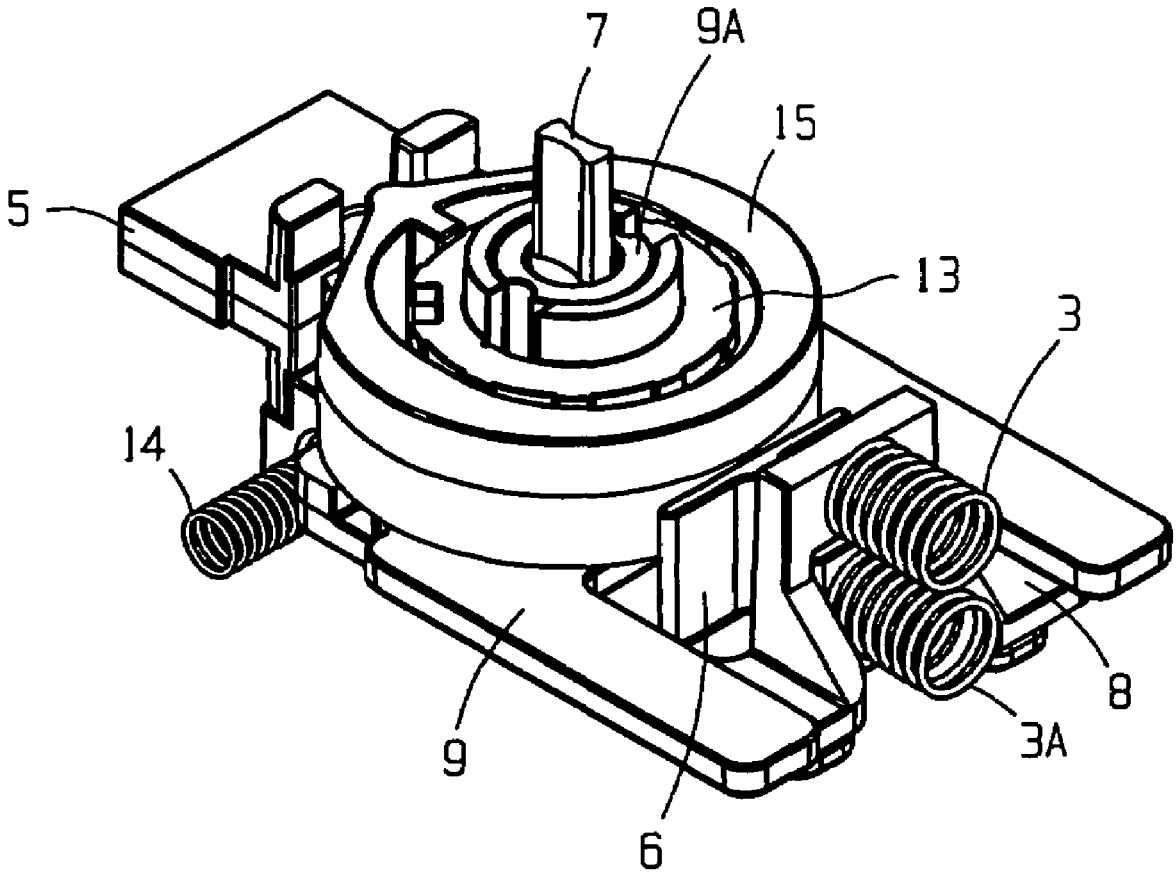
Figure 33:
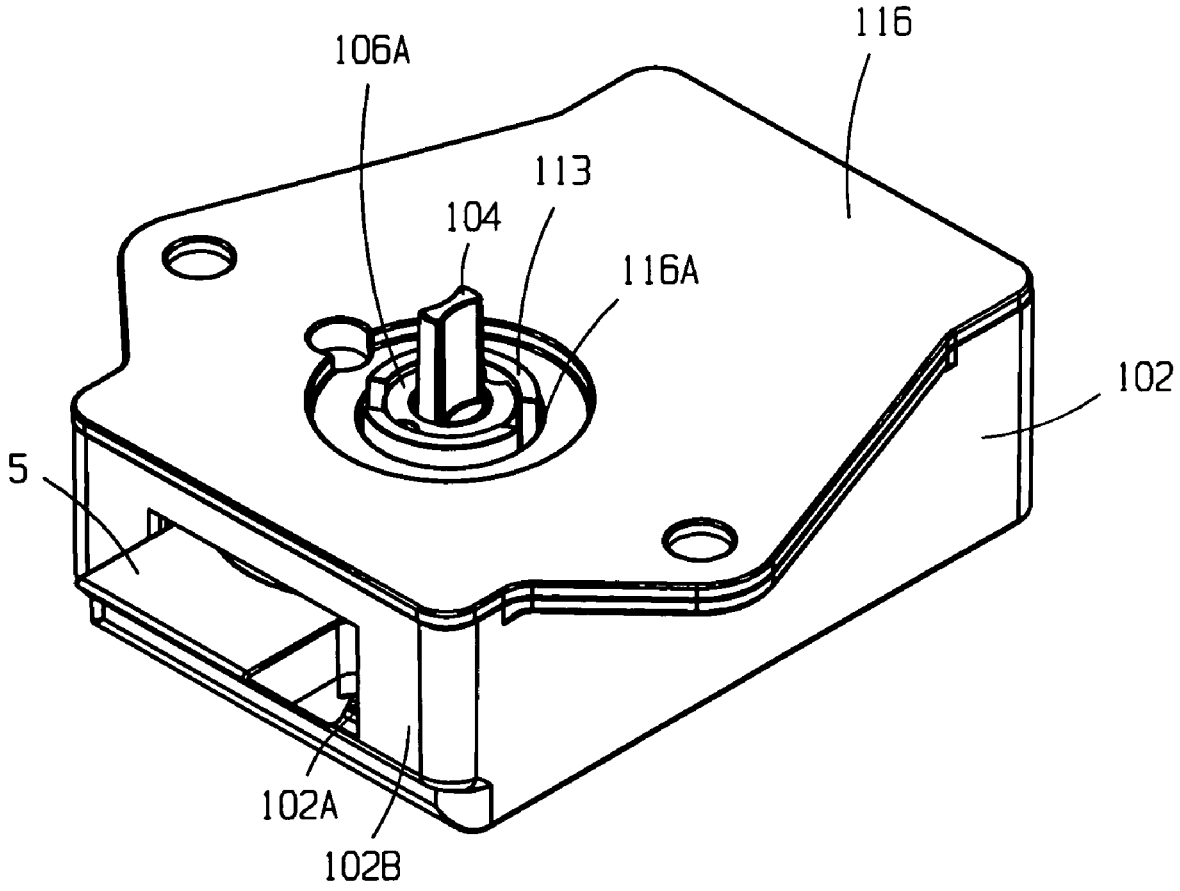
FIGS. 33-42 illustrate the present invention horizontal lock assembly and dial in different subassemblies to show the relative position of each of the parts of the lock assembly.

Referring initially to FIGS. 27-29, the present invention configured as a vertical built-in lock assembly 1 includes a dial assembly 100 which is attached to a lock casing 2 and a cover plate 16 by fasteners 25, a retaining plate 24, and a plastic piece 18. A bolt 5 extends from an opening 2*a* on a side 2*b* of the lock casing 2 and is movable along the longitudinal axis of the opening 2*a*. The dial assembly 100 includes a number dial 23, a tumbler dial 22, a key cylinder 21, a ball bearing 20, a dial cam 19 and a tumbler extension 17. The tumbler extension 17, as best shown in FIG. 29, is fixable attached to the tumbler dial 22 and engages the top tumbler 13, shown in FIG. 30, such that the top tumbler 13 and the dial assembly 100 rotate together. Tumbler extension 17 has two "tabs" which engage two slots in the top tumbler, similarly to that shown in FIG. 33 for the horizontal lock. The key cylinder 21 is rotatable mounted into the tumbler dial 22 offset from the rotational axis of the tumbler dial 21. The dial cam 19 is fixably attached to the distal end 21*a* of the key cylinder 21 such that rotation of the key cylinder 21 will rotate the dial cam 19. FIGS. 1-4 show the present invention in a semi-assembled view of the lock and dial in the locked position. When the lock assembly 1-is in the locked position, the dial assembly 100 can rotate about the axis of the tumbler dial 22 without the dial cam 19 engaging the plug extension 7. In this state, the lock can only be opened with the proper combination. If, however, the proper key is inserted into the key cylinder 21 and turned clockwise (as shown in the figures), the key will drive the dial cam 19 into engagement with the plug extension 7, as shown in FIGS. 5-7. As shown in FIGS. 8-11, once the plug extension 7 is engaged by the dial cam 19 and the dial cam 19 is rotated to the designated stop, the continued rotation of the key will rotate the dial assembly 100 with the plug extension 7. When the plug extension 7 is rotated in this manner, the plug extension cam 7*a* will contact the locking slide 8, pushing the locking slide 8 away from the guide 4, thereby disengaging the two. Once the guide 4 is disengaged, the locker handle (not shown) can move the bolt 5 axially along the opening 2*a*, as shown in FIGS. 12-13, 15-17. This movement disengages the locker door mechanism and allows the locker door to be opened. FIGS. 12-13 also show the bolt retainer 15 and the guide 4 moving in conjunction with the bolt 5. The bolt retainer 15 includes a projection 15*b* which engages the bolt 5 at the bolt pocket 5*a*. The bolt retainer 15 further contains a post which engages the guide 4 in a guide slot. Thus, the engagement of the bolt 5 with the bolt retainer 15 and the engagement of the bolt retainer 15 with the guide 4, results in both the bolt retainer 15 and the guide 4 moving in conjunction with bolt 5.

Figure 14:
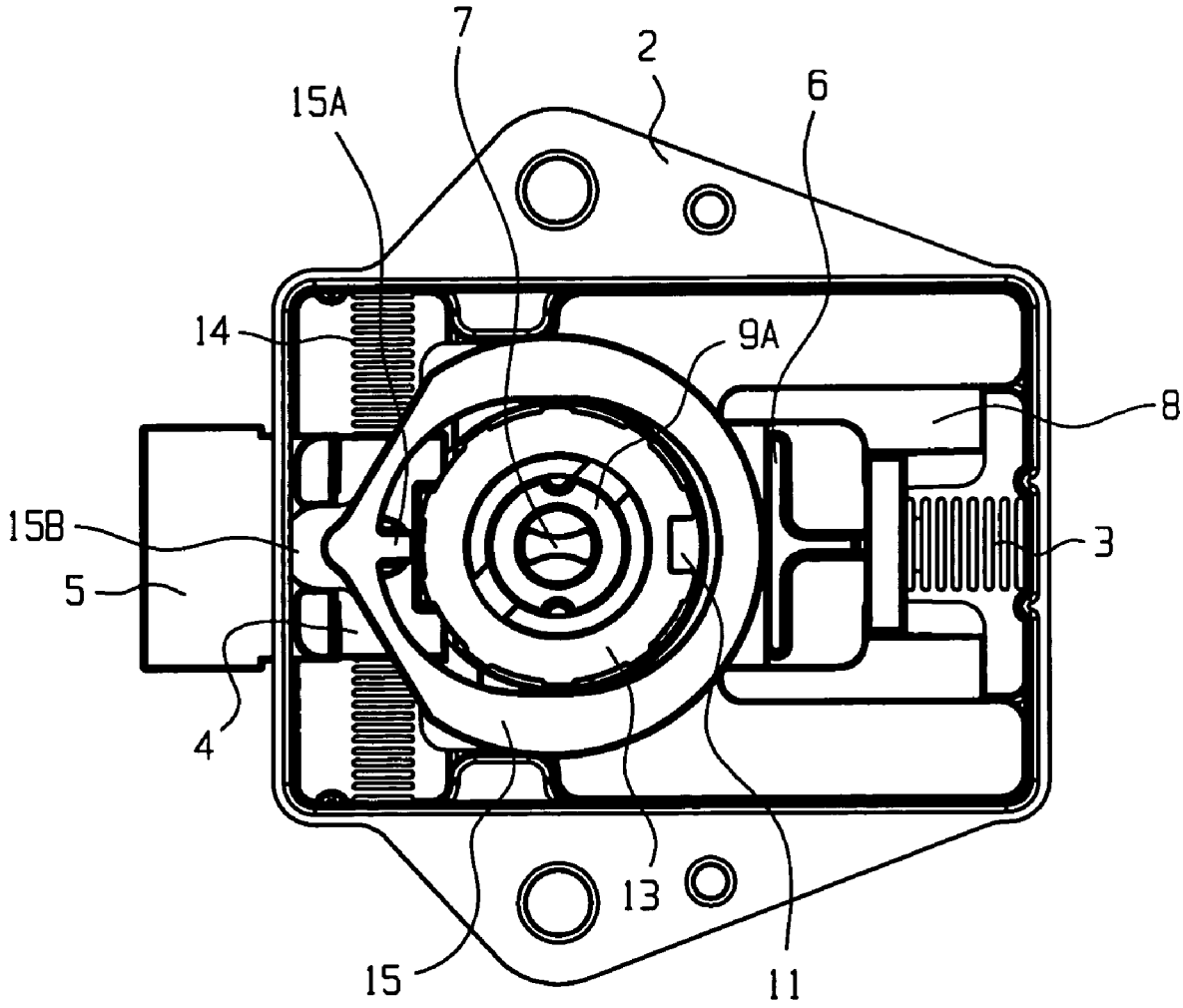
FIGS. 14-18 illustrate the present invention vertical lock assembly and operation with the combination and the relative position between the locked position and the unlocked position.

As shown in FIG. 14, the guide 4 is positioned between two guide springs 14. The guide springs 14 bias the guide 4 toward the center of the lock. Therefore, once the key inserted in the key cylinder 21 is released and turned back for removal, the guide springs 14 push the guide 4, the bolt 5 and the bolt retainer 15 back into the center of the lock. Also shown in FIG. 14, as well as FIG. 32, a locking slide spring 3 is positioned between the locking slide 8 and the lock casing 2. The locking slide spring 3 biases the locking slide 8 into engagement with the guide 4 causing the lock assembly 1 to be relocked when the key is released.

Operation of the Dial Operated Vertical Built-In Lock

Figure 31:
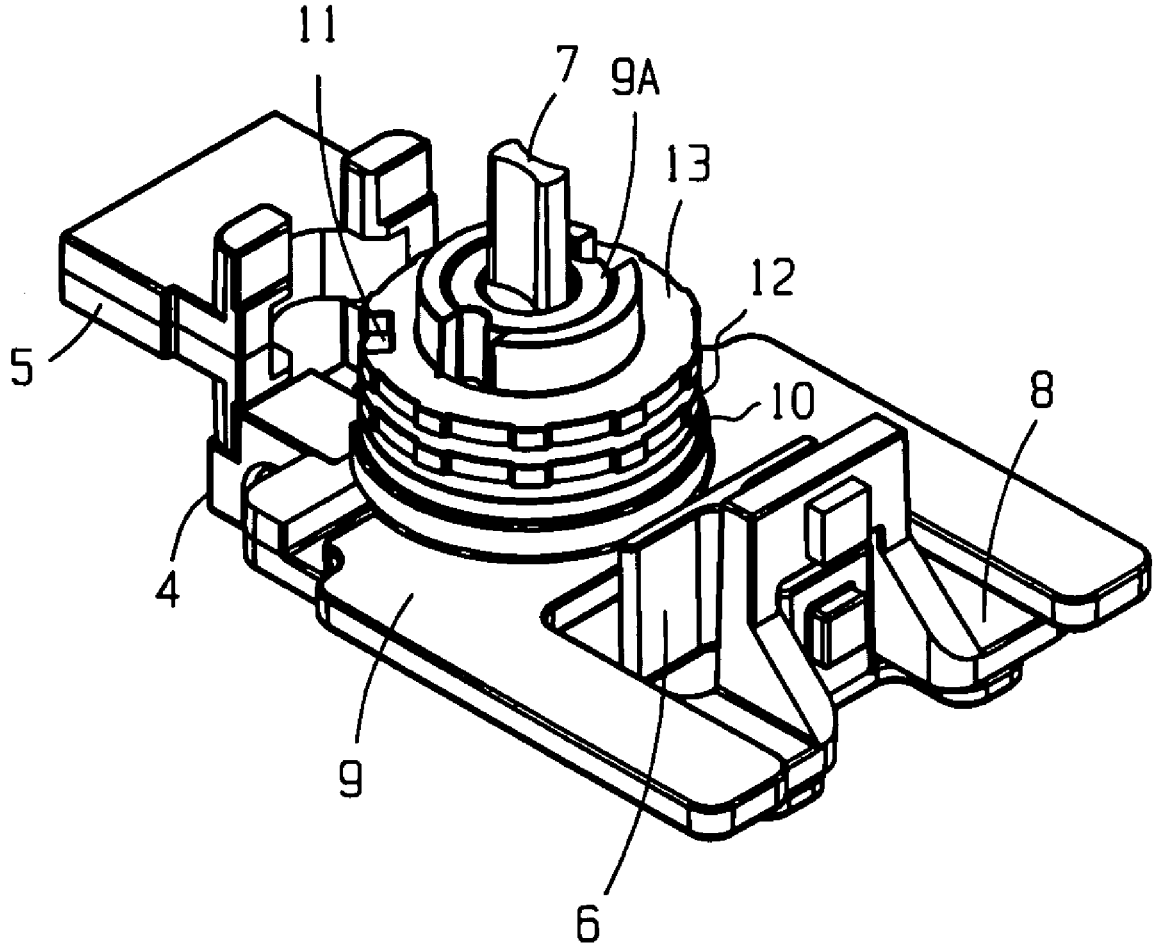
Figure 32:
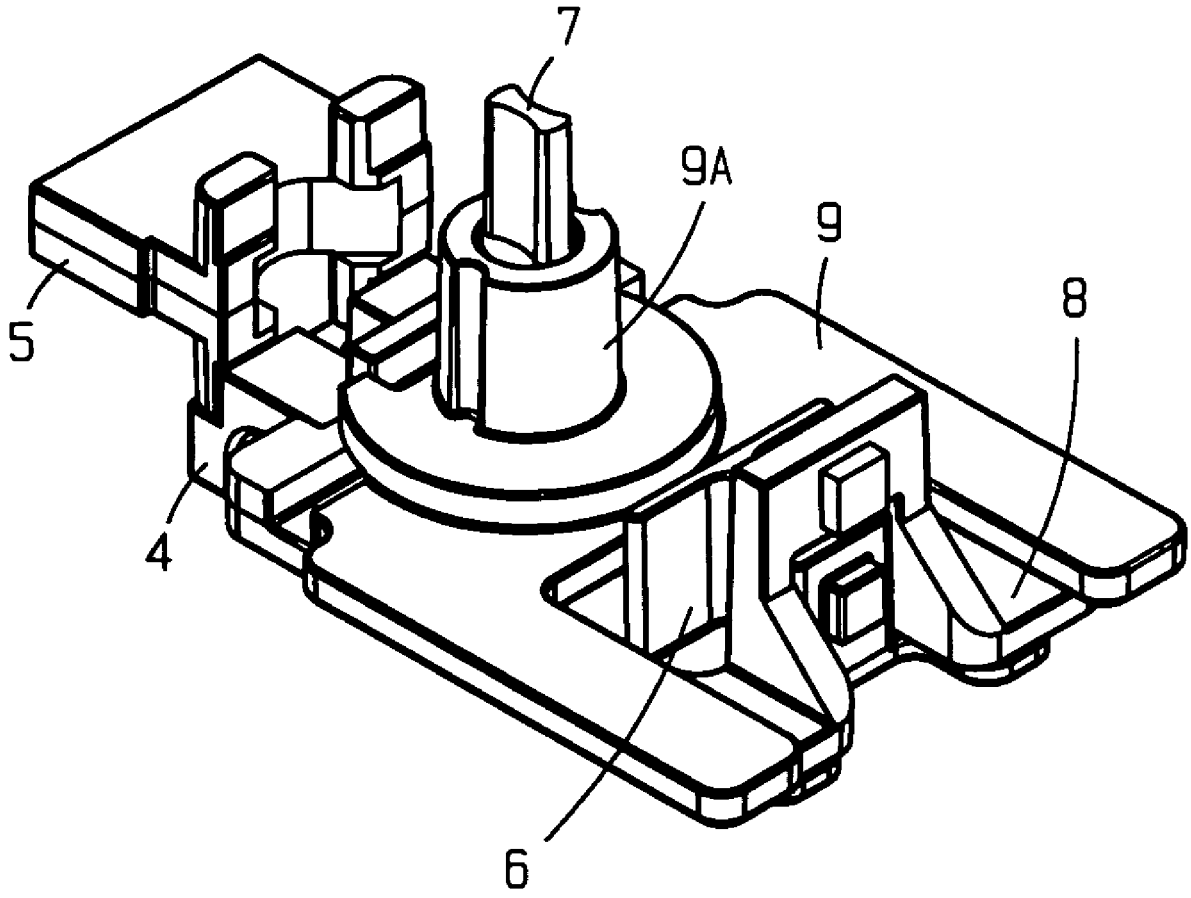

As shown in FIGS. 31-32, the base plate 9, positioned within the lock casing 2, includes a hollow stem 9*a* projecting perpendicular from the base plate 9. The plug extension 7 is rotatable positioned on the inside of the hollow stem 9*a* and a top tumbler 13, a middle tumbler 12, and a bottom tumbler 10 are mounted onto the stem 9*a*. The tumblers 13, 12, and 10 are rotatable to each other and each include an indentation 11, similarly to that shown in FIG. 58 for the horizontal lock. When the proper combination is entered into the dial assembly 100, the indentations 11 move into alignment axially along the stem 9*a*. When the indentations 11 are not aligned, the tumblers 13, 12, and 10 are considered to be in an upset position. Tumblers having indentations such as these are known in the art.

FIG. 14 shows the top view of the vertical lock in the locked position with the top tumbler 13, the middle tumbler 12, and the bottom tumbler 10 in the upset position. When the bolt 5 is moved slightly axially along the opening 2*a* by the locker handle (not shown), the engagement between the pocket 5*a* and the projection 15*b* causes the bolt retainer 15 to move perpendicular to the movement of the bolt 5. The perpendicular movement of the bolt retainer 15 brings a protrusion 15*a* on the bolt retainer 15 into contact with the tumblers 13, 12, and 10 and the locking slide 8, which is positioned below the tumblers 13, 12, and 10. Further movement of the bolt retainer 15 will disengage the locking slide 8 from the guide 4. The tumblers 13, 12, and 10, however, impede further movement of the bolt retainer 15; thus, the locking slide 8 remains engaged with the guide 4. As a result, the engagement between the guide 4, the bolt retainer 15, and the bolt 5 stops the bolt 5 from moving along the opening 2*a* to its fully opened position. Therefore, the locker door remains locked.

Figure 15:
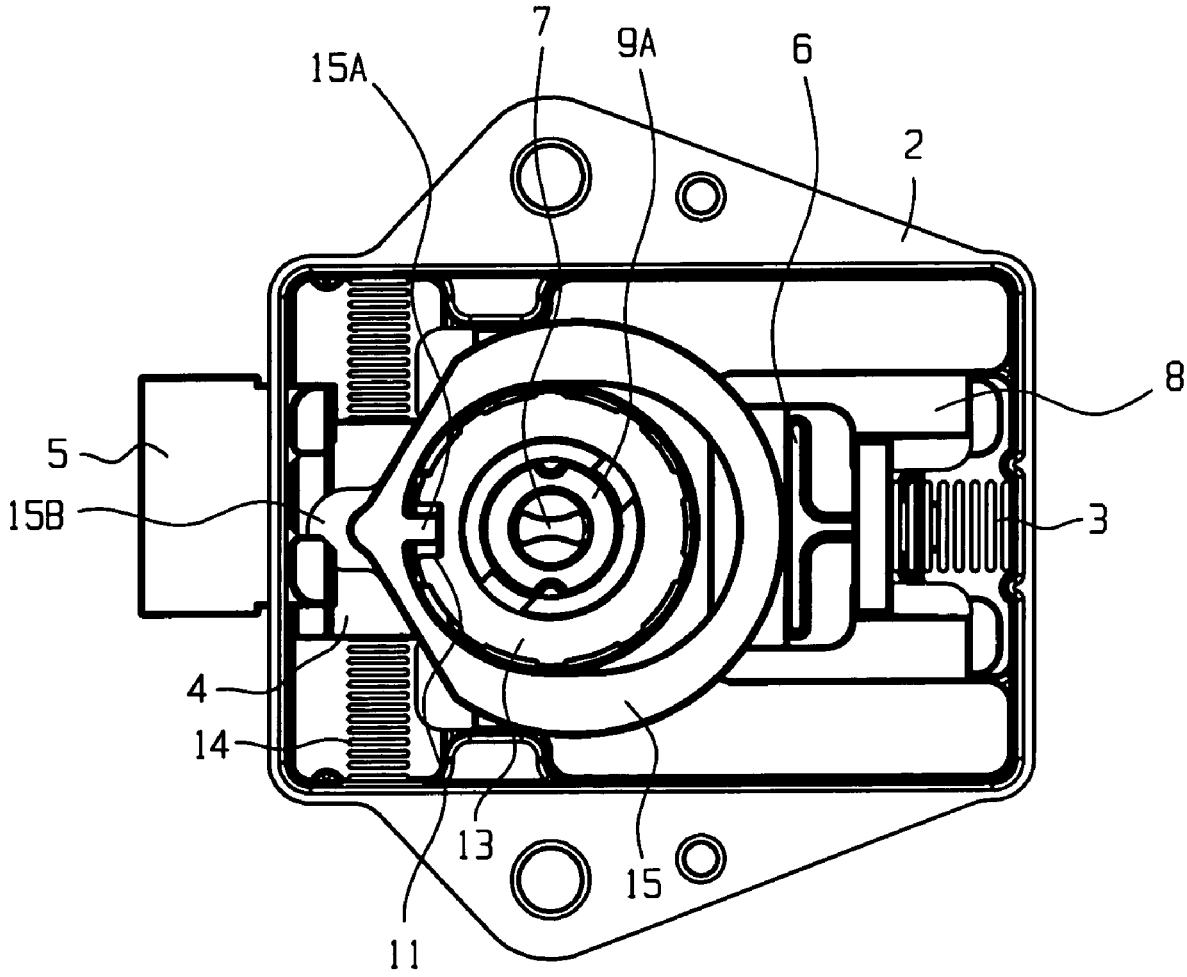
Figure 16:
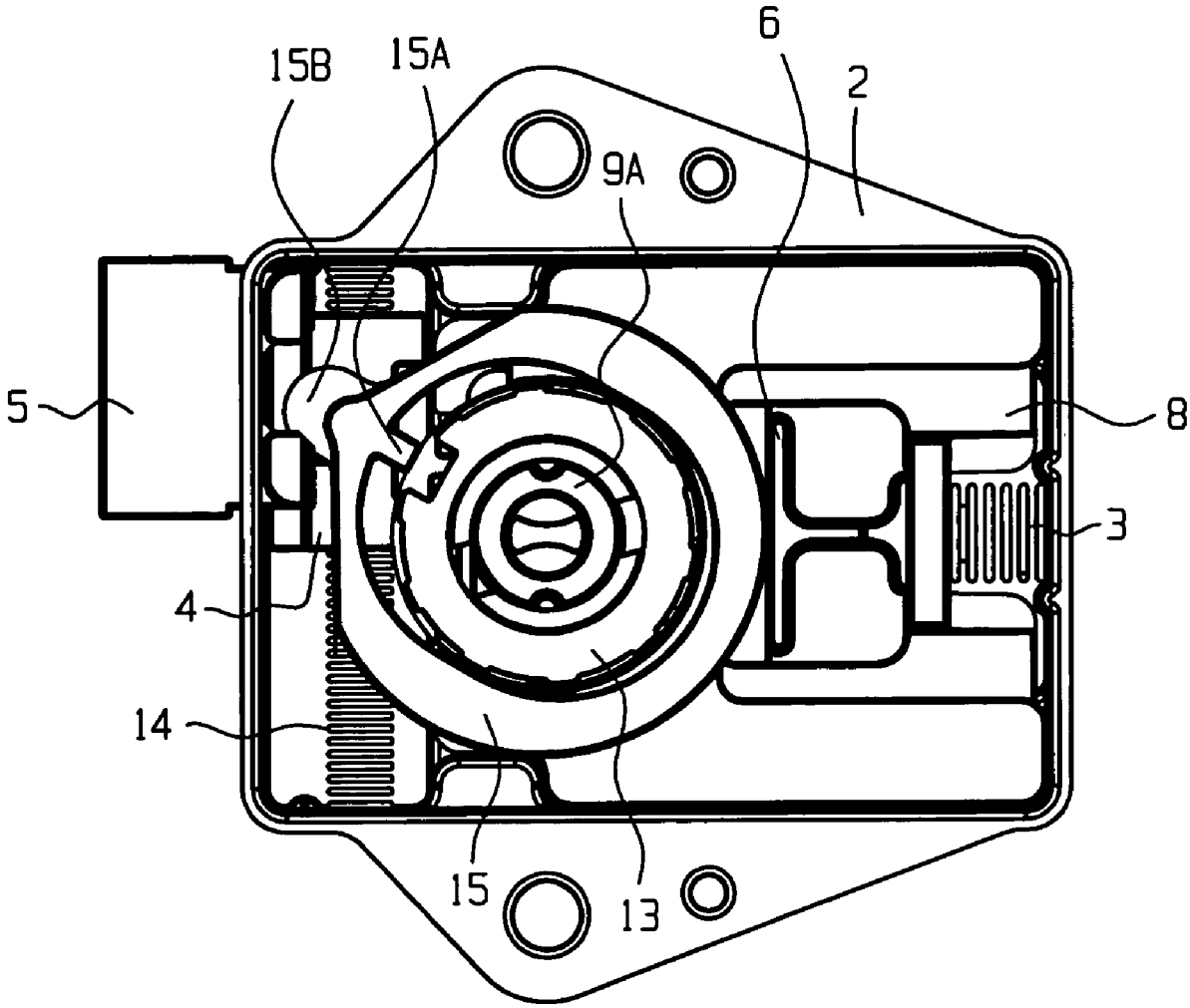
Figure 17:
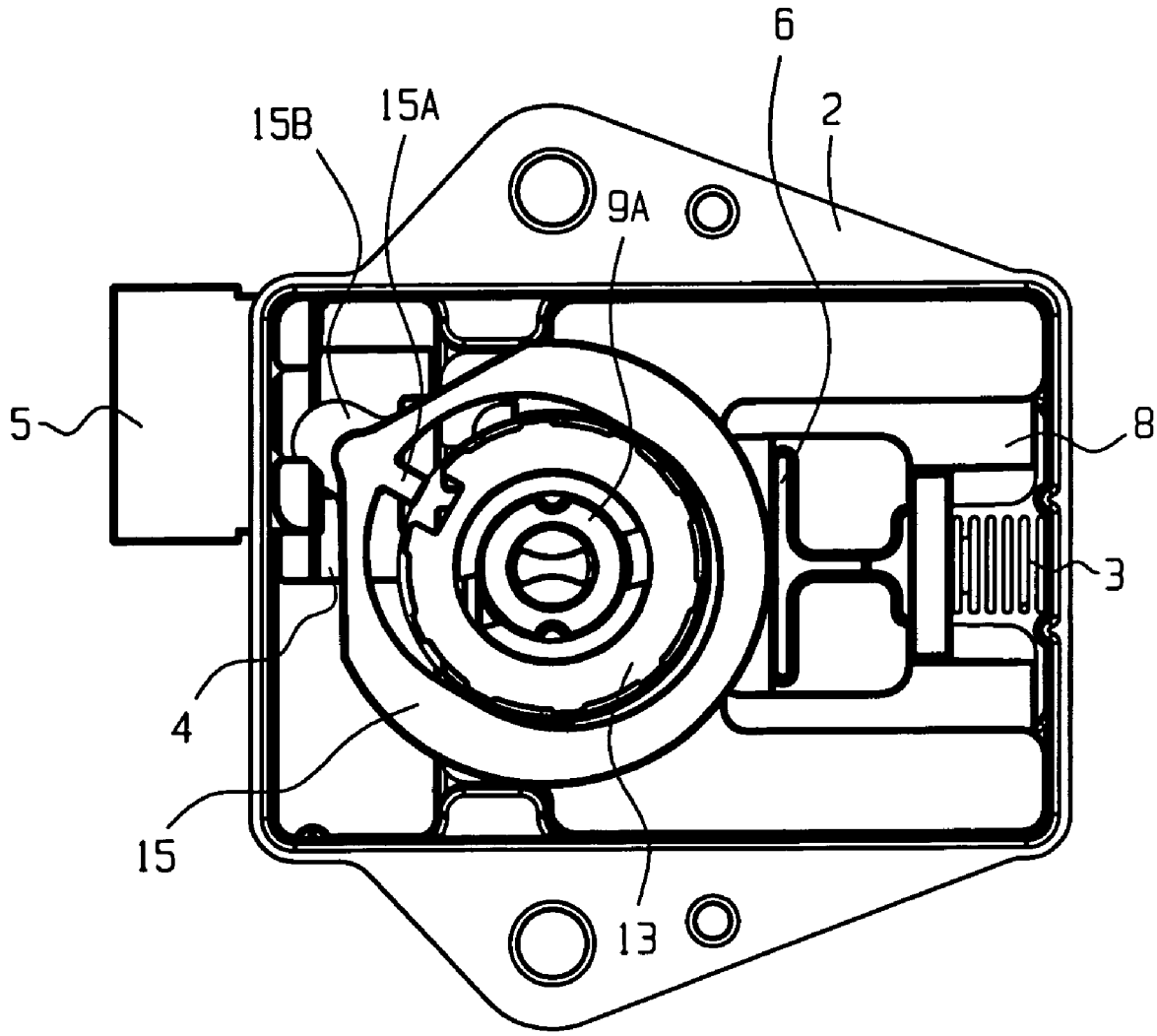
Figure 18:
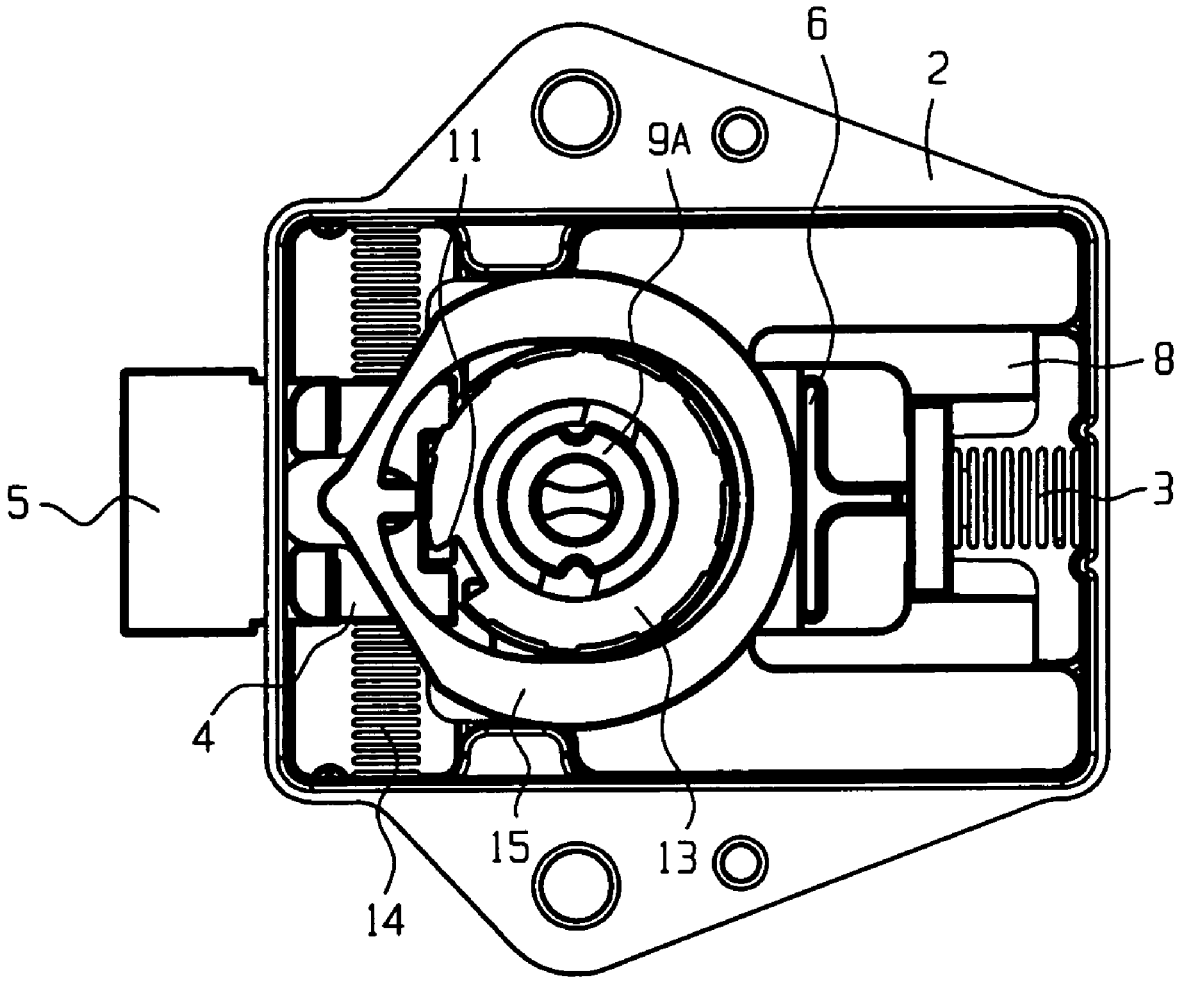

As shown in FIG. 15, when the correct combination is dialed, the indentations 11 align and the movement of the bolt 5 along the opening 2*a*, caused by the locker handle (not shown), pushes the protrusion 15*a* into the indentations 11. This movement also causes the protrusion 15*a* to push the locking slide 8 away from the guide 4, allowing the bolt 5 to be moved to a fully opened position. As shown in FIGS. 16-17, when the bolt 5 moves to the fully opened position, the guide 4, the bolt retainer 15, and the tumblers 13, 12, and 10 move in conjunction with the bolt 5. When the locker handle is released, the bolt 5, the bolt retainer 15, and the guide 4 are pushed back to the center position by the guide springs 14. The bolt retainer 15 is also engaged by a pressure slide 6 as shown in FIGS. 14-18 and FIG. 30. A pressure slide spring 3*a* is positioned between the pressure slide 6 and the lock casing 2 such that the spring biases the pressure slide 6 against the bolt retainer 15. As a result, when the locker handle is released, the pressure slide 6 pushes the protrusion 15*a* of the bolt retainer 15 out of the indentations 11 of the tumblers 13, 12, and 10. FIG. 18 shows that when the bolt 5, the bolt retainer 15, and the guide 4 are pushed back to the center position by the guide springs 14, the momentum of the tumblers 13, 12, and 10 will rotate them past the position where the lock can be opened again. Due to the symmetry of the lock, the bolt 5 can be pushed in the opposite direction allowing the lock to be used on an opposite hand locker door.

Regardless of whether the present invention vertical built-in lock is operated by key or by manipulation of the combination dial, the present invention vertical built-in lock provides for easier use and improved security over the prior art. Specifically, the design of the present invention built-in vertical lock provides for increased movement of the locking bolt, namely from ⅜ inch to 15⁄32 inch. This increased movement of approximately 3⁄32 inch provides for greater engagement and travel of the locking rods, which further minimizes the ability to corrupt the locking mechanism which would allow unauthorized entry into the locker. In addition, the vertical built-in lock of the present invention is symmetrical, thereby allowing one lock to be used on either right-handed or left-handed lockers.

Operation of the Key-Operated Horizontal Built-in Lock

Figure 35:
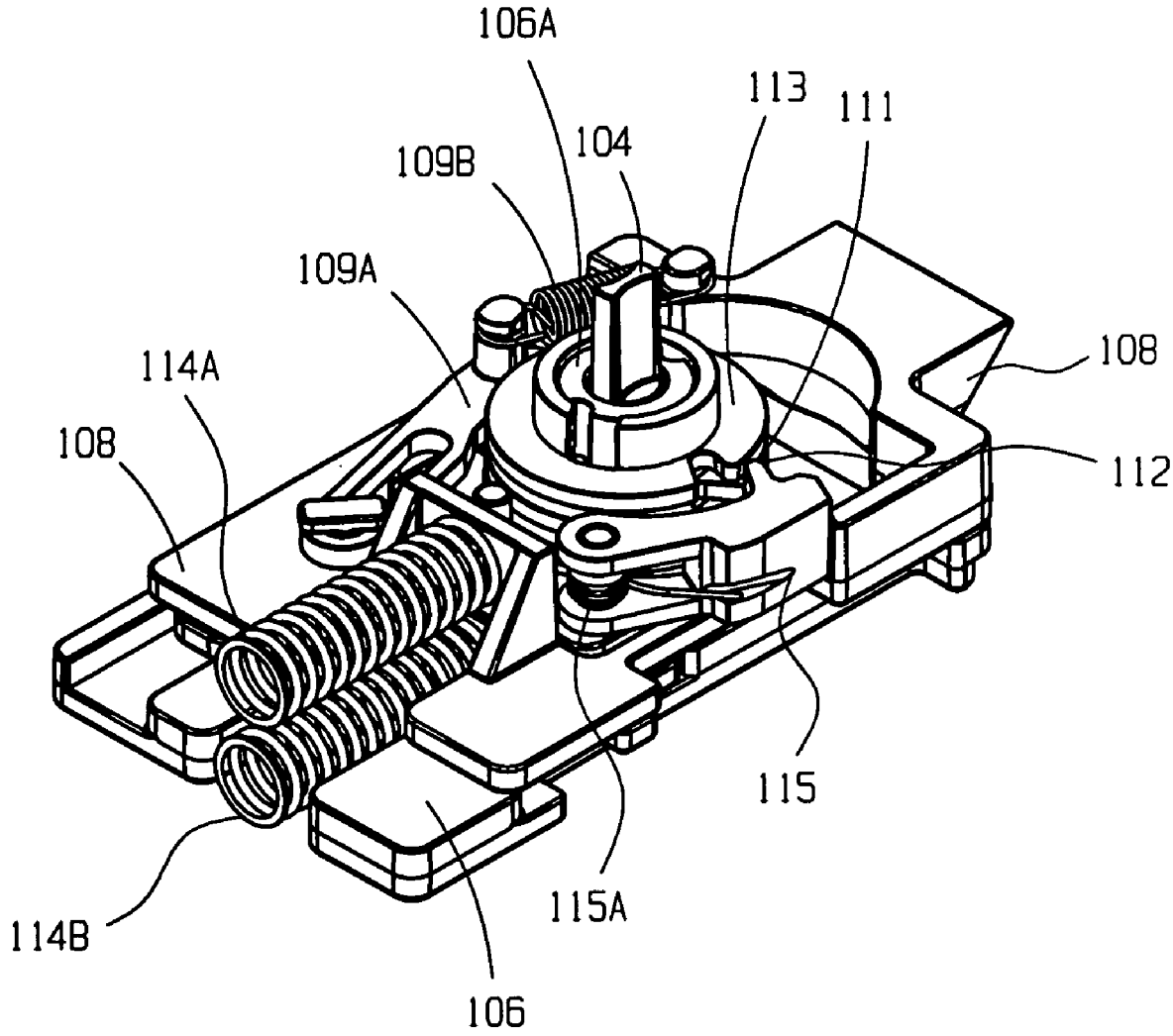
Figure 36:
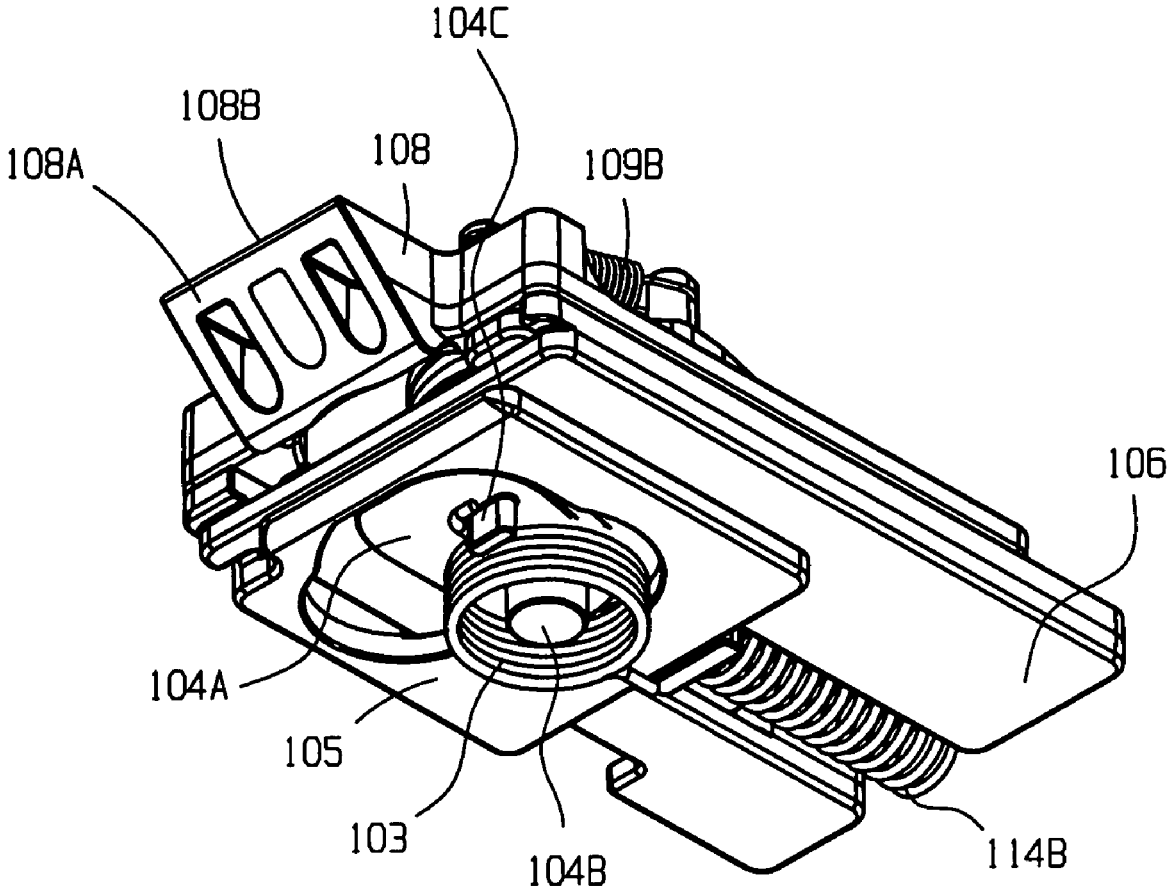

Opening the horizontal lock is similar to opening the vertical lock, as far as the dial assembly is concerned. Referring initially to FIGS. 33, 40, 41, and 53, the present invention configured as a horizontal built-in lock assembly 101 includes a dial assembly 200 attached to a lock casing 102 and a cover plate 116 by fasteners 125, a retaining plate 124, and a plastic piece 118. A bolt 108 is slideably disposed in the lock casing 102 and can extend from an opening 102*a* on a side 102*b* of the lock casing 102. The dial assembly 200 includes a number dial 123, a tumbler dial 122, a key cylinder 121, a ball bearing 120, a dial cam 119 and a tumbler extension 117. For the horizontal lock 101, the dial assembly 200 engages the plug extension 104 and top tumbler 113 in the same manner as the dial assembly 100 engages the plug extension 7 and the top tumbler 13 in the vertical lock 1. As with the vertical lock assembly 1, FIG. 35 shows that the top tumbler 113 and the plug extension 104 are exposed through the opening 116*a* in the cam cover plate 116 for engagement with the dial assembly 200. Specifically, the tumbler extension 117 is fixable attached to tumbler dial 122 and engages the top tumbler 113 such that the top tumbler 113 and the dial assembly 200 rotate together. The key cylinder 121 is rotatable mounted into the tumbler dial 122 offset from the rotational axis of the tumbler dial 121. The dial cam 119 is fixably attached to the distal end 121*a* of the key cylinder 121 such that rotation of the key cylinder 121 will rotate the dial cam 119.

Figure 51:
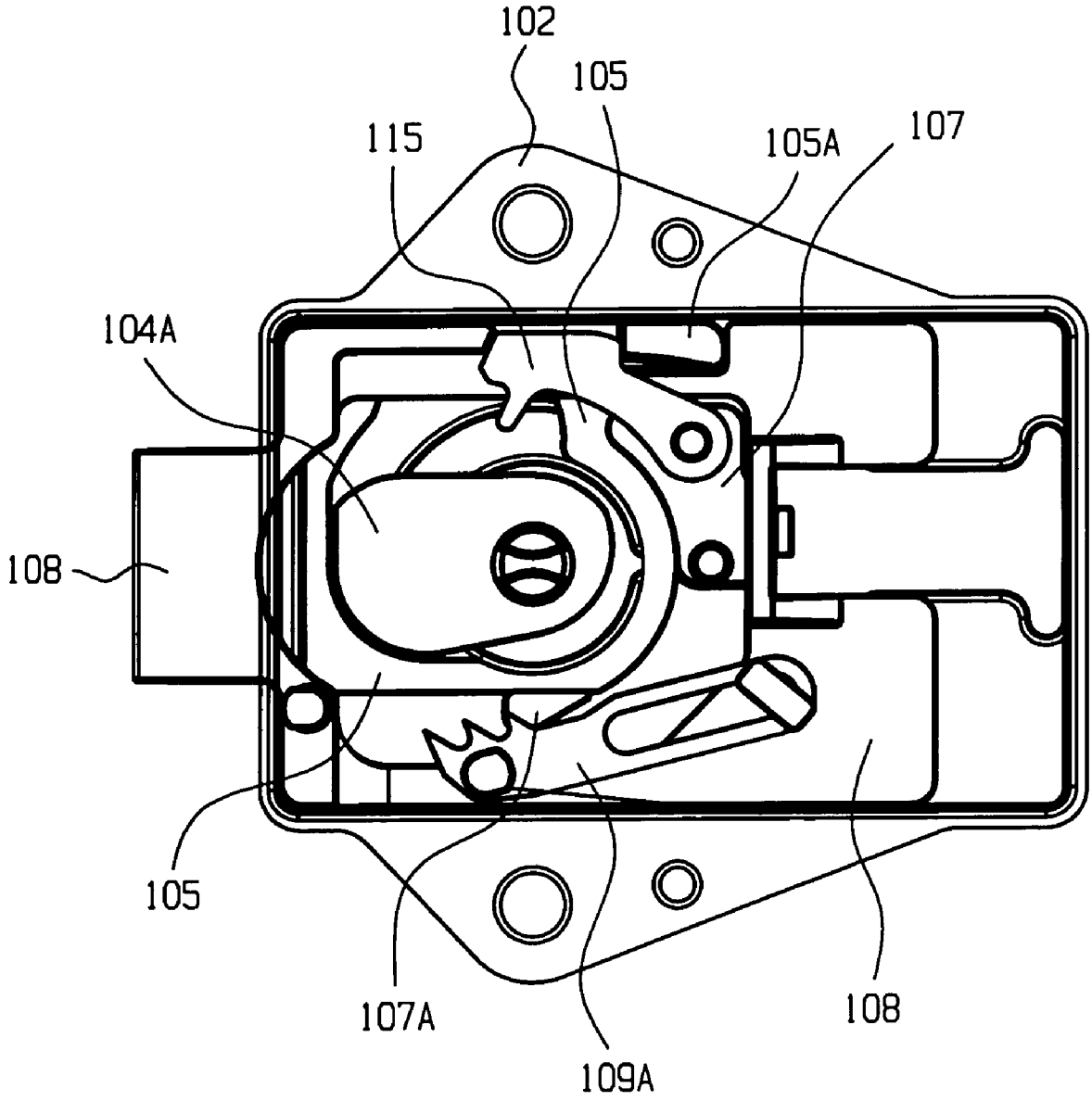
Figure 52:
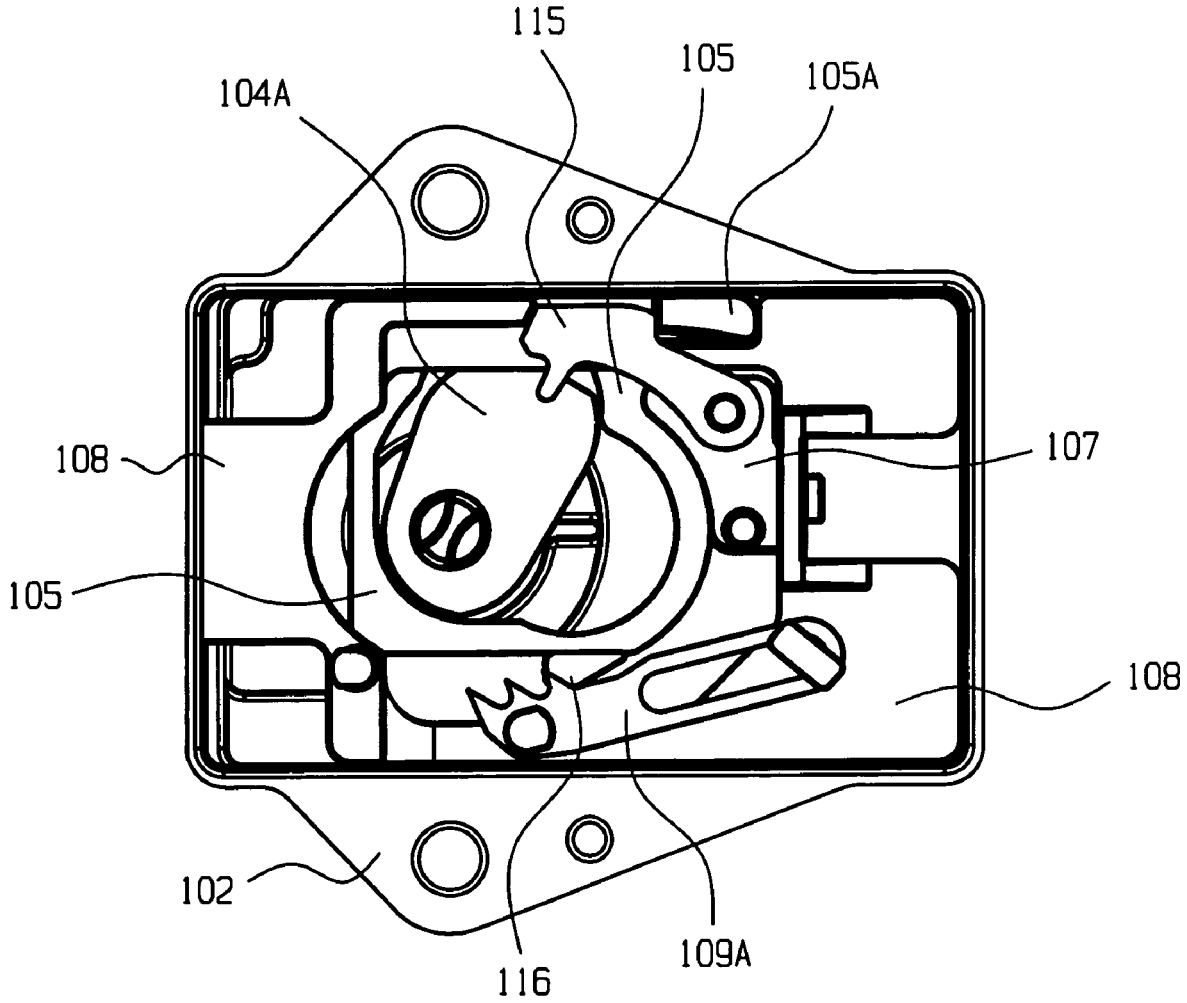

FIGS. 42-52 illustrate the horizontal built-in locking assembly. The locked position and alignment of the lock and dial are shown in FIG. 51. As with the vertical lock assembly 1, when the horizontal lock assembly 101 is in the locked position, the dial assembly 200 can rotate about the axis of the tumbler dial 122 without the dial cam 119 engaging the plug extension 104. In this state, the lock can only be opened with the proper combination. If, however, the proper key is inserted into the key cylinder 121 and turned clockwise, the key will drive the dial cam 119 into engagement with the plug extension 104. Once the plug extension 104 is engaged by the dial cam 119 and the dial cam 119 is rotated to the designed stop, the continued rotation of the key will rotate the dial assembly 200 with the plug extension 104. As shown in FIGS. 51-52, when the plug extension 104 is rotated in this manner, the plug extension cam 104*a* will engage and move the cam plate 105. The cam plate 105 includes a tower 105*a* which extends outward from the plate 105, as shown in FIG. 58, and is generally positioned between the bolt 108 and the paw 115 when the horizontal lock 101 is in the locked position. When the cam plate 105 is moved by the plug extension cam 104*a*, the cam plate tower 105*a* engages the bolt 108 which further engages the paw 115. The paw 115 is coupled to the paw plate 107, thus, moving the cam plate 105 moves the bolt 108, the paw 115, and the paw plate 107 to an open (bolt retracted) position, and the locker door can now be opened.

Figure 38:
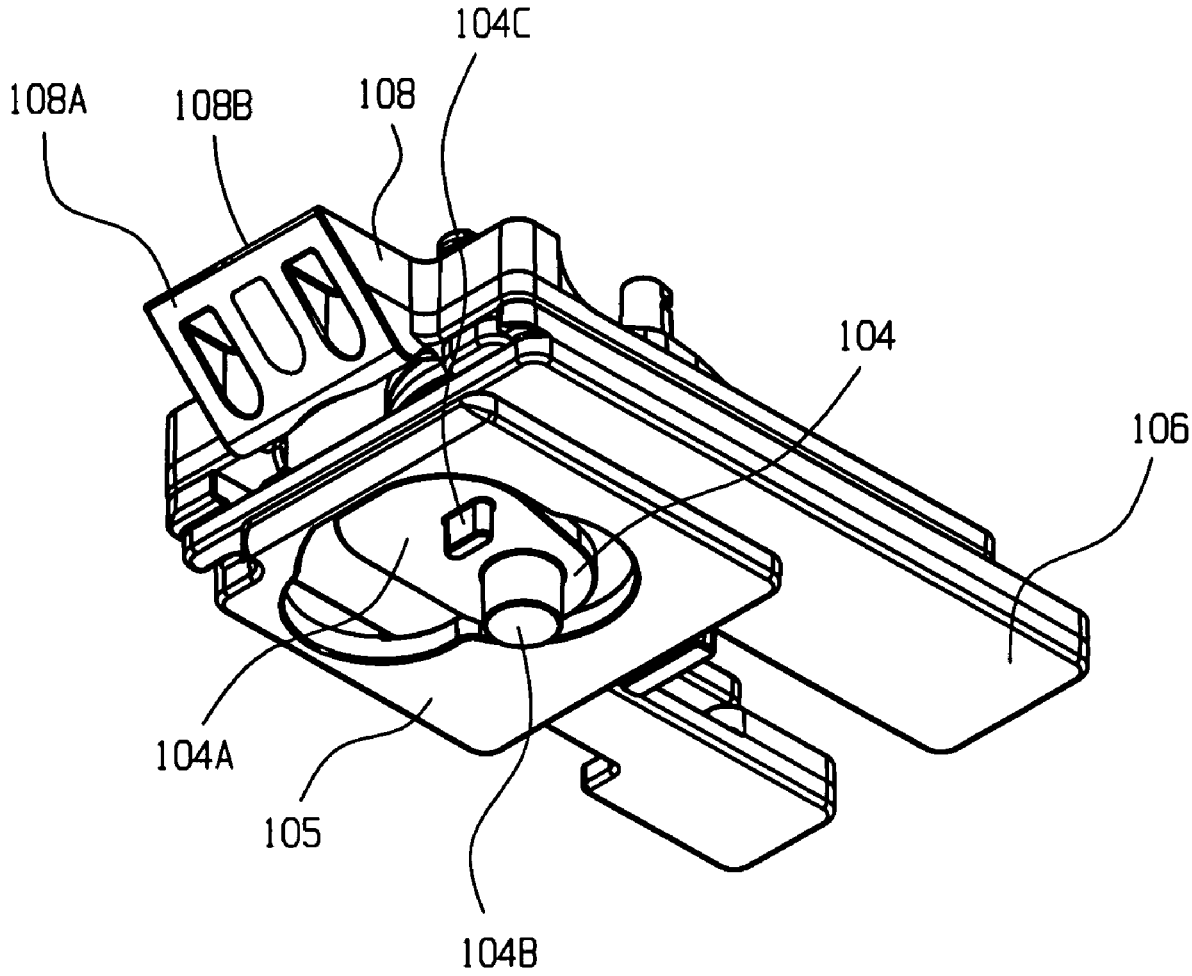
Figure 39:
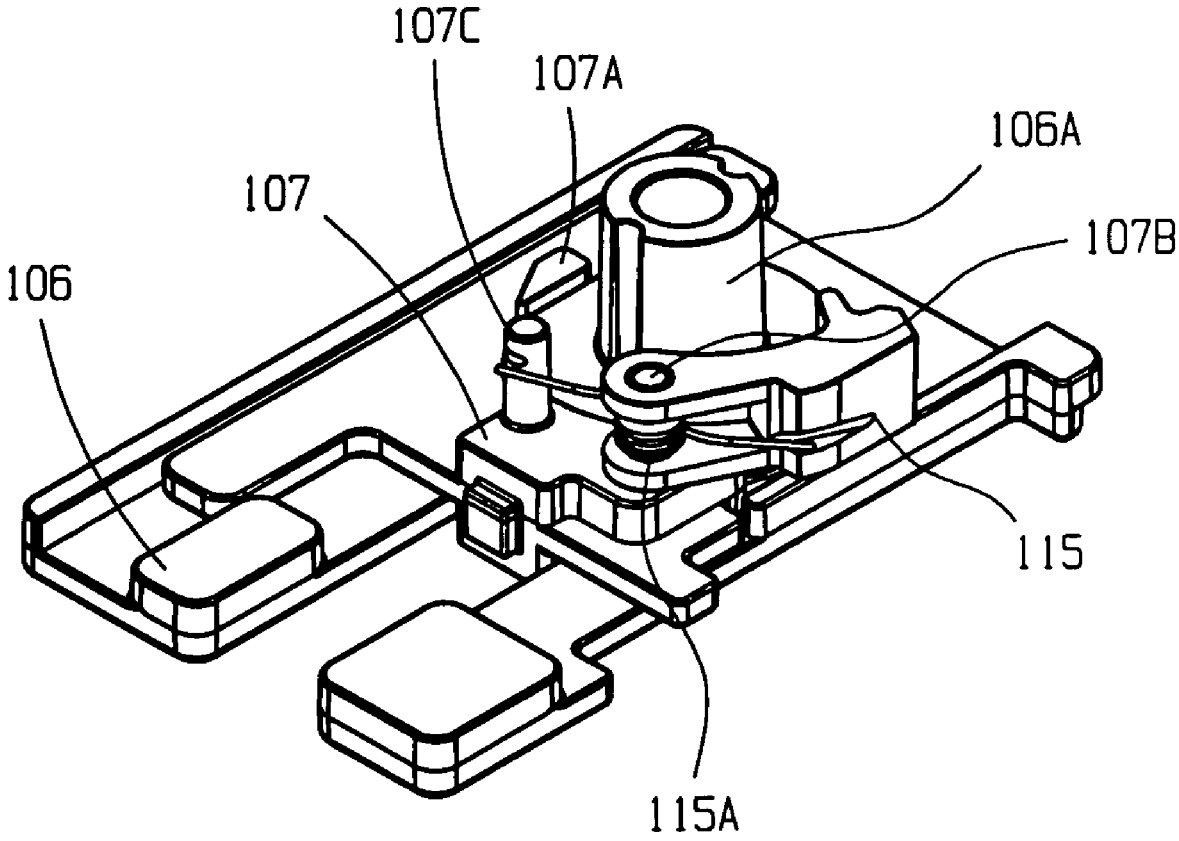
Figure 40:
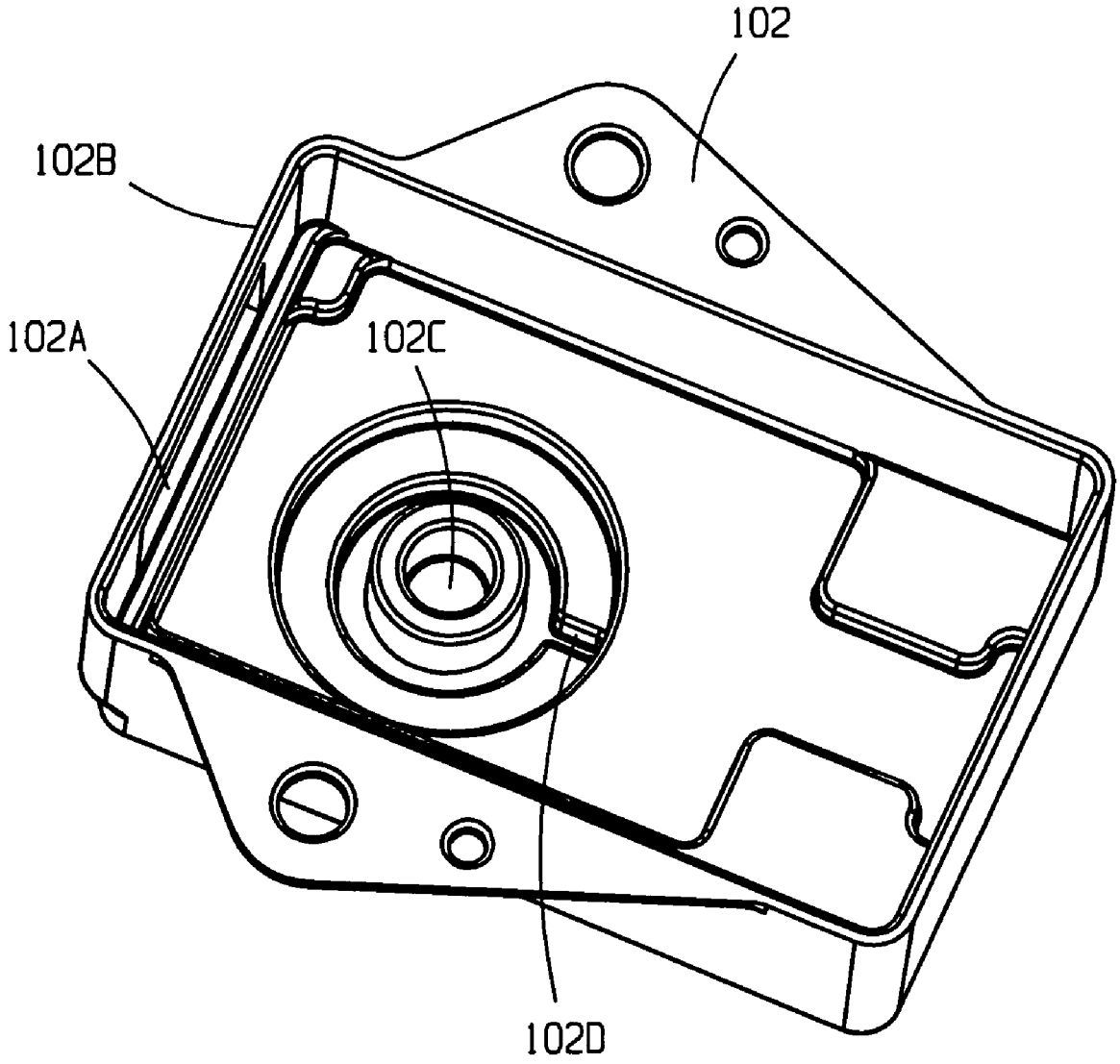
Figure 41:
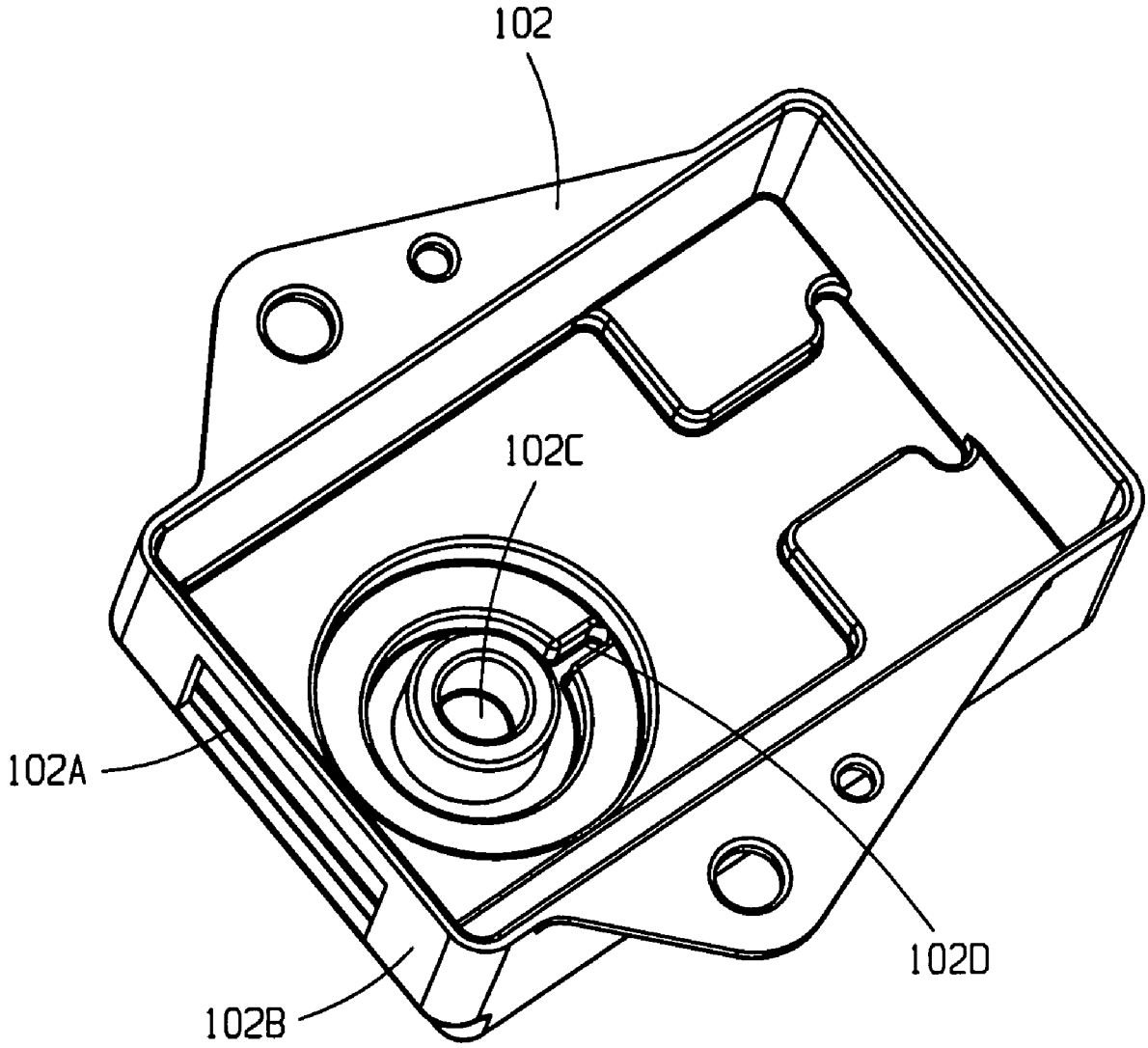

FIGS. 40-41 show a pocket 102*c* and a spring seat 102*d* on the lock casing 102. The distal end 104*b* of the plug extension 104, shown in FIGS. 38 and 40, is rotatable mounted in the pocket 102*c*. Further, the plug extension cam 104*a* includes a projection 104*c* extending axially from the cam 104*a*. A plug extension cam spring 103 engages the lock casing 102 at the spring seat 102*d* and engages the plug extension cam 104*a* at the projection 104*c*. The spring 103 is biased to rotate the plug extension cam 104*a* back to its original locked position. In addition, two springs 114, namely a bolt spring 114*a* and a paw plate spring 114*b*, are positioned between the lock casing 102 and the bolt 108 and the paw plate 107, respectively. The springs 114 are biased to move the bolt 108 and the paw plate 107 back to the locked (bolt extended) position. Thus, once the key is released and turned back for removal, the springs 114 and the cam spring 103 move the cam plate 105, the bolt 108, and the paw plate 107 to the locked position.

Operation of the Dial-Operated Horizontal Built-In Lock

As shown in FIGS. 34-39, the base plate 106, positioned within the lock casing 102, includes a hollow stem 106*a* projecting perpendicular from the base plate 106.

Figure 53:
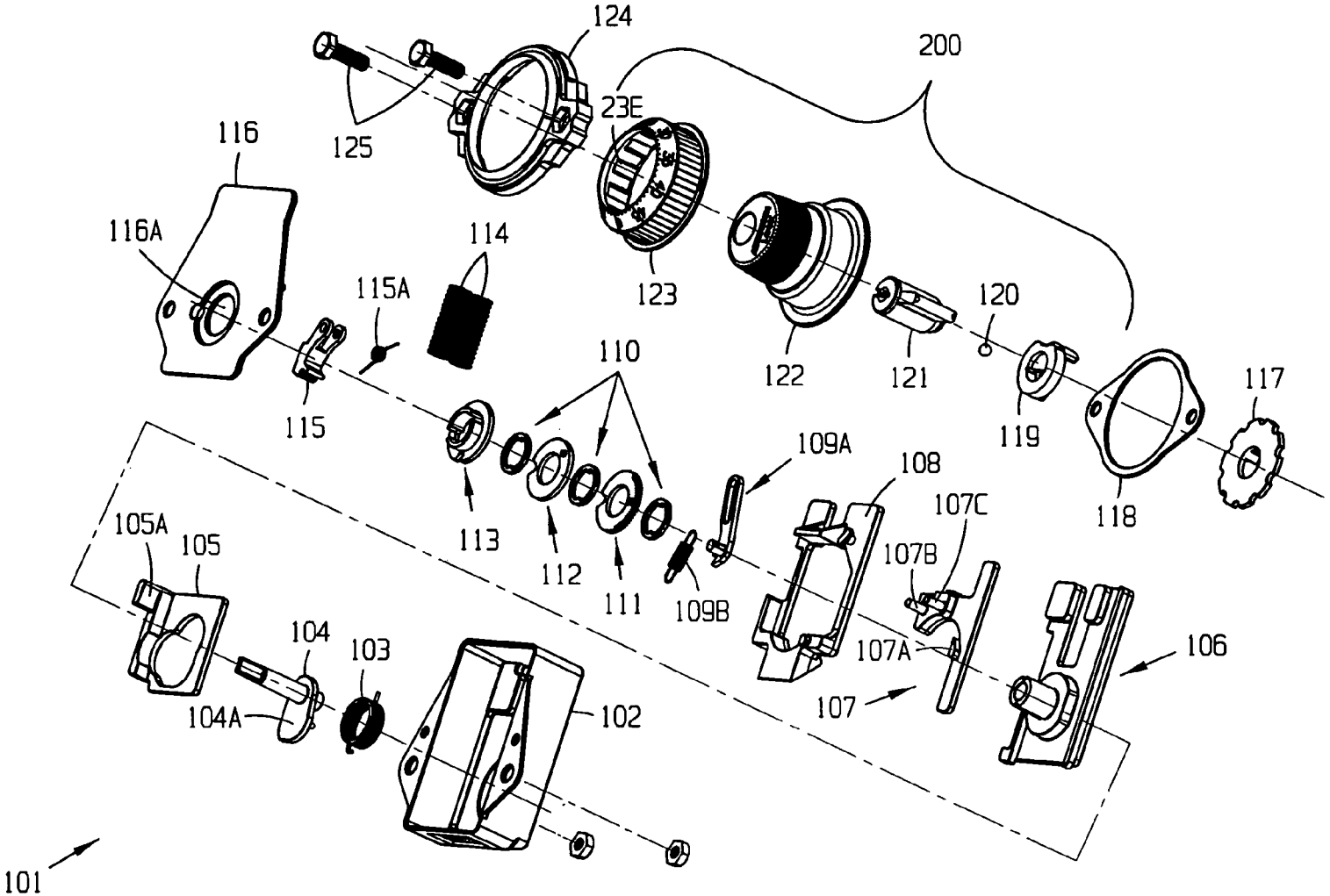
FIG. 53 is a schematic exploded view of the components of the horizontal lock assembly.

The plug extension 104 is rotatably positioned on the inside of the hollow stem 106*a* and a top tumbler 113, a middle tumbler 112, and a bottom tumbler 111 are mounted onto the stem 106*a*. In addition, a tumbler spacer 110 is positioned between the top tumbler 113 and the middle tumbler 112, between the middle tumbler 112 and the bottom tumbler 111, and between the bottom tumbler 111 and the base plate 106, as shown in FIG. 53. Tumbler spacers, as shown, are positioned in the same manner on the vertical lock assembly 1. The tumblers 113, 112, and 111 are rotatable to each other and each include an indentation 110*a*. When the proper combination is entered into the dial assembly 200, the indentations 110*a* align axially along the stem 106*a*. When the indentations 110*a* are not aligned, the tumblers 113, 112, and 111 are considered to be in an upset position. Tumblers having indentations such as these are known in the art.

Figure 42:
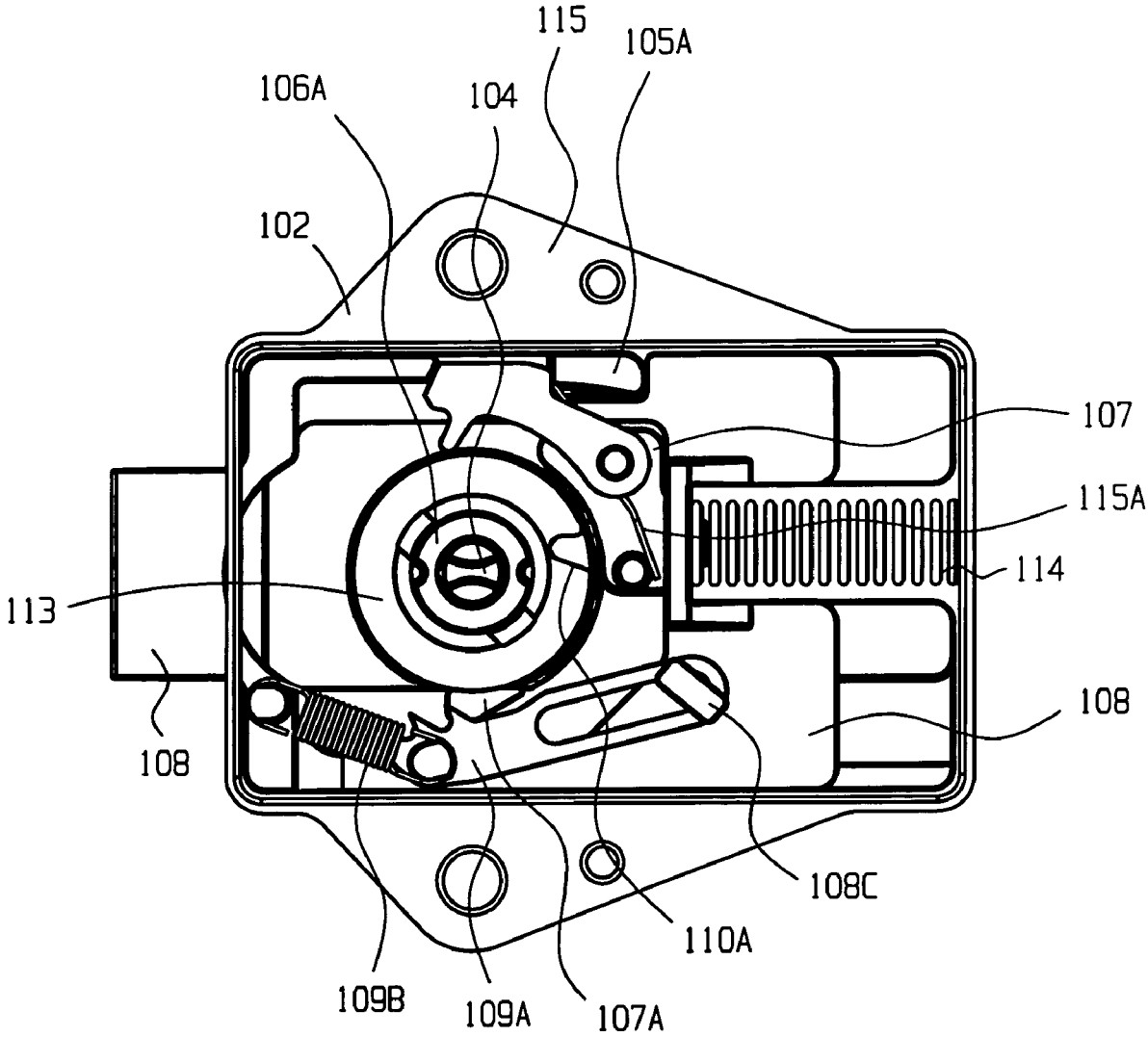

FIG. 42 shows the top view of the horizontal lock in the locked position with the top tumbler 113, the middle tumbler 112, and the bottom tumbler 111 in the upset position. The bolt 108 can not be forced to retract due to the plug extension cam 104*a*, the cam plate 105 and the paw 115 all being in the locked position. Specifically, in the locked position, plug extension cam 104*a* is positioned as shown in FIG. 51. In this position, plug extension cam 104*a* blocks longitudinal movement of the cam plate 105. Referring to FIG. 42, when a force attempts to retract the bolt 108, the bolt 108 engages the paw 115 which engages the cam plate tower 105*a*. However, because the cam plate 105 held in place by the plug extension cam 104*a*, the cam plate tower 105*a* is likewise held in place and the bolt 108 cannot retract.

Figure 43:
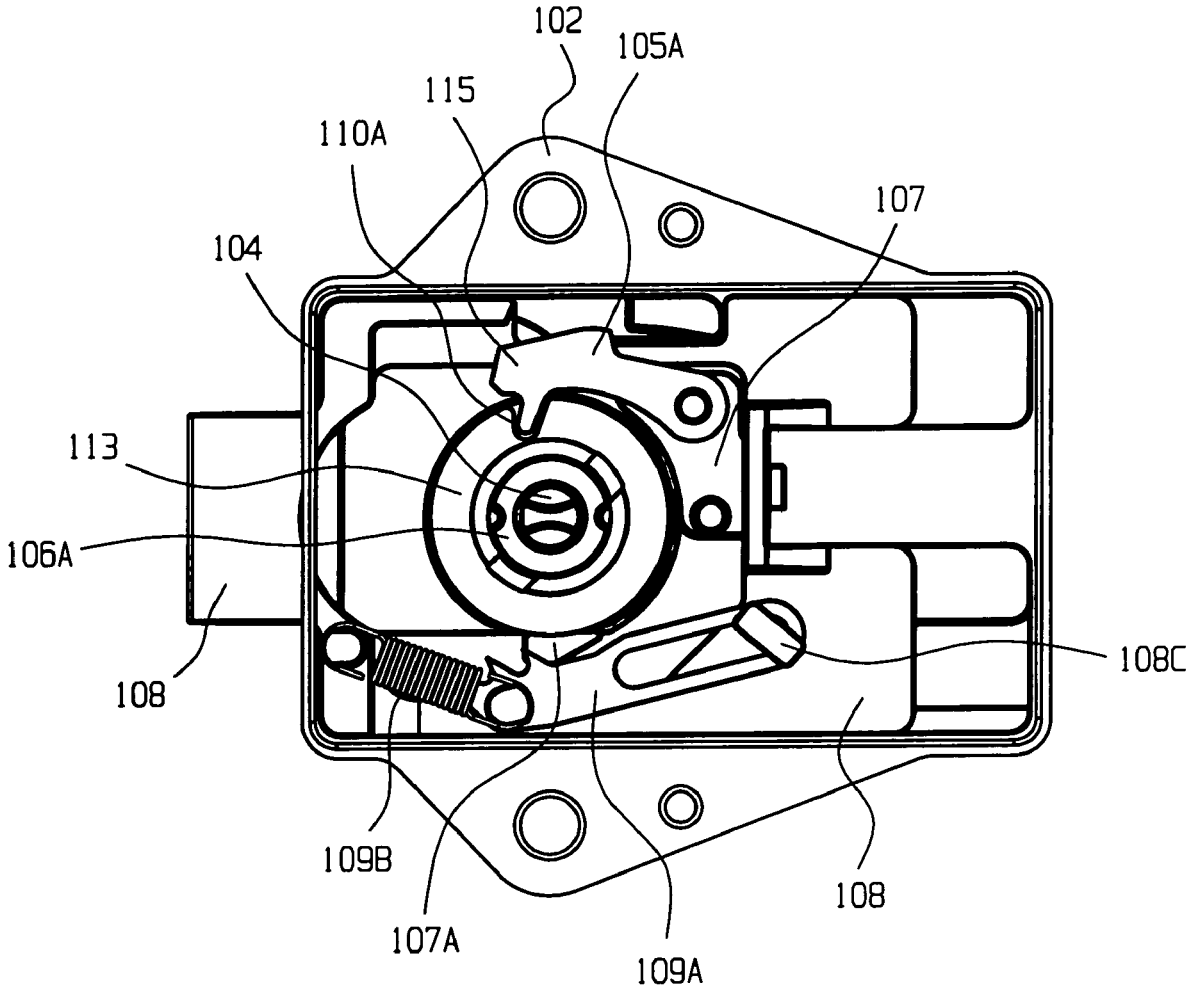
Figure 44:
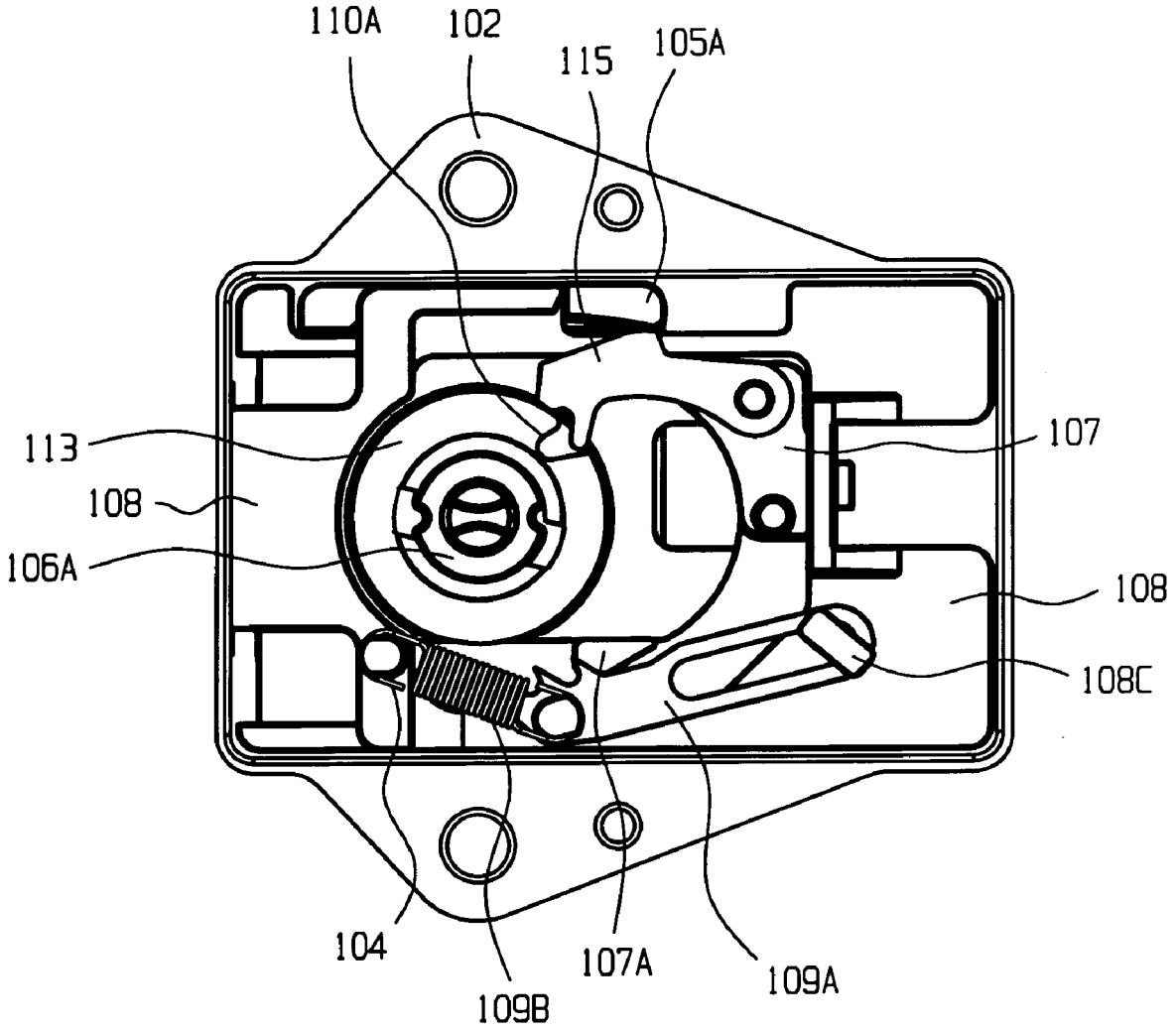
Figure 45:
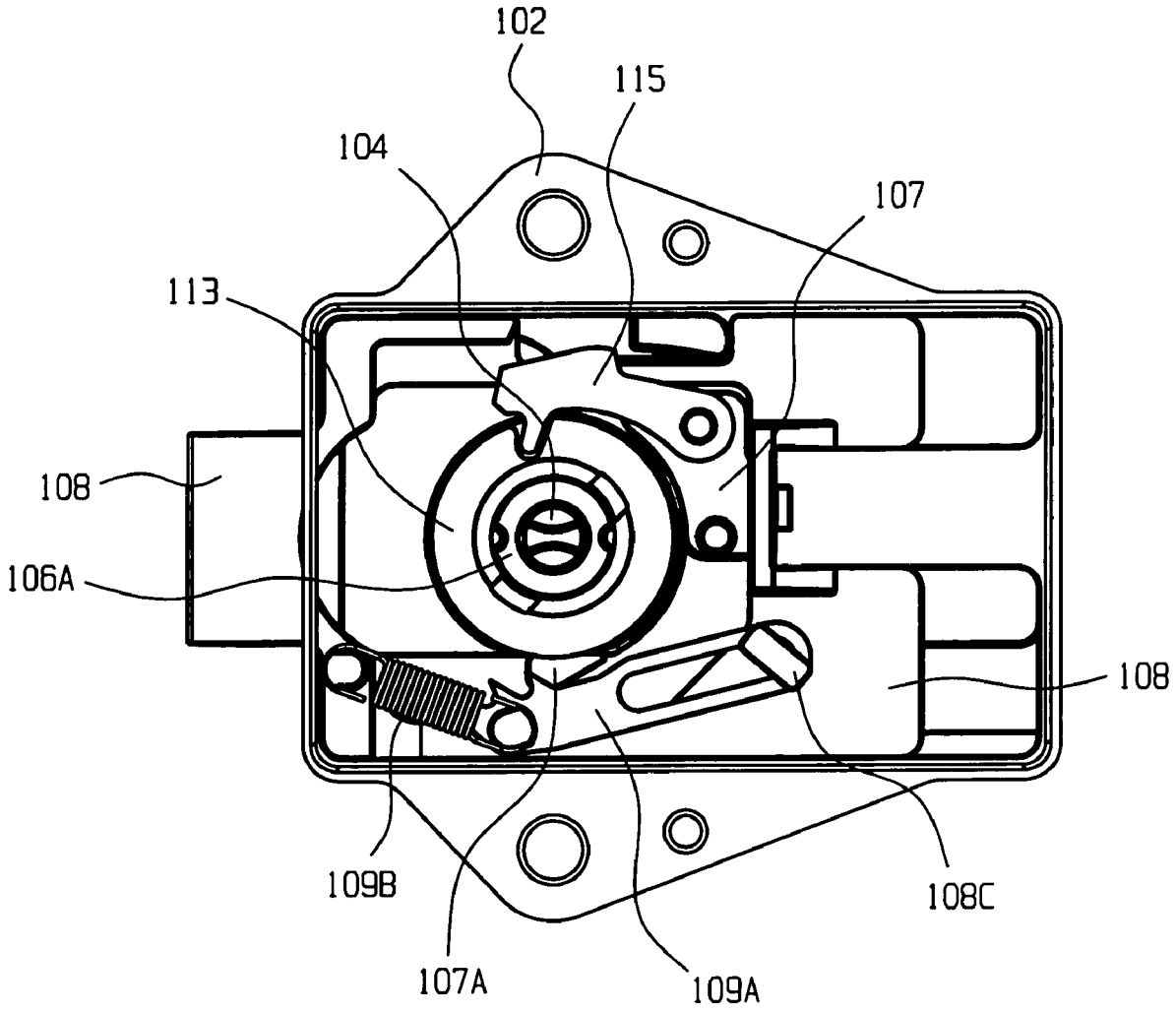

As shown in FIG. 41, the paw 115 is pivotably mounted on the paw plate 107 at a first post 107*b*. A paw spring 115*a* is also mounted on the first post 107*b* and engages a second post 107*c* and the paw 115 so as to bias the paw 115 into the tumblers 113, 112, and 111. As shown in FIG. 43, when the proper combination is dialed, the indentations 110*a* on the tumblers 113, 112, and 111 align and the paw spring 115*a* engages the paw 115 with the indentations 110*a*. When the paw 115 is engaged with the indentations 110*a*, it is no longer positioned between the bolt 108 and the cam plate tower 105*a*. In addition, when the paw 115 is engaged with the indentations 110*a*, turning the dial assembly 200 will turn all the tumblers 113, 112, and 111 together. Therefore, as shown in FIG. 44, further turning of the dial assembly 200 will push the paw 115 and the paw plate 107 against the bolt 108 resulting in the bolt 108 retracting to the open position. When the locker is opened, the dial assembly 200 can be released. Once the dial assembly 200 is released, the bolt 108 and the paw plate 107 will be returned to a locked position by the bolt spring 114*a* and the paw plate spring 114*b*, respectively, as shown in FIG. 45. In this position, the lock can be opened and closed as many times as needed by turning the dial assembly 200 back and forth, thus, the horizontal lock assembly 101 functions as a dead-bolt lock.

If, however, the locker door is closed and the dial assembly 200 is not rotated, the horizontal lock assembly 101 will function as a spring bolt lock. In generally, when the horizontal lock assembly 101 is mounted on a locker door (not shown) and the door is closed, the locker edge will cause the bolt 108 to retract. The locker edge typically including a door strike (not shown) which will contact the taper face 108*a*, shown in FIGS. 36 and 38, of the bolt 108. As the door strike continues along the taper face 108*a* of bolt 108, bolt 108 continues to retract until the strike passes the leading edge 108*b* of the bolt 108. At this point the bolt 108 moves to an extended position. The use of a tapered face 108*a* on a bolt 108 in conjunction with a door strike is known in the art.

Figure 34:
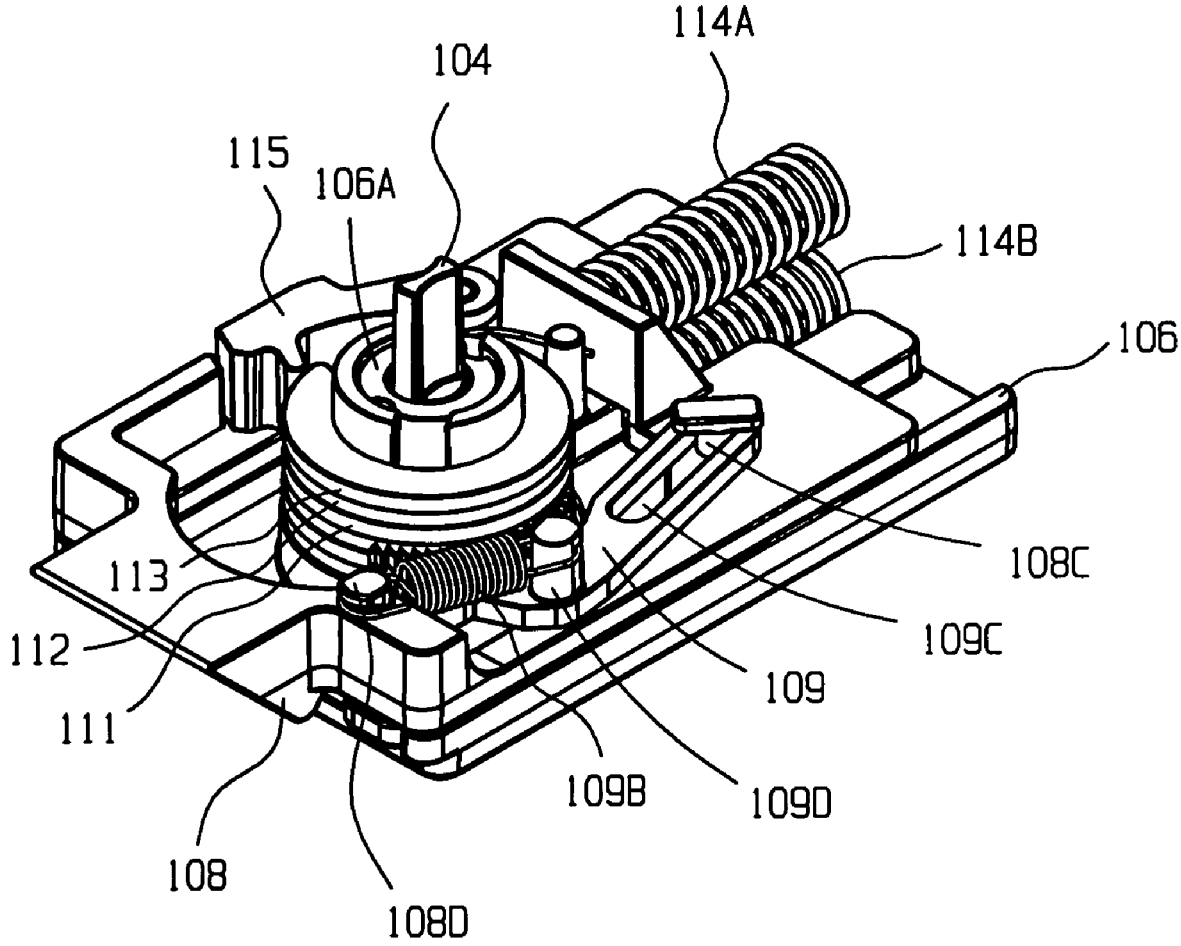
Figure 37:
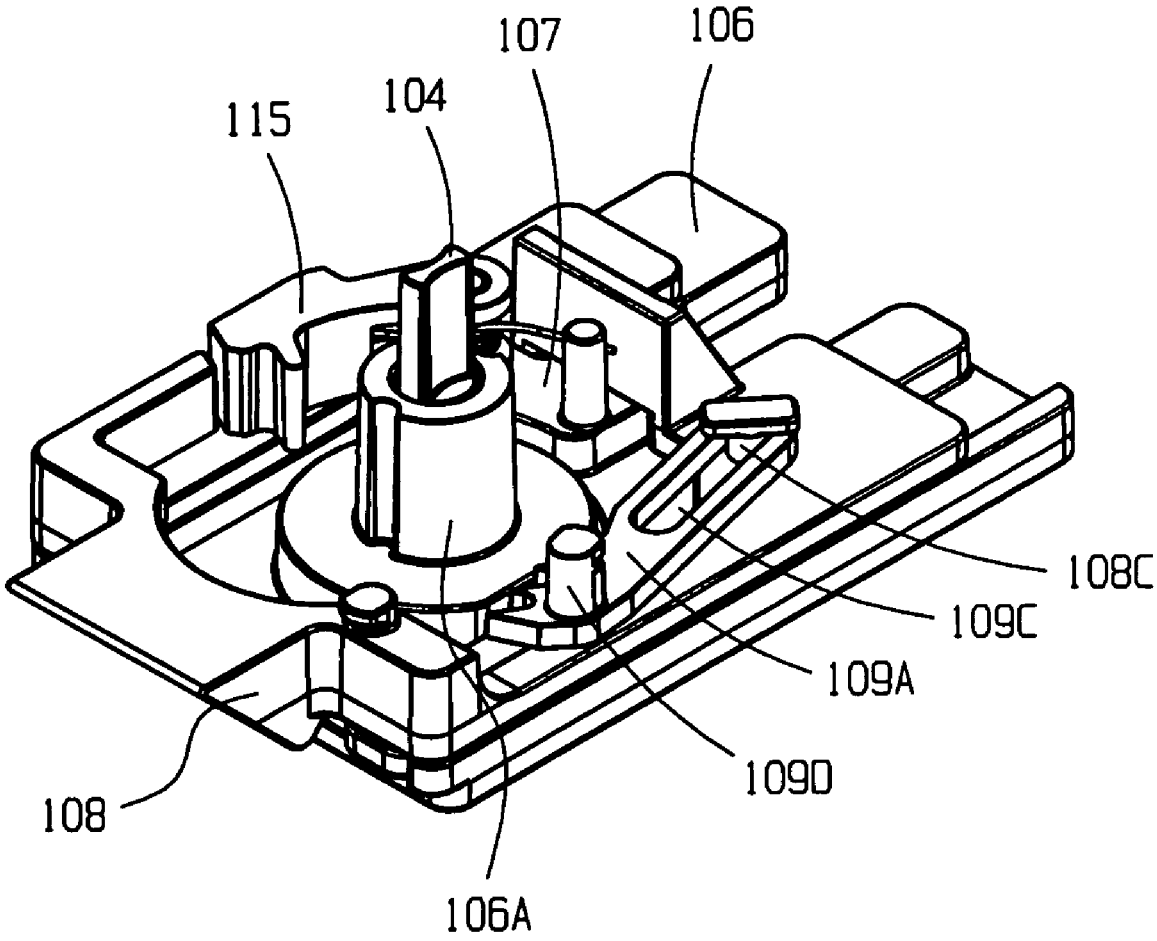
Figure 46:
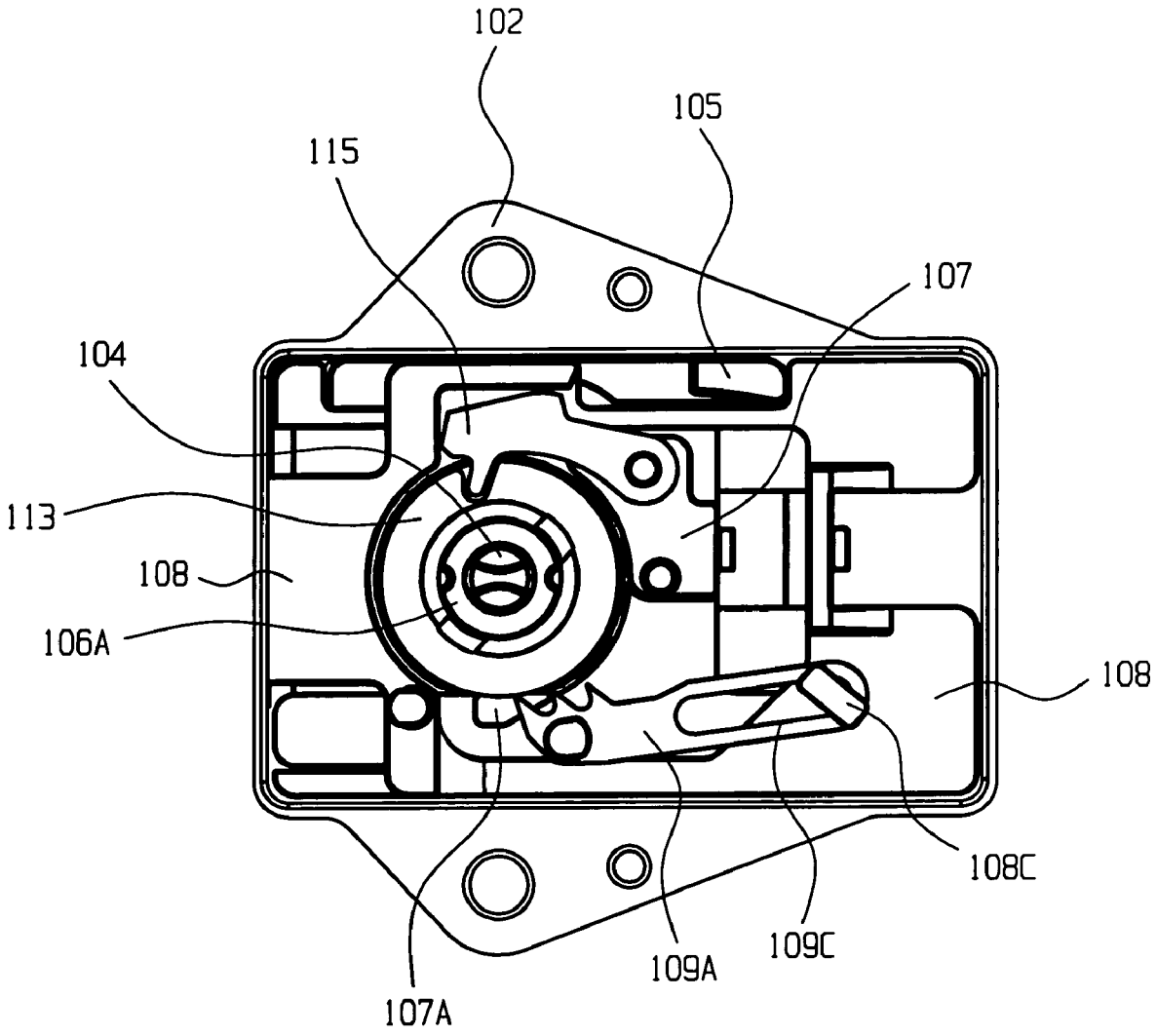
Figure 47:
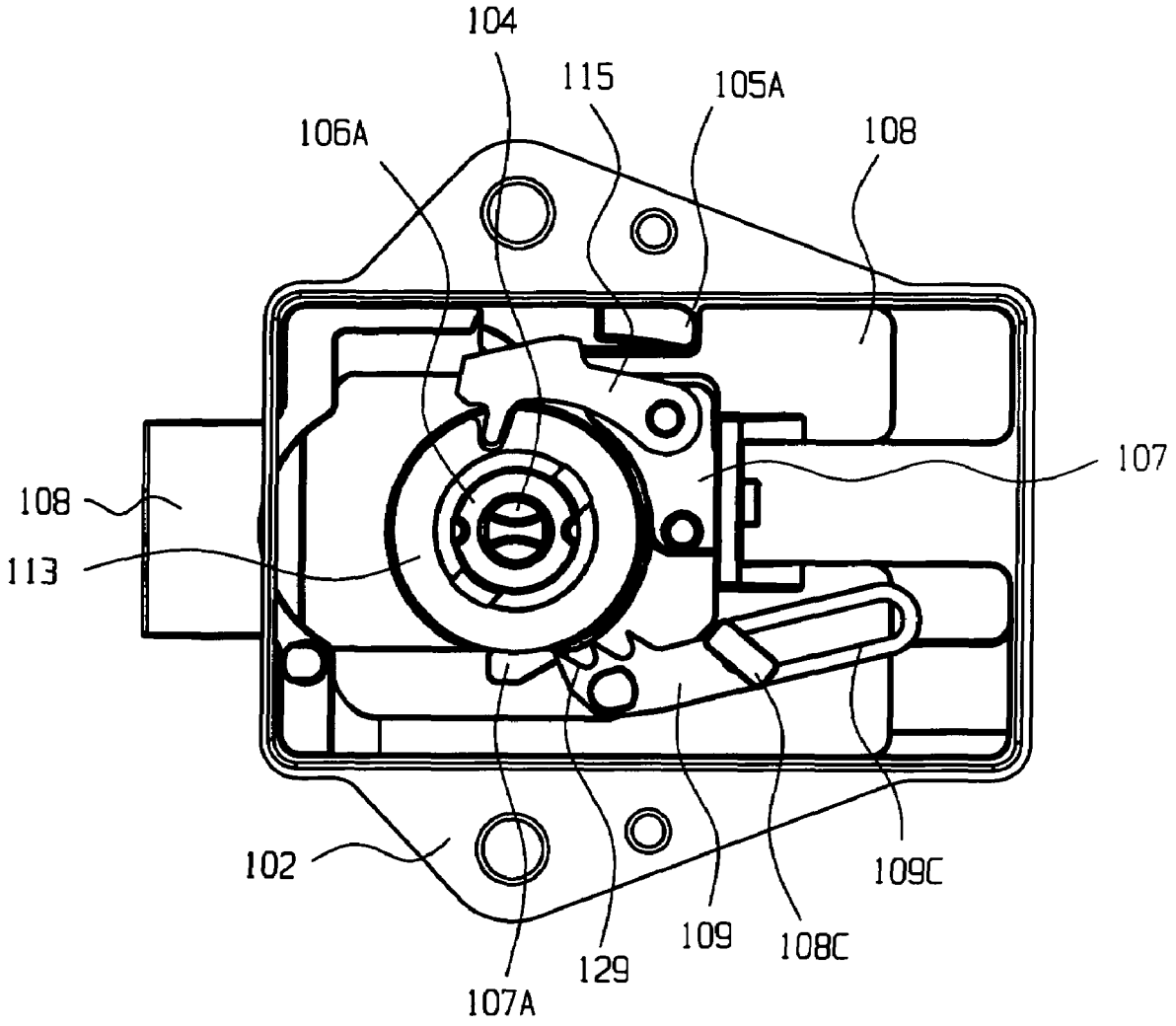
Figure 48:
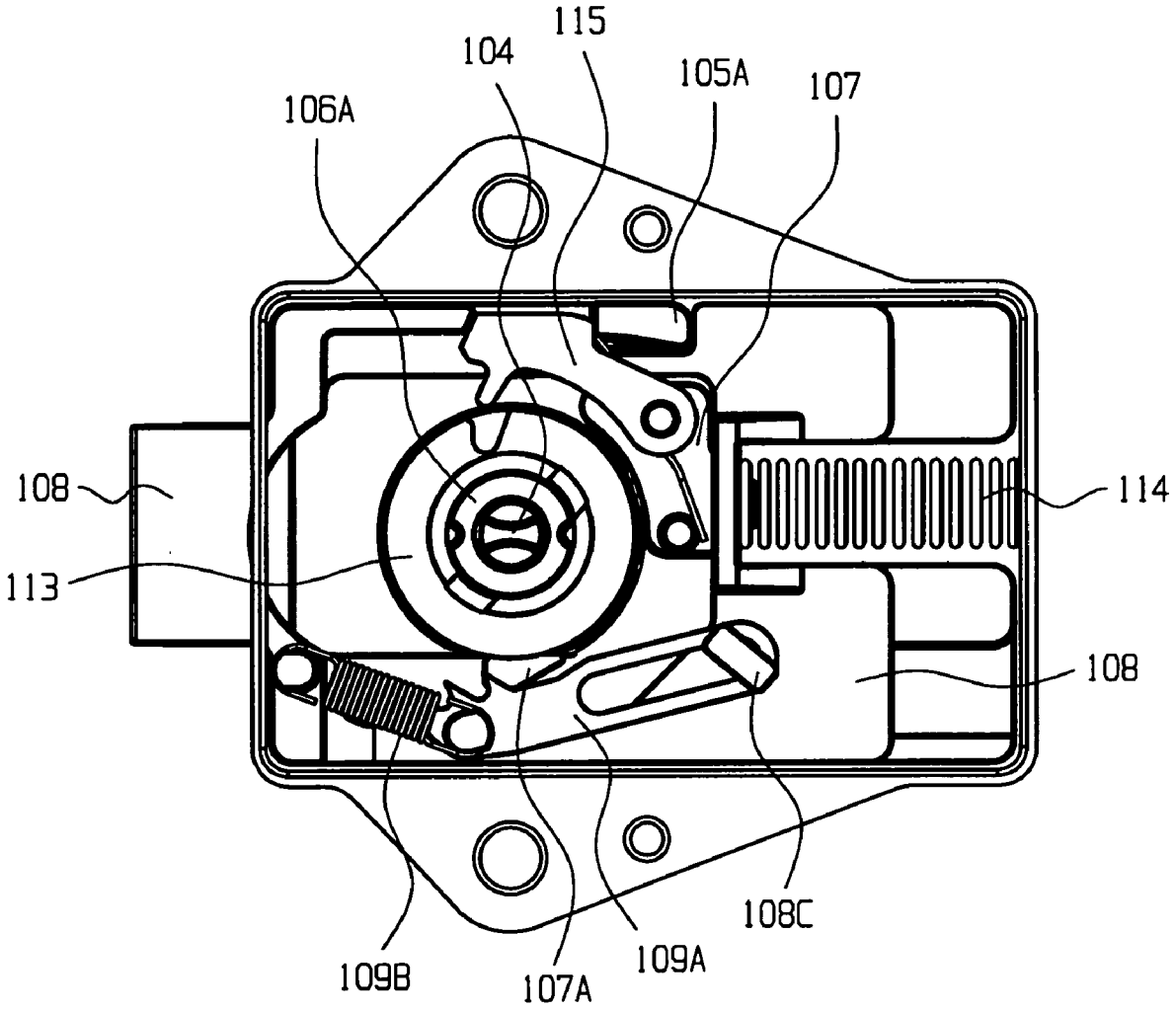
Figure 49:
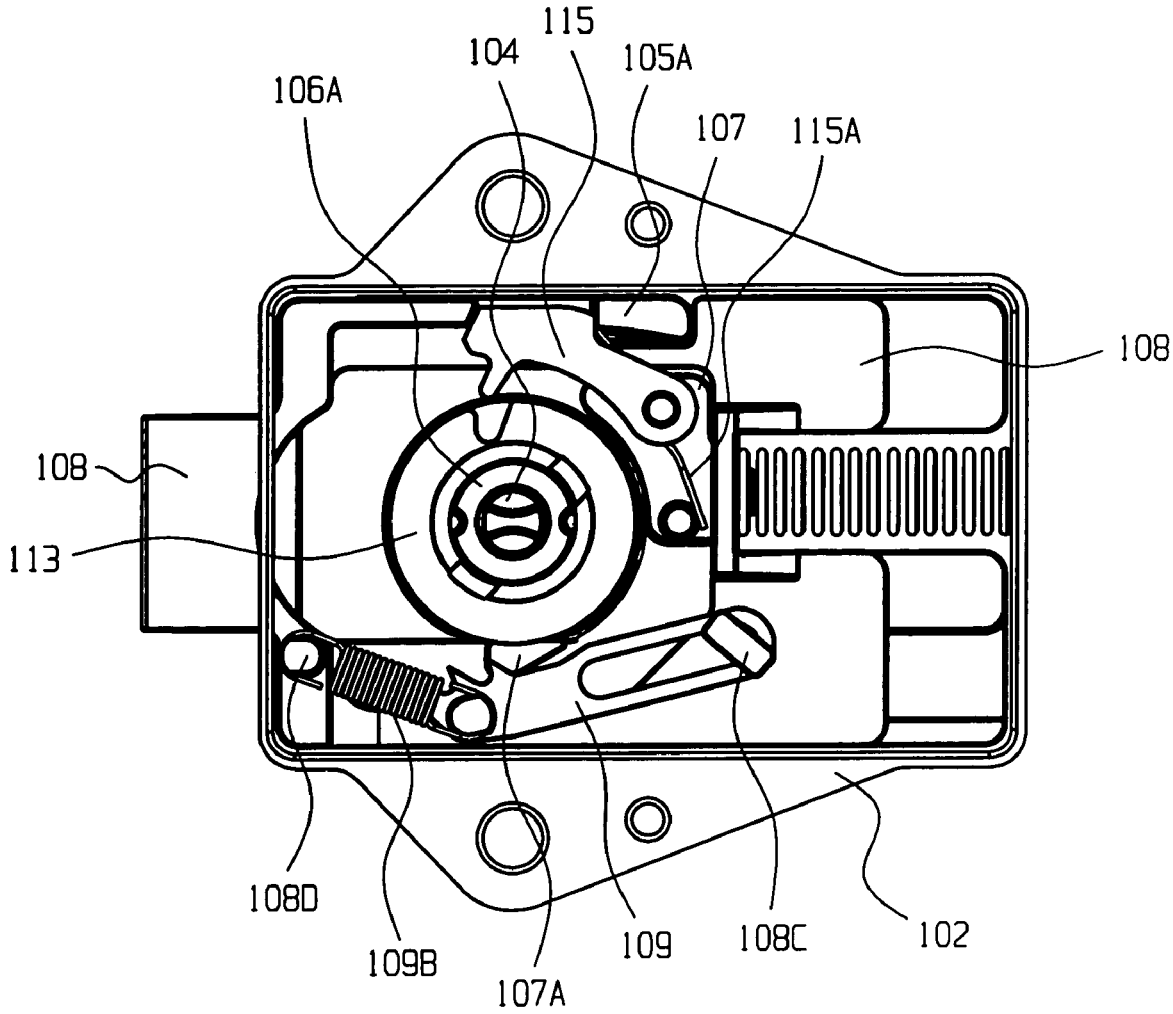
Figure 50:
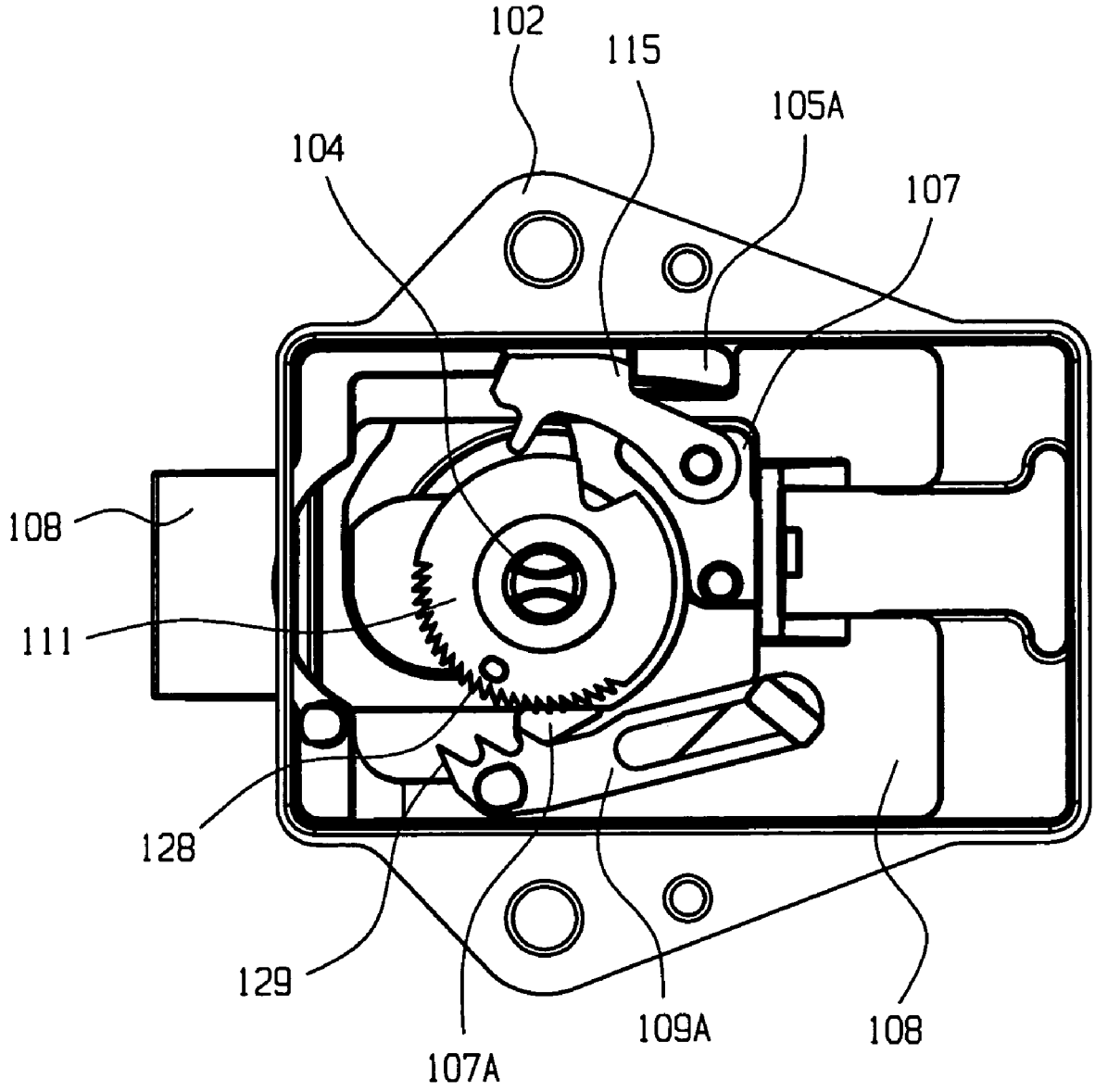

Specifically, as shown in FIG. 46, when the locker edge (not shown) causes the bolt 108 to retract, the upsetter 109*a* moves along with the bolt 108. The upsetter 109*a*, which includes a slot 109*c*, a post 109*d*, and teeth 129, is pivotably and slideably mounted onto bolt 108 at bolt post 108*c* as shown in FIGS. 34 and 37. When the locker edge retracts the bolt 108, the paw 115 and the paw plate 107 do not move with the bolt 108. This is due to the paw 115 no longer being positioned between the bolt 108 and the cam plate tower 105*a* and due to the force applied by the paw plate spring 114*b*. An upsetter spring 109*b* is attached to the bolt 108 at projection 108*d* and to the upsetter 109 at upsetter post 109*d*. The upsetter spring 109*b* biases the upsetter 109 toward the projection 108*d* and the bottom tumbler 113. When the bolt 108 and the paw plate 107 move together, the upsetter 109*a* is blocked from engaging the bottom tumbler 113 by a projection 107*a* on the paw plate 107. However, when the bolt 108 moves and the paw plate 107 does not, as described above, the shape of the projection 107*a* allows the upsetter to engage the bottom tumbler 113. When the locker door strike (not shown) passes the leading edge 108*b* and the bolt 108 moves toward a locked position, the upsetter 109*a* stays engaged into the bottom tumbler 111, as shown in FIGS. 51 and 52. This movement results in the upsetter spring 109*b* stretching until sufficient spring tension causes the upsetter spring 109*b* to pull the upsetter 109*a* and rotate the bottom tumbler 111. This rotation pushes the paw 115 out of the indentations 110*a* and back into the locked position, as shown in FIGS. 48 and 49. Due to all parts being positively engaged and disengaged by springs, the lock can be used on the opposite hand locker door.

Regardless of whether the present horizontal built-in lock is operated by key or by manipulation of the combination dial, the present horizontal built-in lock provides for easier use and improved security over the prior art. Specifically, the design of the present built-in horizontal lock provides for increased travel or movement of the locking bolt, namely from 7/32 inch to 13/32 inch. This increased movement of approximately 3/16 inch provides for greater engagement and travel of the locking rods, which further minimizes the ability to corrupt the locking mechanism which would allow unauthorized entry into the locker. In addition, the horizontal built-in lock of the present invention is symmetrical, thereby allowing one lock to be used on either right-handed or left-handed lockers. Furthermore, the present invention horizontal built-in lock includes the security of the present dead bolt mechanisms and the ease of use of the present spring bolt mechanisms. The present invention is designed to be a dead bolt in the locked position. When the proper combination is dialed, further rotation of the dial will push the locking bolt into the unlocked position, and allow the locker door to open. When the locker is open, the dial can be released, and the bolt will extend. The bolt is however, not in the dead bolt position, but rather in the spring bolt position. The locker can then just be closed. The bolt then acts like a spring bolt in that the locking bolt will retract into the lock and once the locker door is in the closed position, the locking bolt will extend back to the locked position. The lock will then be in the dead bolt mode. This means that it is designed for more security in that the bolt can not be manipulated by objects stuck into the locker.

Built-In Dial Combination Changes with Key

Figure 19:
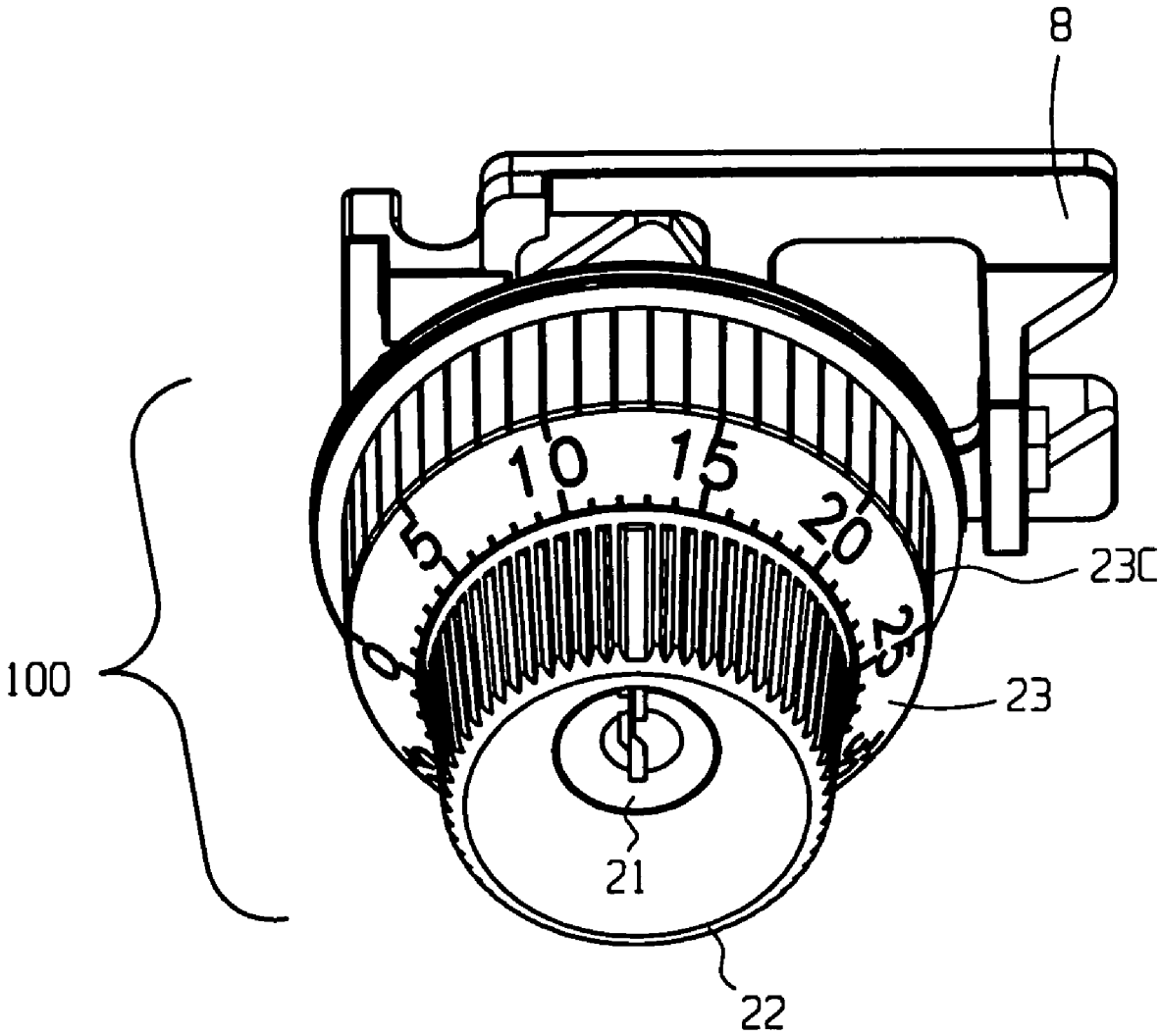
FIGS. 19-26 illustrate the present invention lock assembly and the combination changing mechanism employed therewith.
Figure 20:
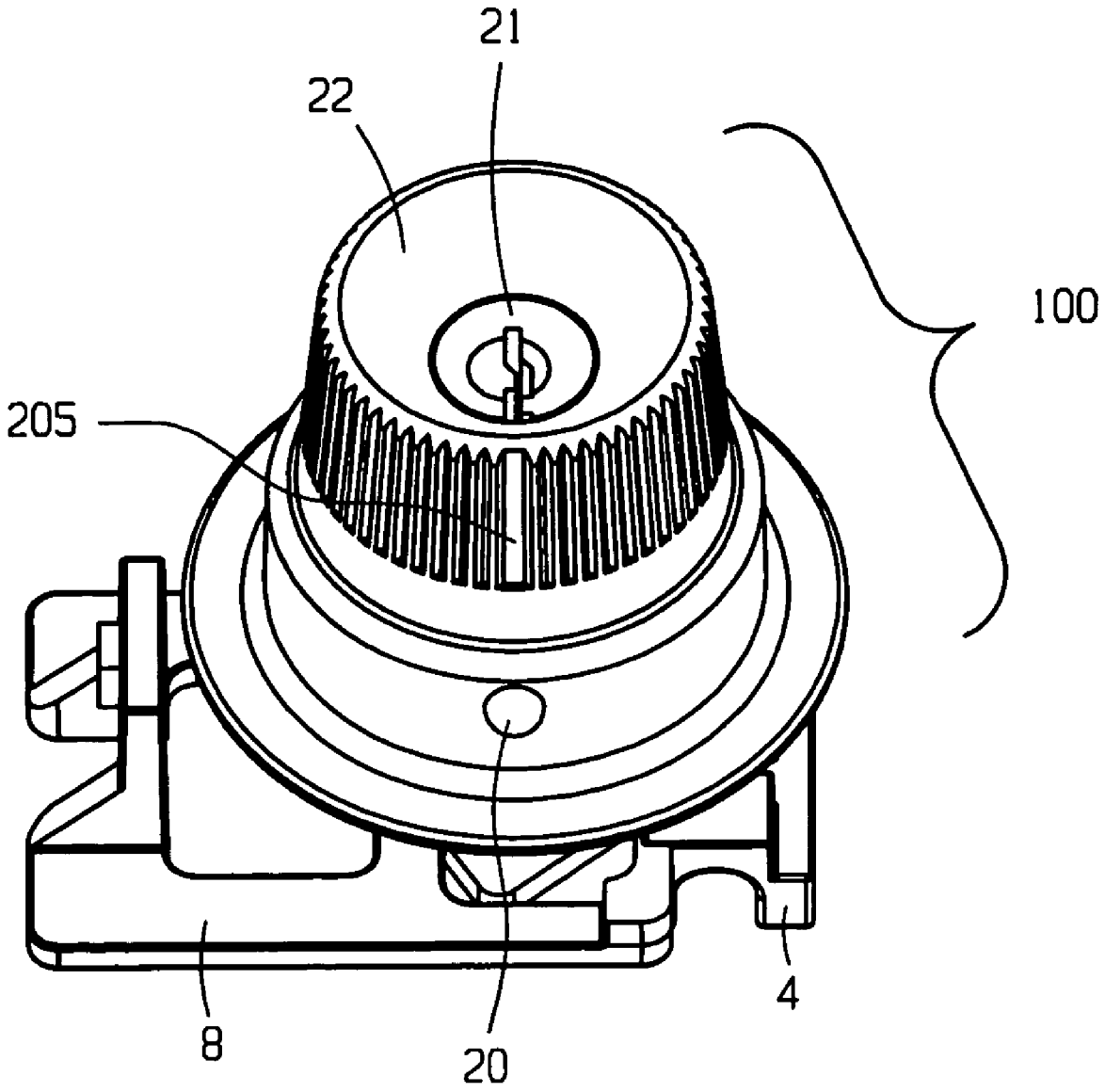
Figure 21:
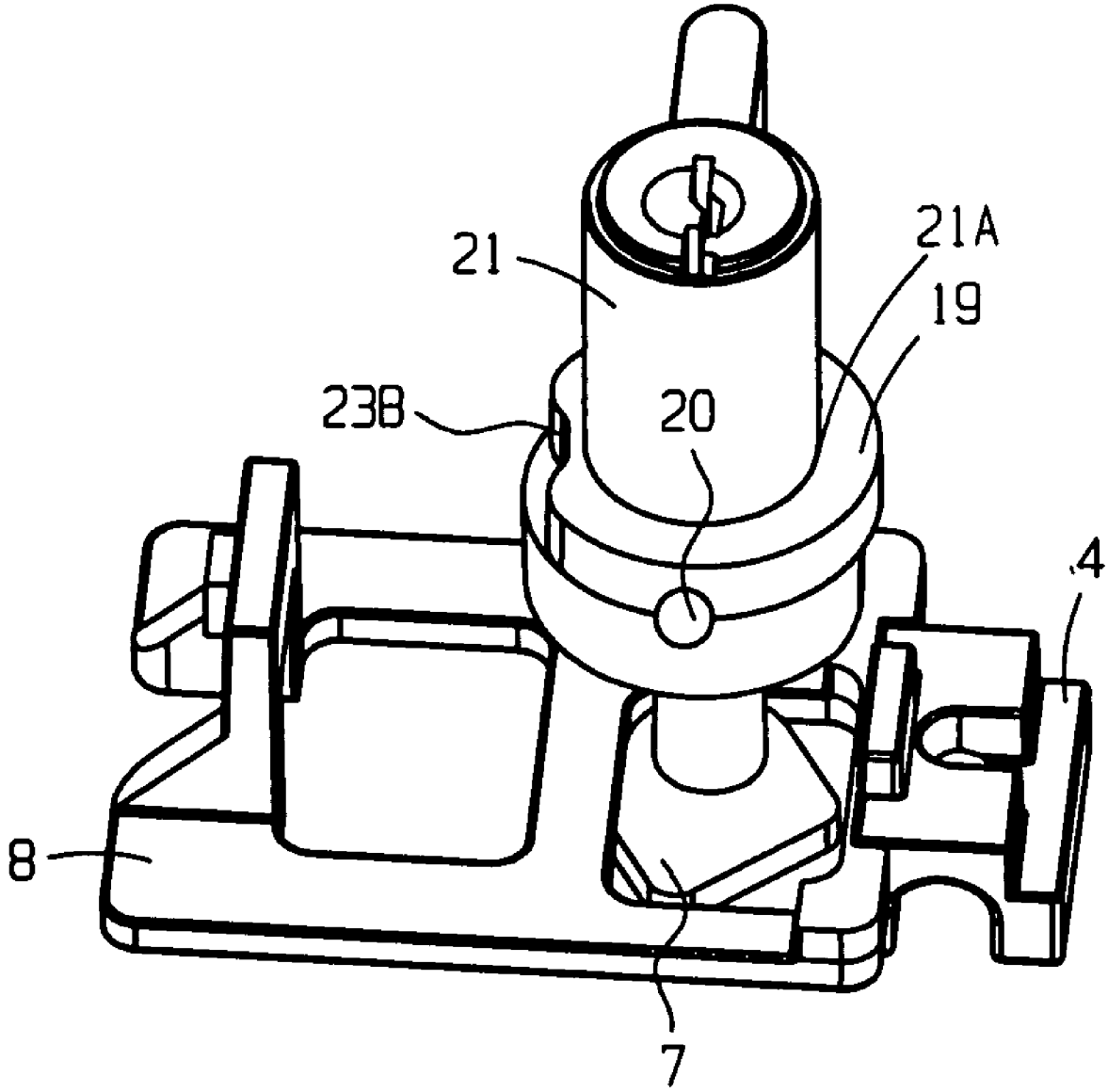
Figure 22:
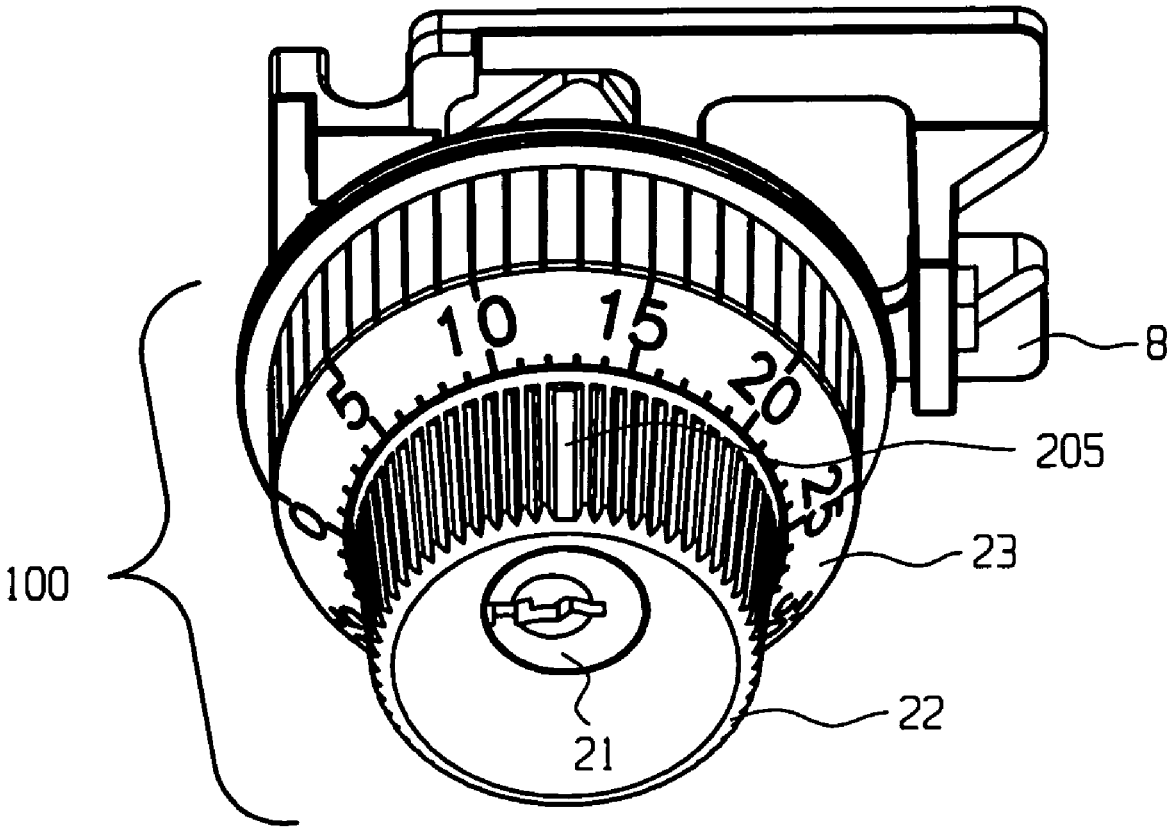
Figure 23:
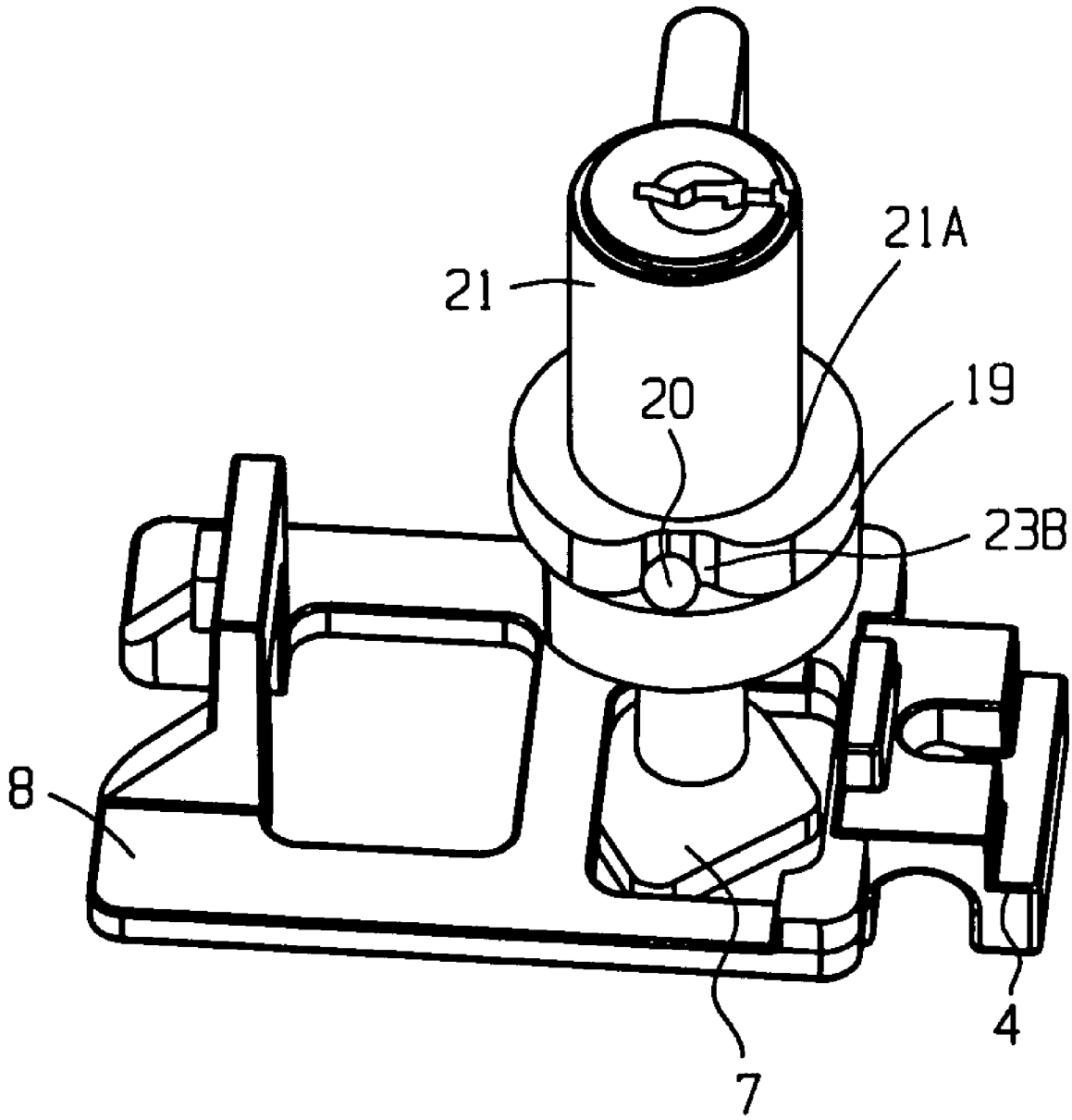
Figure 24:
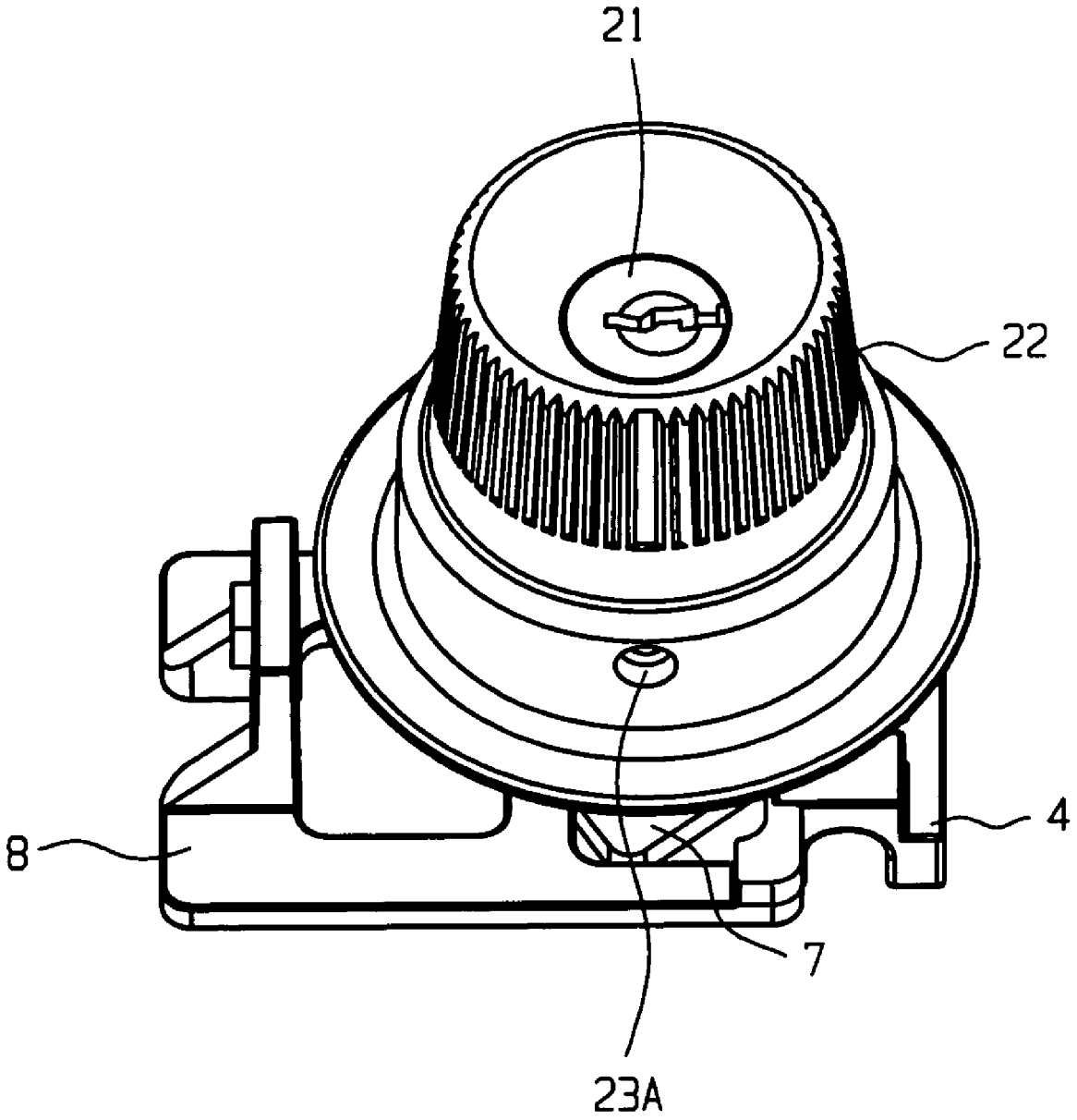
Figure 25:
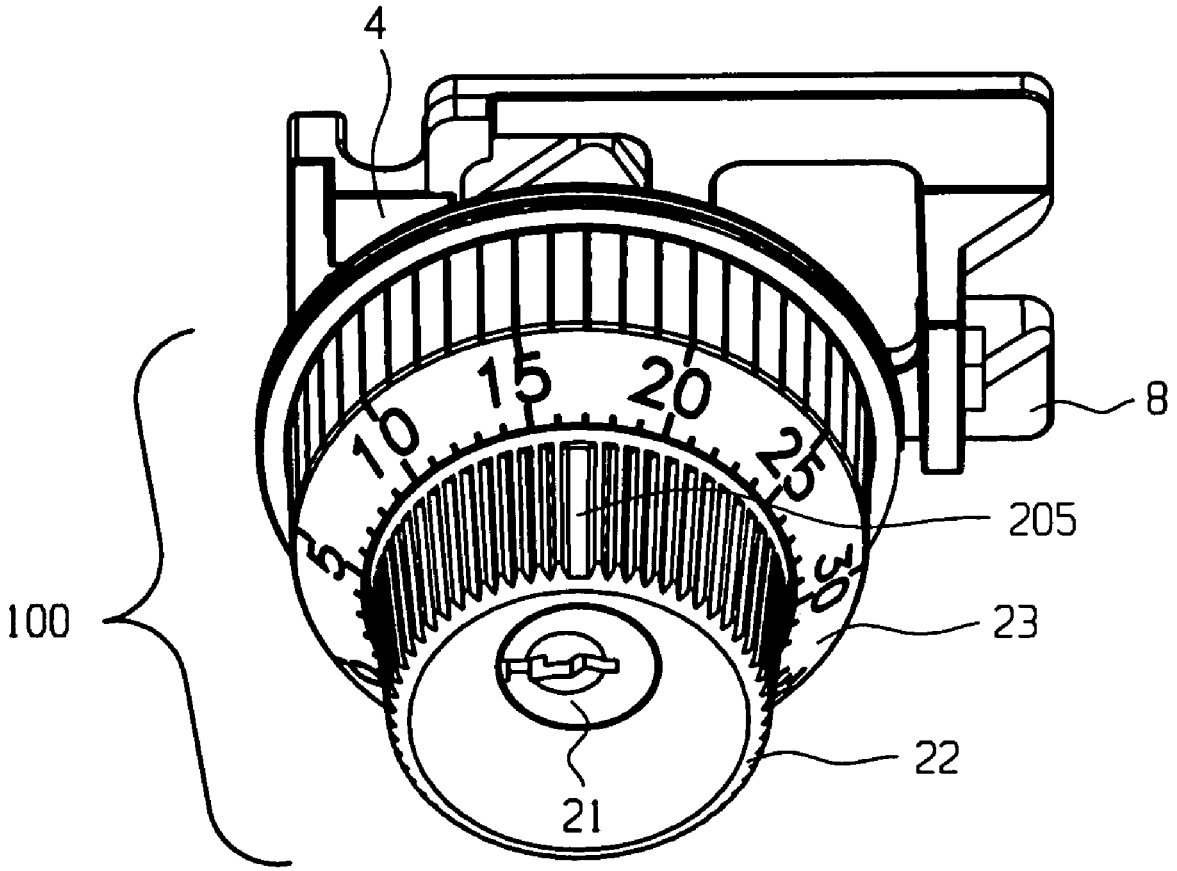
Figure 26:
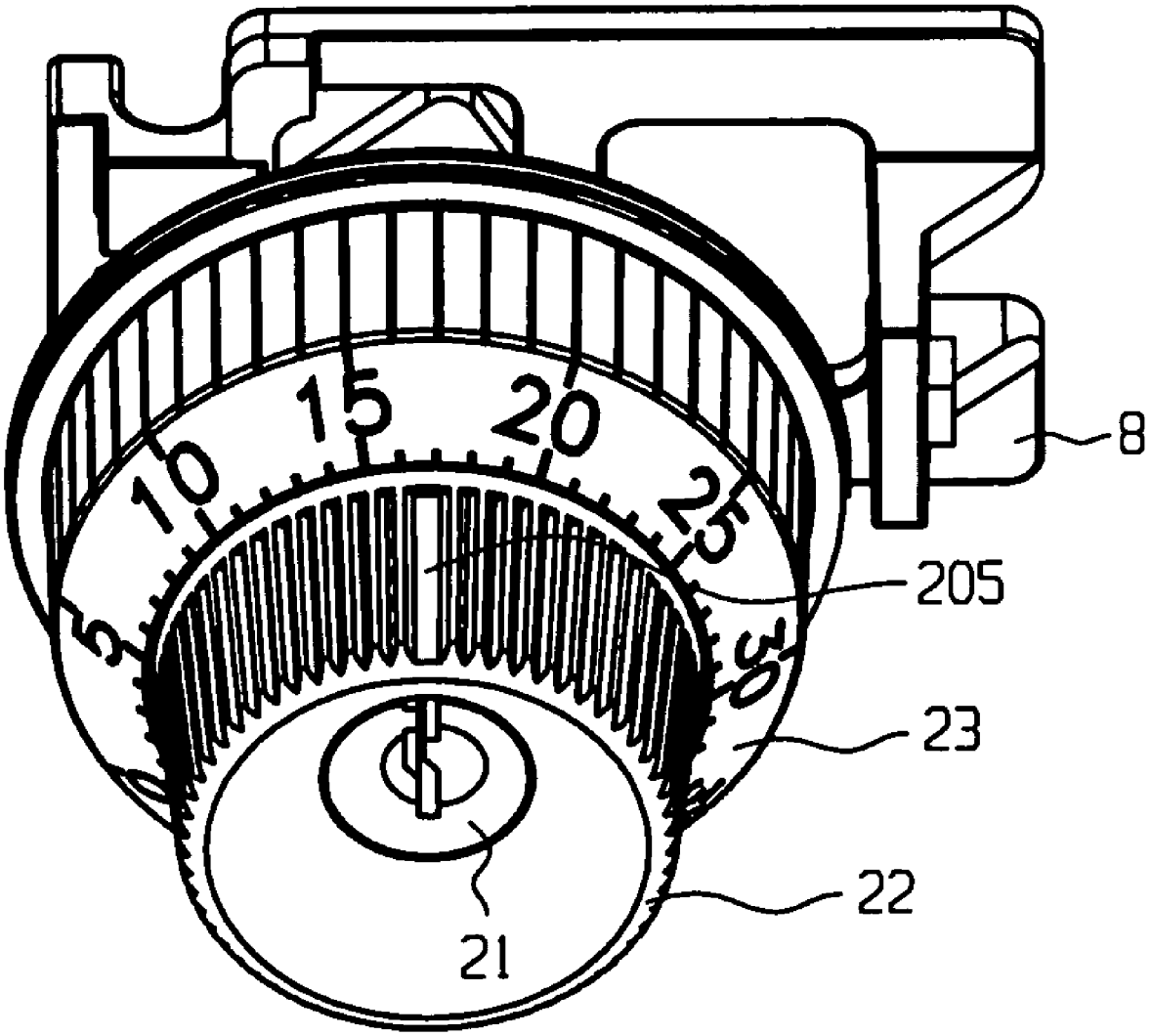

FIGS. 19-21 show a semi-assembled view of the lock and the dial assembly 100 in the locked position. While the description below is directed to the vertical lock embodiment, one skilled in the art should appreciate that the combination change aspects could apply to the horizontal lock, or other embodiments not specifically described herein. The tumbler dial 22 includes a ball bearing opening 23*a* as shown in FIG. 24. The ball bearing 20 is positioned in the dial opening 23*a* such that on one side of the opening 23*a* the ball bearing 20 engages the dial cam 19 and on the other side of the opening 23*a* the ball bearing 20 engages the number dial 23. The inside surface 23*d* of the number dial 23 contains a plurality of axial grooves 23*e* shown in FIG. 53. The ball bearing 20 engages the number dial 23 through one of these grooves 23*e* which forces the number dial 23 to rotate in conjunction with the tumbler dial 22. As shown in FIGS. 22-24, when the proper key is inserted into the key cylinder 21 and turned counter-clockwise, the dial cam 19 will be driven to allow the ball bearing 20 to drop into the pocket 23*b* in the dial cam 19, thereby disengaging the number dial 23 from the tumbler dial 22. The number dial 23 can then be rotated to another position relative to the entire dial assembly 100. The outside of the number dial 23*c* includes an indicator 205 to provide the combination changer with the proper combination code. One skilled in the art will appreciate that the indictor can be any type of mark, including a dot or series of lines, or grooves, or flat spaces, such as to indicate position. In addition the indictor may also be located on the tumbler dial or another piece that is visible and can provide indication of relative position of the number dial. The key cylinder 21 can then be rotated back to center, and the lock will have a different combination. FIGS. 19 and 26 show the relative change in the number dial such as to provide a new combination.

The lock assembly of the present invention offsets the entire key cylinder 21 to allow a larger key cylinder 21 to be placed in the tumbler dial 22 without needing to increase the relative size of the tumbler dial 22 over conventional dials. This offset is achieved through the design of the dial cam 19 on the end of the key cylinder 21. The larger key cylinder 21 enables the use of an industry standard cylinder, the use of more pins, and the use of more intricate security pins. This will provide greater security, more key cut permutations, and true master key system availability options. In addition, the number dial 23 is larger than conventional number dials which allows for a greater number of different combination changes. Whereas traditional locker locks have about 5 different changes, the locker lock of the present invention can provide for 12 or more different combinations.

The lock assembly of the present invention also provides for ease of use in the changing of the combination used on the dial. Current assemblies require the locker to be opened, the key to be inserted, rotated and held in position while a button on the back of the lock, inside the locker door, is depressed. When the button is pressed, the internal driver pin is dislocated and the dial must be continuously turned until the driver pin engages into another position. The key must be turned backed to the locked position and then be removed from the lock cylinder. Once the combination has been changed, it must be manually dialed and checked to positively identify the proper position of the internal changing mechanism, ensuring the correct combination. Use of the present invention and the indicator 205 on the outside of the dial signifying the code number, indicating the proper number for the combination code, provides for a much more efficient method of changing the locker combination. The combination code will be known only by the combination changer, so it cannot be determined by anyone else. The combination changer can use a system for storing such codes so that retrieval is simplified. As indicated above, to change the lock combination, the key is inserted, turned counterclockwise, and the number dial 22 is turned relative to the tumbler dial-23. The key is then turned back to the locked position and the key is removed. The number signified by the indicator 205 is the code for the lock combination. The locker does not need to be opened and the combination does not need to be checked.

The present invention also includes a retaining plate 24 which provides a new and improved design. It includes two places for screws to drop in, so a further covering of the screws with a sheet metal plate is unnecessary. A plastic piece 18 that has holding points inside of its two small holes, allows for easy assembly.

The foregoing descriptions of preferred embodiments of the invention have been presented for purposes of illustration and description. They are not intended to be exhaustive or to limit the invention to the precise form disclosed. Obvious modifications or variations are possible in light of the above teachings. The embodiments provide an illustration of the principles of the invention and their practical application, and enable one of ordinary skill in the art to utilize the invention in various embodiments with various modifications suited to the particular use contemplated, and within the scope of the invention as set forth in the following claims.

The invention claimed is:

1. A method of changing the combination of a lock, said method comprising:

inserting a key into a key cylinder of the lock;

rotating said key, such that said key cylinder is rotated from a first position to a second position;

rotating a user graspable number dial relative to a user graspable tumbler dial; and turning the key and the key cylinder back to first position;

wherein the step of rotating the key further comprises decoupling the number dial from the tumbler dial.

2. The method set forth in claim 1 wherein the key cylinder is mounted in the tumbler dial at a position offset from the rotational center of the tumbler dial.

3. The method set forth in claim 1 wherein at least ten combination changes are available.

4. The method as set forth in claim 1 further comprising the step of aligning a marking with a number on said number dial, wherein said number correlates to a combination to unlock the lock.

5. The method set forth in claim 1, wherein the lock remains locked while the combination is changed.

* * * * *